US007495569B2

(12) United States Patent
Pittz

(10) Patent No.: US 7,495,569 B2
(45) Date of Patent: Feb. 24, 2009

(54) COMPOSITION FOR SANITIZING HANDS AND A METHOD FOR VERIFYING AND MONITORING HAND WASHING AND SANITIZING PRACTICES

(76) Inventor: Eugene P. Pittz, 6254 W. Kraft Ave., Las Vegas, NV (US) 89130

( * ) Notice: Subject to any disclaimer, the term of this patent is extended or adjusted under 35 U.S.C. 154(b) by 174 days.

(21) Appl. No.: 11/539,588

(22) Filed: Oct. 6, 2006

(65) Prior Publication Data

US 2008/0084315 A1 Apr. 10, 2008

(51) Int. Cl.
*G08B 23/00* (2006.01)

(52) U.S. Cl. ..... 340/573.1

(58) Field of Classification Search ..... 340/573.1, 340/572.1, 540; 514/642; 600/306
See application file for complete search history.

(56) References Cited

U.S. PATENT DOCUMENTS

| | | | | |
|---|---|---|---|---|
| 5,654,341 | A * | 8/1997 | Struewing | 514/642 |
| 2004/0199058 | A1* | 10/2004 | Karam et al. | 600/306 |
| 2006/0273915 | A1* | 12/2006 | Snodgrass | 340/573.1 |
| 2008/0001763 | A1* | 1/2008 | Raja et al. | 340/573.1 |

* cited by examiner

*Primary Examiner*—Phung Nguyen
(74) *Attorney, Agent, or Firm*—Veronica-Adele R. Cao; Weiss & Moy, P.C.

(57) ABSTRACT

A method for measuring skin surface pH on sites on the hands and/or lower arm is devised for verifying and monitoring of proper hand washing and sanitizing practices. Hand sanitizer compositions are devised that allow for verifying and monitoring of proper hand sanitizing practices.

30 Claims, 33 Drawing Sheets

Table of Comparison of a Single Ivory Hand Wash by Two Workers

Worker 1: Infrequent Hand Washer, Seldom Washes Back of the Hands

| | Minute | SSpH BWJ | SSpH FWJ | Ratio BWJ/FWJ | SSpH BH | SSpH FH | SSpH BIF | SSpH FIF |
|---|---|---|---|---|---|---|---|---|
| | 0 | 4.6 | 4.62 | 1 | 4.5 | 4.62 | 5.02 | 4.98 |
| Wash | 1 | 5.98 | 6.84 | 0.87 | 5.23 | 6.25 | 7.1 | 6.86 |
| | 30 | 5.3 | 5.87 | 0.9 | 5.22 | 5.41 | 6.2 | 0.01 |
| | 60 | 5.03 | 5.49 | 0.92 | 4.59 | 5.33 | 4.83 | 5.85 |
| | 120 | 4.9 | 5.32 | 0.92 | 4.45 | 4.89 | 5.22 | 5.44 |
| | 180 | 4.73 | 4.9 | 0.97 | 4.5 | 4.84 | 5.07 | 5.14 |

Worker 2: Frequent Hand Washer, follows ServSafe Handwashing Practices

| | Minute | BWJ | FWJ | Ratio BWJ/FWJ | BH | FH | BIF | FIF |
|---|---|---|---|---|---|---|---|---|
| | 0 | 4.1 | 4 | 0.89 | 3.93 | 4.35 | 4.28 | 4.81 |
| Wash | 1 | 7.35 | 7.34 | 1 | 7 | 6.25 | 7.37 | 6.86 |
| | 30 | 5.93 | 5.97 | 0.99 | 5.4 | 4.96 | 6.27 | 5.88 |
| | 60 | 5.84 | 5.5 | 1.06 | 5.24 | 4.6 | 5.55 | 5.69 |
| | 120 | 6.2 | 5.01 | 1.24 | 4.57 | 4.39 | 5.43 | 5.19 |
| | 180 | 4.96 | 4.41 | 1.13 | 4.29 | 4.36 | 4.86 | 4.86 |

Abbreviations:

| | |
|---|---|
| Av. | Average of all six sites |
| SSpH | Skin Surface pH |
| BH | Back of the hand. |
| FH | Front of the hand(Palm) |
| BIF | Back of the index finger. |
| BWJ | Back of the wrist junction |
| FWJ | Front of the wrist junction. |
| FIF | Front of the index finger. |

Figure 3: Table of Baseline Skin Surface pH Results

| Subject | SSpH N = | Av. | BH | FH | Ratio | BIF | FIF | Ratio | BWJ | FWJ | Ratio | Age | Race | Occupation |
|---|---|---|---|---|---|---|---|---|---|---|---|---|---|---|
| EP(RH) | 14(N=2) | 4.45 | 4.17 | 4.48 | 0.93 | 4.53 | 4.79 | 0.95 | 4.41 | 4.4 | 1 | | | |
| EP(LH) | 15(N=1) | 4.69 | 4.84 | 4.64 | 1.04 | 4.67 | 5.01 | 0.93 | 4.51 | 4.52 | 1 | 67 | Caucasian | Food Safety Inspector |
| JAP(LH) | 6(N=2) | 4.52 | 4.45 | 4.49 | 0.99 | 4.6 | 4.63 | 0.99 | 4.37 | 4.5 | 0.97 | | | |
| JAP(RH) | 6(N=2) | 4.86 | 4.88 | 4.69 | 1.04 | 4.84 | 4.96 | 0.98 | 4.87 | 4.93 | 0.99 | 60 | Caucasian | Food Service Manager |
| JJP(LH) | 1(N=2) | 4.18 | 4.09 | 4.25 | 0.96 | 4.2 | 4.25 | 0.99 | 4.07 | 4.24 | 0.96 | 57 | Caucasian | Dance Instructor |
| EC(LH) | 1(N=2) | 4.91 | 4.7 | 4.79 | 0.98 | 5.03 | 5.04 | 1 | 5.03 | 4.86 | 1.03 | 60 | Oriental | Housewife |
| BM(LH) | 1(N=2) | 5.3 | 4.89 | 5.69 | 0.86 | 5.6 | 5.89 | 0.95 | 5.1 | 4.64 | 1.1 | 51 | Black | Teacher |
| BM(RH) | 1(N=2) | 5.28 | 5.22 | 5.46 | 0.96 | 5.44 | 6.02 | 0.91 | 4.82 | 4.78 | 1.01 | | | |
| LS(LH) | 1(N=2) | 4.48 | 4.29 | 4.45 | 0.96 | 4.61 | 4.7 | 0.98 | 4.41 | 4.44 | 0.99 | 40 | Caucasian | Teacher |
| LS(RH) | 1(N=2) | 4.57 | 4.51 | 4.51 | 1 | 4.74 | 4.7 | 1.01 | 4.43 | 4.51 | 0.98 | | | |
| MS(LH) | 1(N=2) | 4.64 | 4.5 | 4.67 | 0.96 | 4.64 | 4.96 | 0.94 | 4.52 | 4.47 | 1.01 | 42 | Caucasian | Manager |
| MS(RH) | 1(N=2) | 4.75 | 4.55 | 4.74 | 0.96 | 4.78 | 5.03 | 0.95 | 4.67 | 4.73 | 0.99 | | | Automotive |
| CS(LH) | 1(N=2) | 4.41 | 4.26 | 4.5 | 0.96 | 4.51 | 4.53 | 1 | 4.4 | 4.34 | 1.01 | 20 | Caucasian | Student |
| CS(RH) | 1(N=2) | 4.48 | 4.51 | 4.39 | 1.03 | 4.5 | 4.86 | 0.93 | 4.29 | 4.34 | 0.99 | | | |
| **Overall** | **Average** | **4.67** | **4.57** | **4.69** | **0.97** | **4.76** | **4.96** | **0.96** | **4.57** | **4.55** | **1** | | | |

| | | |
|---|---|---|
| **Av.** | **Back of Hand** | **4.63** |
| **Av.** | **Front of Hand** | **4.74** |
| **Av.** | **Ratios** | **0.98** |

Abbreviations

| | |
|---|---|
| Av. | Average of all six sites |
| SS pH | Skin Surface pH |
| BH | Back of the hand. |
| FH | Front of the hand(Palm) |
| BIF | Back of the index finger. |
| BWJ | Back of the wrist junction |
| FWJ | Front of the wrist junction. |
| RH | right hand |
| LH | left hand |
| FIF | Front of the index finger. |

Figure 4: Table of Comparison of a Single Ivory Hand Wash by Two Workers

Worker 1: Infrequent Hand Washer, Seldom Washes Back of the Hands

| | Minute | SSpH BWJ | SSpH FWJ | Ratio BWJ/FWJ | SSpH BH | SSpH FH | SSpH BIF | SSpH FIF |
|---|---|---|---|---|---|---|---|---|
| | 0 | 4.6 | 4.62 | 1 | 4.5 | 4.62 | 5.02 | 4.98 |
| Wash | 1 | 5.98 | 6.84 | 0.87 | 5.23 | 6.25 | 7.1 | 6.86 |
| | 30 | 5.3 | 5.87 | 0.9 | 5.22 | 5.41 | 6.2 | 0.01 |
| | 60 | 5.03 | 5.49 | 0.92 | 4.59 | 5.33 | 4.83 | 5.85 |
| | 120 | 4.9 | 5.32 | 0.92 | 4.45 | 4.89 | 5.22 | 5.44 |
| | 180 | 4.73 | 4.9 | 0.97 | 4.5 | 4.84 | 5.07 | 5.14 |

Worker 2: Frequent Hand Washer, follows ServSafe Handwashing Practices

| | Minute | BWJ | FWJ | Ratio BWJ/FWJ | BH | FH | BIF | FIF |
|---|---|---|---|---|---|---|---|---|
| | 0 | 4.1 | 4 | 0.89 | 3.93 | 4.35 | 4.28 | 4.81 |
| Wash | 1 | 7.35 | 7.34 | 1 | 7 | 6.25 | 7.37 | 6.86 |
| | 30 | 5.93 | 5.97 | 0.99 | 5.4 | 4.96 | 6.27 | 5.88 |
| | 60 | 5.84 | 5.5 | 1.06 | 5.24 | 4.6 | 5.55 | 5.69 |
| | 120 | 6.2 | 5.01 | 1.24 | 4.57 | 4.39 | 5.43 | 5.19 |
| | 180 | 4.96 | 4.41 | 1.13 | 4.29 | 4.36 | 4.86 | 4.86 |

Abbreviations:

| | |
|---|---|
| Av. | Average of all six sites |
| SSpH | Skin Surface pH |
| BH | Back of the hand. |
| FH | Front of the hand(Palm) |
| BIF | Back of the index finger. |
| BWJ | Back of the wrist junction |
| FWJ | Front of the wrist junction. |
| FIF | Front of the index finger. |

Figure 5: Recovery From A Single Hand Wash with Ivory®
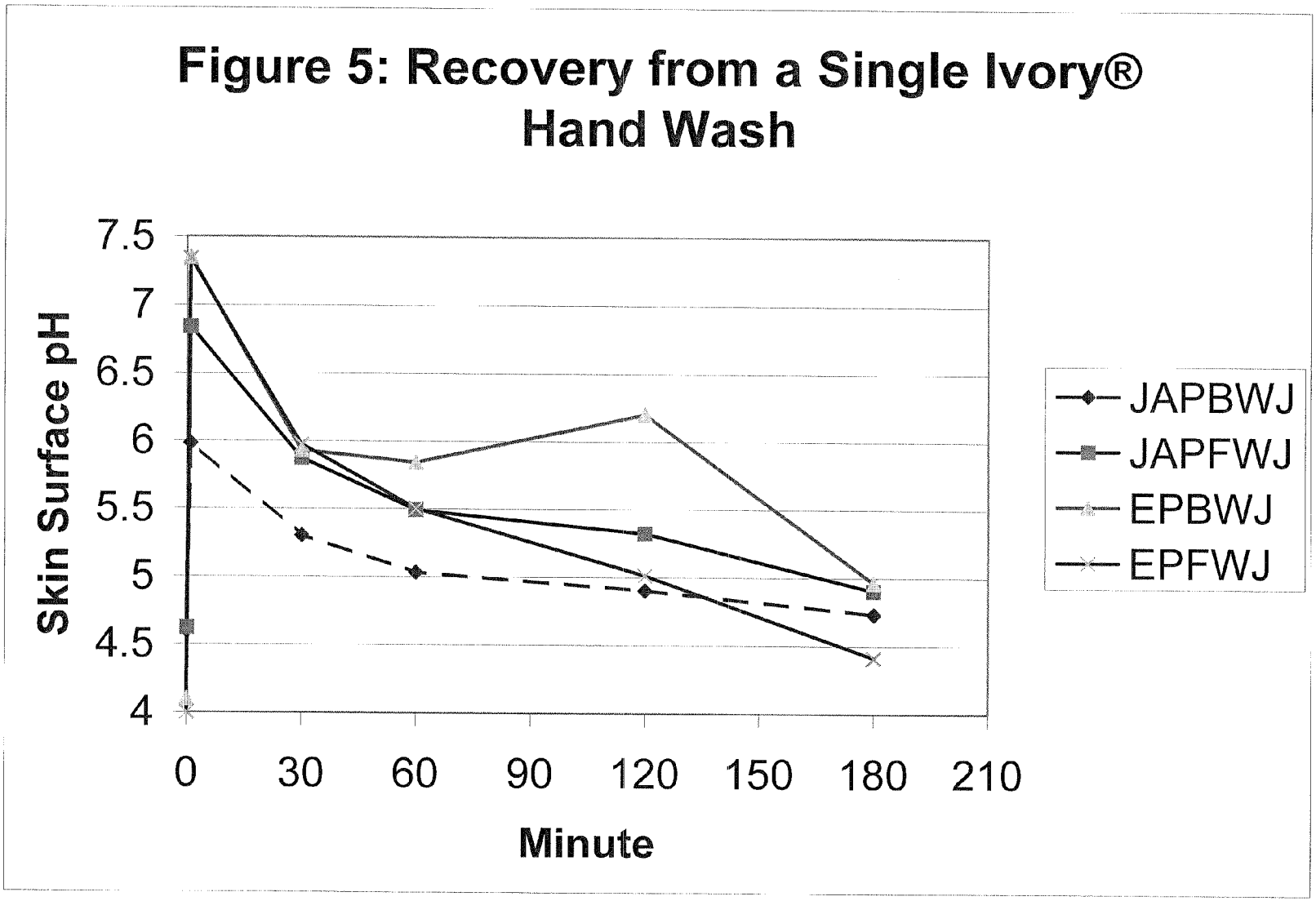

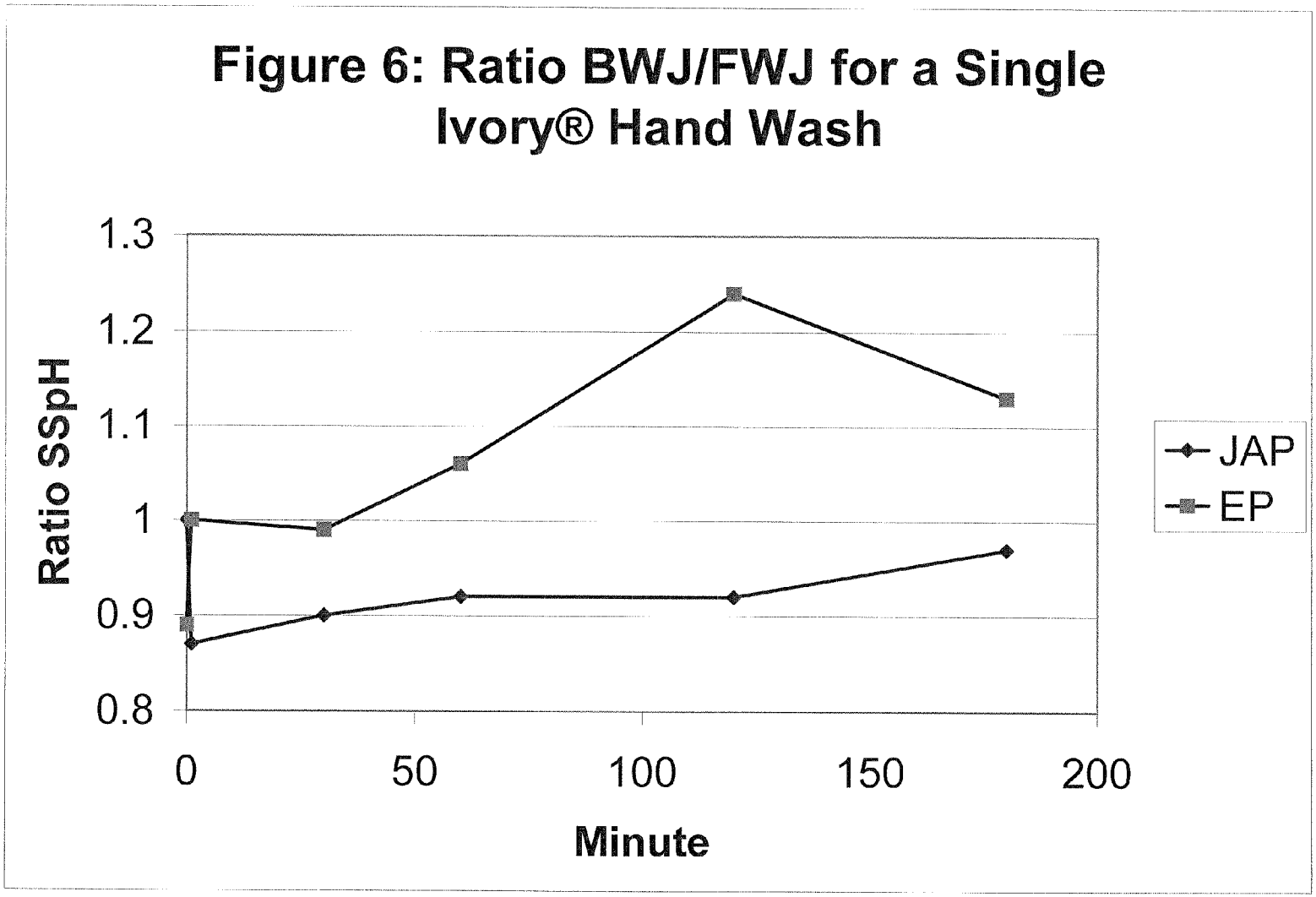
Figure 6: Ratio BWJ/FWJ for a Single Ivory® Hand Wash
Ratio SSpH
1.3
1.2
1.1
1
0.9
0.8
0
50
100
150
200
Minute
JAP
EP Figure 7: First Single Hand Wash With Various Regimens

Unwashed Skin

| Hour | SSpH BWJ | SSpH FWJ | Ratio* | SSpH BH | SSpH FH | SSpH BIF | SSpH FIF |
|---|---|---|---|---|---|---|---|
| 0 | 4.29 | 4.37 | 0.98 | 4.21 | 4.67 | 4.47 | 4.73 |
| 1 | 4.29 | 4.32 | 0.99 | 4.18 | 4.66 | 4.52 | 4.66 |
| 2 | 4.21 | 4.3 | 0.98 | 4.06 | 4.56 | 4.56 | 4.78 |
| 3 | 4.4 | 4.39 | 1 | 4.11 | 4.48 | 4.45 | 4.69 |
| 4 | 4.39 | 4.27 | 1.03 | 4.08 | 4.5 | 4.28 | 4.73 |
| 5 | 4.4 | 4.22 | 1.04 | 4.06 | 4.57 | 4.31 | 4.85 |
| 6 | 4.37 | 4.24 | 1.03 | 4.05 | 4.51 | 4.24 | 4.96 |
| 7 | 4.42 | 4.29 | 1.03 | 4.34 | 4.39 | 4.46 | 4.72 |
| 8 | 4.35 | 4.24 | 1.03 | 4.3 | 4.4 | 4.38 | 4.82 |
| 9 | 4.44 | 4.34 | 1.02 | 4.28 | 4.5 | 4.4 | 4.84 |

Distilled Water

| | Minute | BWJ | FWJ | Ratio* | BH | FH | BIF | FIF |
|---|---|---|---|---|---|---|---|---|
| | 0 | 4.51 | 4.67 | 0.97 | 4.34 | 4.52 | 4.75 | 4.87 |
| Wash | 1 | 4.39 | 4.42 | 0.99 | 4.41 | 4.48 | 4.53 | 4.67 |
| | 5 | 4.34 | 4.43 | 0.98 | 4.3 | 4.39 | 4.53 | 4.75 |
| | 10 | 4.26 | 4.52 | 0.94 | 4.19 | 4.37 | 4.54 | 4.62 |
| | 20 | 4.4 | 4.4 | 1 | 4.26 | 4.42 | 4.65 | 4.63 |

Tap Water

| | Minute | BWJ | FWJ | Ratio* | BH | FH | BIF | FIF |
|---|---|---|---|---|---|---|---|---|
| | 0 | 4.38 | 4.46 | 0.98 | 4.1 | 4.49 | 4.44 | 4.8 |
| Wash | 1 | 4.94 | 5.15 | 0.96 | 4.42 | 4.54 | 4.51 | 5 |
| | 5 | 4.81 | 4.4 | 1.09 | 4.79 | 4.72 | 4.64 | 5.11 |
| | 10 | 4.7 | 4.56 | 1.03 | 4.26 | 4.48 | 4.52 | 4.88 |
| | 15 | 4.53 | 4.43 | 1.02 | 4.28 | 4.49 | 4.45 | 4.87 |
| | 30 | 4.41 | 4.35 | 1.01 | 4.27 | 4.48 | 4.38 | 4.8 |
| | 45 | 4.42 | 4.25 | 1.04 | 4.06 | 4.5 | 4.48 | 4.75 |

SoftSoap

| | Minute | BWJ | FWJ | Ratio* | BH | FH | BIF | FIF |
|---|---|---|---|---|---|---|---|---|
| | 0 | 4.47 | 4.39 | 1.02 | 4.27 | 4.6 | 4.38 | 5.05 |
| Wash | 1 | 5.53 | 5.42 | 1.02 | 5.24 | 4.87 | 5.51 | 5.47 |
| | 30 | 4.82 | 4.53 | 1.06 | 4.31 | 4.55 | 4.86 | 5.37 |
| | 60 | 4.52 | 4.45 | 1.02 | 4.24 | 4.44 | 4.49 | 5.07 |
| | 120 | 4.49 | 4.23 | 1.06 | 4.15 | 4.38 | 4.42 | 4.91 |

Dove Bar

| | Minute | BWJ | FWJ | Ratio* | BH | FH | BIF | FIF |
|---|---|---|---|---|---|---|---|---|
| | 0 | 4.25 | 4.2 | 1.01 | 4.01 | 4.4 | 4.31 | 4.57 |
| Wash | 1 | 5.75 | 5.1 | 1.13 | 4.85 | 5.54 | 6.16 | 5.74 |
| | 15 | 4.64 | 4.37 | 1.06 | 4.58 | 4.59 | 4.98 | 4.99 |
| | 45 | 4.59 | 4.19 | 1.1 | 4.52 | 4.41 | 4.65 | 4.68 |

Lever 2000

| | Minute | BWJ | FWJ | Ratio* | BH | FH | BIF | FIF |
|---|---|---|---|---|---|---|---|---|
| | 0 | 4.36 | 4.33 | 1.01 | 4.27 | 4.5 | 4.46 | 4.68 |
| Wash | 1 | 6.46 | 6.76 | 0.95 | 5.85 | 6.21 | 6.74 | 6.88 |
| | 5 | 6.69 | 6.57 | 1.02 | 5.32 | 5.87 | 6.19 | 6.54 |
| | 10 | 6.31 | 6.56 | 0.96 | 5.38 | 5.38 | 6.37 | 6.07 |
| | 15 | 6.24 | 6.25 | 0.99 | 4.96 | 5.31 | 5.86 | 6.08 |
| | 20 | 5.99 | 5.98 | 1 | 5.83 | 5.24 | 6.11 | 6.14 |
| | 30 | 6.33 | 5.47 | 1.16 | 5.1 | 5.36 | 5.93 | 5.74 |

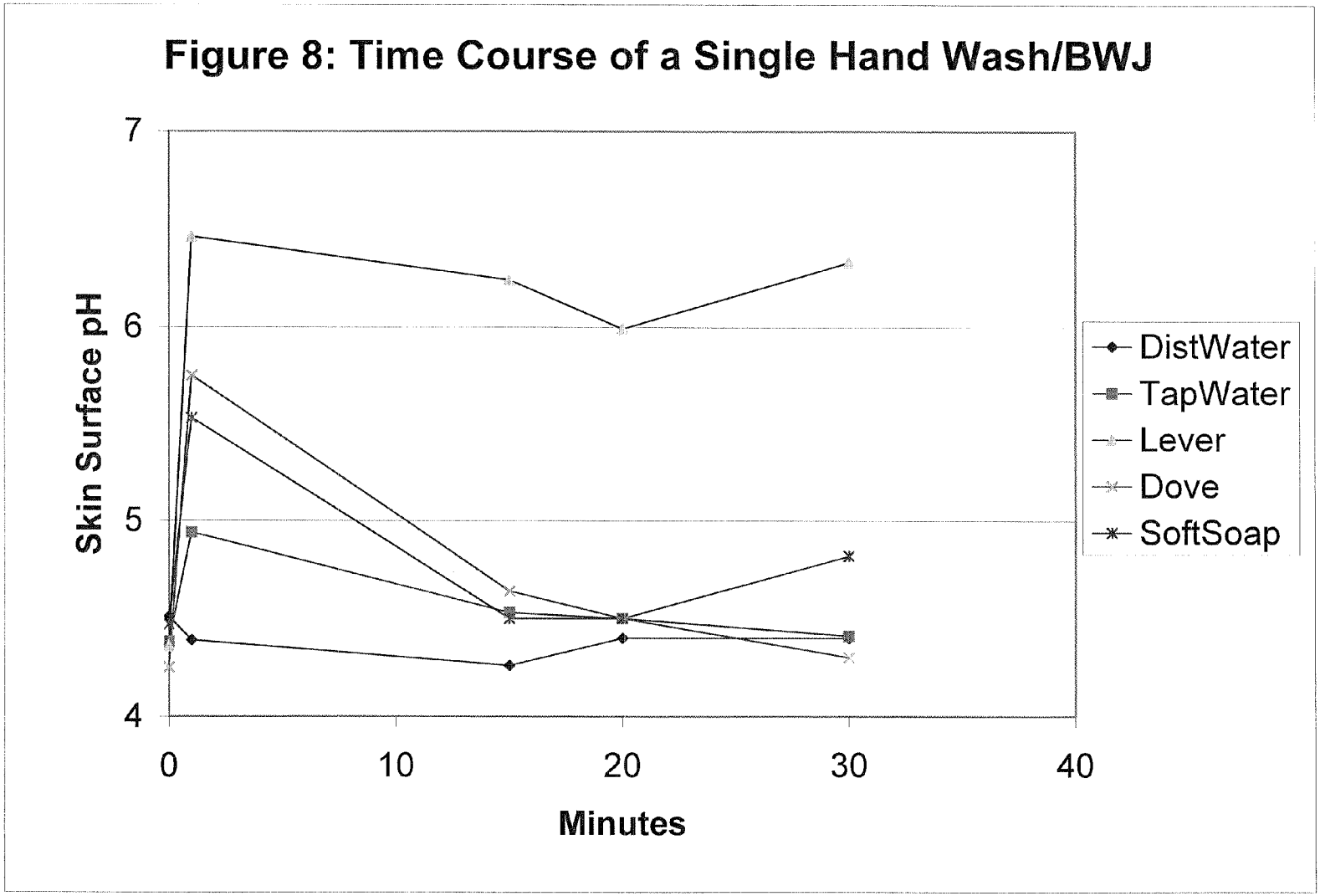
Figure 8: Time Course of a Single Hand Wash/BWJ
Skin Surface pH
7
6
5
4
0
10
20
30
40
Minutes
DistWater
TapWater
Lever
Dove
SoftSoap Figure 9: Table of Repeat Hand Washes with Method(R)

Sixty Minutes Between Washes

| | Min. | Ratio | SSpH BWJ | SSpH FWJ | SSpH BH | SSpH FH | SSpH BIF | SSpH FIF |
|---|---|---|---|---|---|---|---|---|
| | 0 | 1.02 | 4.33 | 4.24 | 4.32 | 4.45 | 4.41 | 4.72 |
| Wash | 1 | 1.02 | 5.52 | 5.13 | 4.79 | 4.94 | 5.86 | 5.24 |
| | 5 | 1.04 | 5.01 | 4.83 | 4.89 | 4.87 | 5.43 | 5.17 |
| | 10 | 0.95 | 4.96 | 5.21 | 5.02 | 4.88 | 5.09 | 5.04 |
| | 15 | 1.03 | 4.72 | 4.6 | 4.67 | 4.56 | 4.88 | 4.99 |
| | 30 | 1.08 | 4.65 | 4.29 | 4.27 | 4.47 | 4.51 | 4.86 |
| | 60 | 1.05 | 4.48 | 4.25 | 4.27 | 4.47 | 4.52 | 4.83 |
| Wash | 61 | 1.01 | 5.5 | 5.43 | 4.83 | 5.1 | 5.89 | 5.34 |
| | 65 | 1.07 | 5.28 | 4.96 | 4.75 | 4.85 | 5.5 | 5.05 |
| | 70 | 1.02 | 4.93 | 4.83 | 4.66 | 4.76 | 5.26 | 4.96 |
| | 75 | 1.07 | 5.05 | 4.7 | 4.58 | 4.72 | 4.95 | 4.97 |
| | 90 | 1.07 | 4.66 | 4.34 | 4.45 | 4.57 | 4.65 | 4.77 |
| | 120 | 1.08 | 4.56 | 4.23 | 4.21 | 4.57 | 4.82 | 4.74 |
| Wash | 121 | 1.07 | 5.66 | 5.31 | 5.01 | 4.92 | 6.1 | 5.4 |
| | 180 | 1.09 | 4.88 | 4.49 | 4.56 | 4.47 | 4.9 | 4.78 |
| Wash | 181 | 1.02 | 5.72 | 5.6 | 5.17 | 5.14 | 5.4 | 5.67 |
| | 240 | 1.03 | 5.05 | 4.91 | 4.52 | 4.52 | 5.43 | 4.92 |
| Wash | 241 | 1.09 | 6.23 | 5.72 | 5.34 | 5.28 | 6.09 | 5.37 |
| | 300 | 0.99 | 4.65 | 4.69 | 4.86 | 4.52 | 5.16 | 4.81 |
| | 360 | 1.06 | 5.03 | 4.73 | 4.52 | 4.47 | 4.85 | 4.79 |
| | 420 | 1.09 | 4.88 | 4.48 | 4.46 | 4.48 | 4.74 | 4.89 |
| | 480 | 1 | 4.41 | 4.39 | 4.26 | 4.6 | 4.7 | 4.75 |

Thirty Minutes Between Washes

| | Min | Ratio | SSpH BWJ | SSpH FWJ | SSpH BH | SSpH FH | SSpH BIF | SSpH FIF |
|---|---|---|---|---|---|---|---|---|
| | 0 | 0.94 | 4.99 | 5.33 | 4.96 | 5.02 | 4.87 | 5.49 |
| Wash | 1 | 1 | 5.93 | 5.96 | 5.88 | 5.6 | 5.93 | 5.85 |
| | 5 | 1.02 | 5.78 | 5.68 | 5.43 | 5.2 | 5.65 | 5.55 |
| | 10 | 1.04 | 5.71 | 5.48 | 5.83 | 5.03 | 5.53 | 5.38 |
| | 15 | 0.99 | 5.55 | 5.62 | 5.36 | 5.03 | 5.3 | 5.46 |
| | 30 | 1.12 | 5.45 | 4.85 | 5.15 | 4.97 | 5.01 | 5.17 |
| Wash | 31 | 1.1 | 6.15 | 5.59 | 6.01 | 5.45 | 5.97 | 5.58 |
| | 60 | 1.18 | 5.58 | 4.78 | 5.19 | 4.92 | 5.17 | 5.39 |
| Wash | 61 | 1.04 | 6.15 | 5.9 | 6.55 | 5.51 | 6.3 | 5.74 |
| | 90 | 1.15 | 5.91 | 5.15 | 5.66 | 5 | 5.9 | 5.47 |
| Wash | 91 | 1.03 | 6.22 | 6.06 | 6.2 | 5.64 | 0.34 | 5.64 |
| | 120 | 1.21 | 6.1 | 5.03 | 5.58 | 4.86 | 5.8 | 5.29 |
| Wash | 121 | 1.05 | 6.27 | 6 | 6.28 | 5.43 | 6.16 | 6.01 |
| | 150 | 1.08 | 5.87 | 5.42 | 5.47 | 5.73 | 5.71 | 5.41 |
| Wash | 151 | 1.06 | 6.54 | 6.2 | 6.41 | 5.67 | 6.48 | 5.9 |
| | 180 | 1.26 | 6.25 | 4.97 | 5.89 | 5 | 6.16 | 5.55 |
| Wash | 181 | 1.07 | 6.46 | 6.06 | 6.27 | 5.59 | 6.64 | 6.12 |
| | 210 | 1.09 | 5.98 | 5.47 | 5.8 | 5.06 | 5.87 | 5.51 |
| Wash | 211 | 0.97 | 5.99 | 6.14 | 6.05 | 5.43 | 6.39 | 5.82 |
| | 215 | 1.08 | 6.02 | 5.59 | 5.54 | 5.31 | 6.24 | 5.61 |
| | 220 | 1.15 | 5.97 | 5.2 | 5.55 | 5.11 | 5.85 | 5.49 |
| | 225 | 1.15 | 5.86 | 5.1 | 5.38 | 4.9 | 5.52 | 5.29 |
| | 240 | 1.17 | 5.53 | 4.74 | 5.44 | 4.88 | 5.39 | 5.22 |
| | 270 | 1.21 | 5.49 | 4.53 | 4.84 | 4.59 | 5.12 | 5.1 |
| | 330 | 1.26 | 5.5 | 4.36 | 4.79 | 4.69 | 4.91 | 5.11 |
| | 780 | 1.08 | 4.96 | 4.61 | 4.84 | 4.45 | 4.77 | 5.06 |
| | 1260 | 1.17 | 5.58 | 5 | 5.28 | 5.39 | 5.17 | 5.38 |

Abbreviations

| | |
|---|---|
| SS pH | Skin Surface pH |
| BWJ | Back of the wrist junction |
| FWJ | Front of the wrist junction. |
| BH | Back of the hand. |
| FH | Front of the hand(Palm) |
| BIF | Back of the index finger. |
| FIF | Front of the index finger. |

Figure 10: Sixty Min. Repeat Wash with Method®
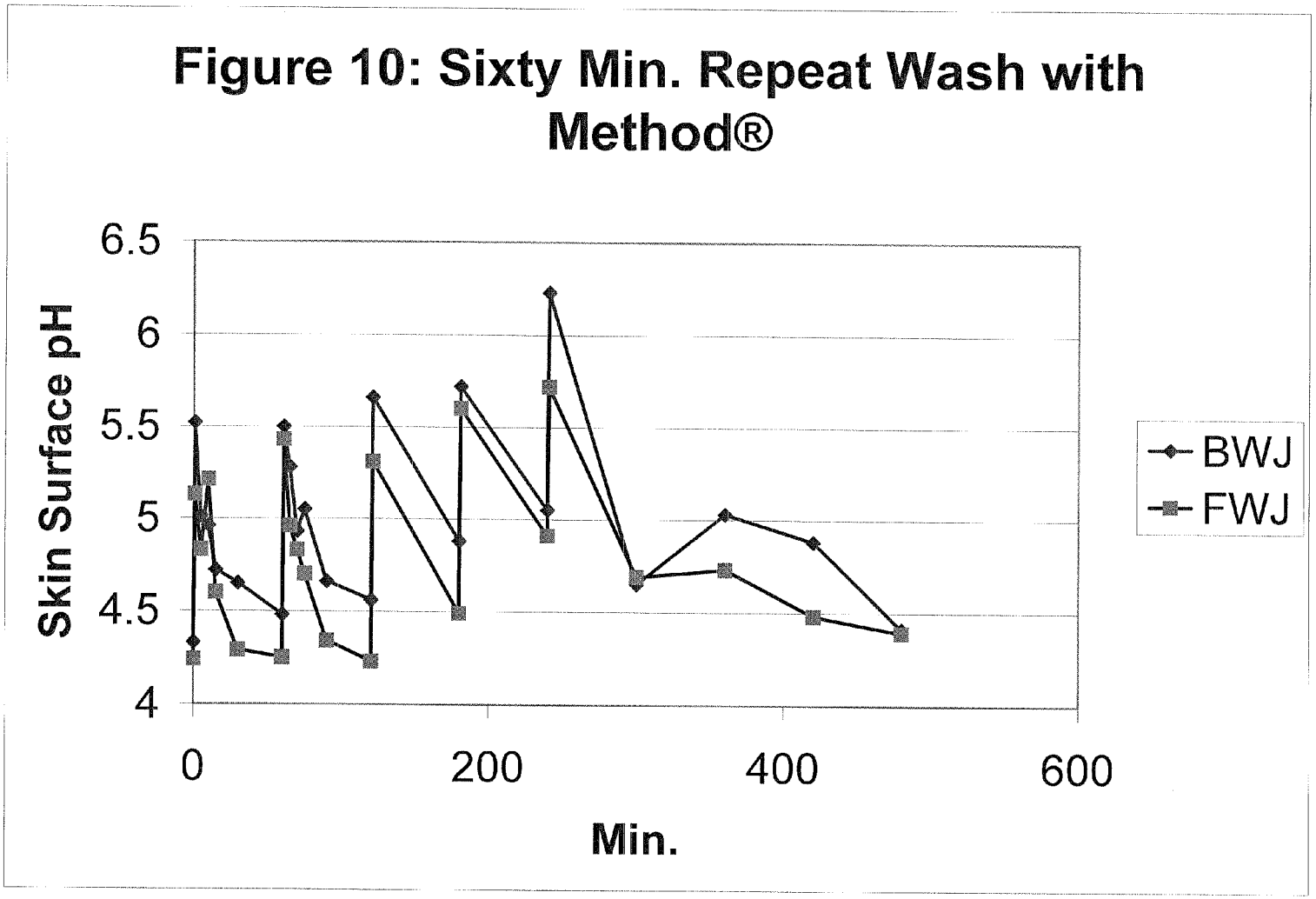

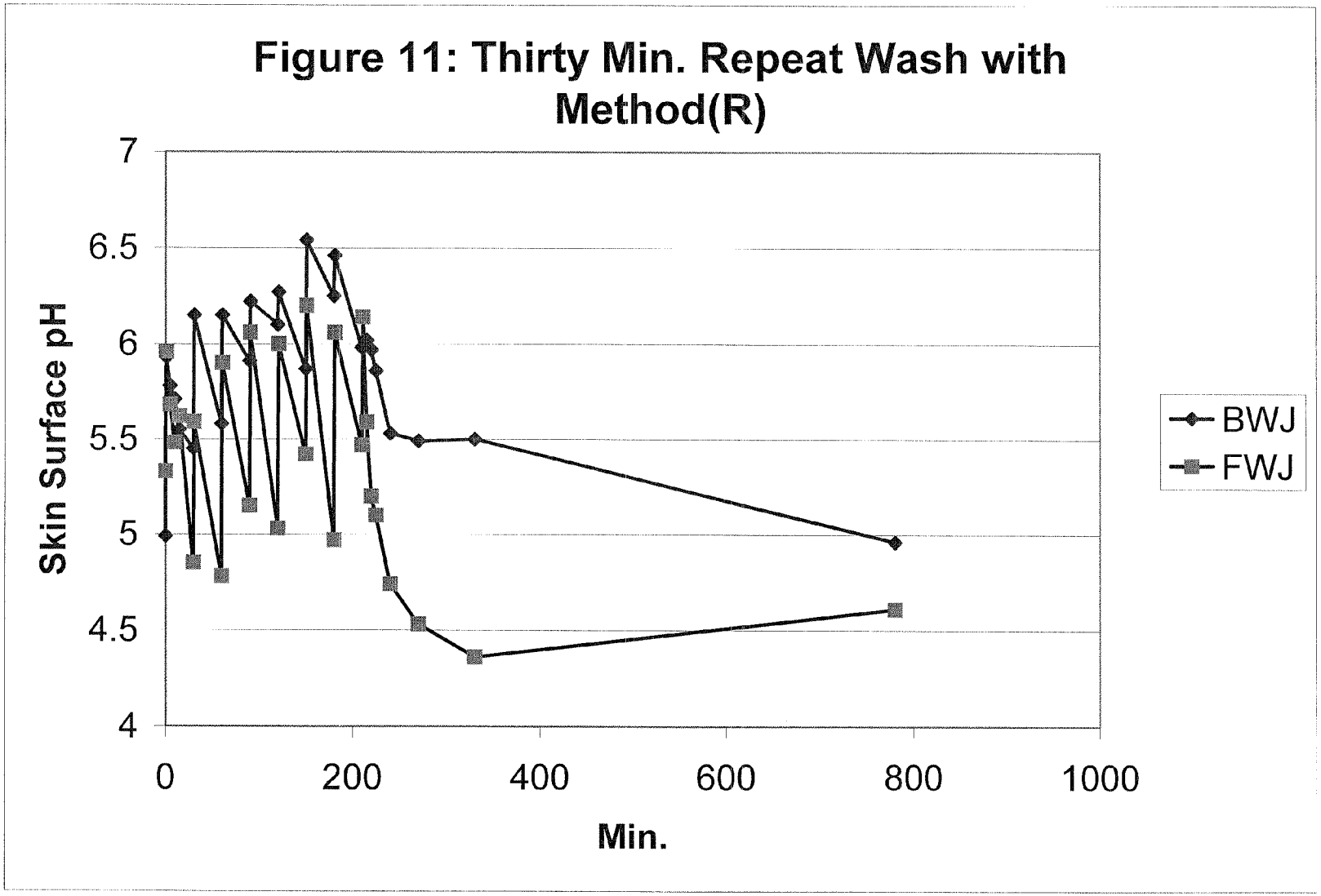
Figure 11: Thirty Min. Repeat Wash with Method(R)
Skin Surface pH
7
6.5
6
5.5
5
4.5
4
0
200
400
600
800
1000
Min.
BWJ
FWJ

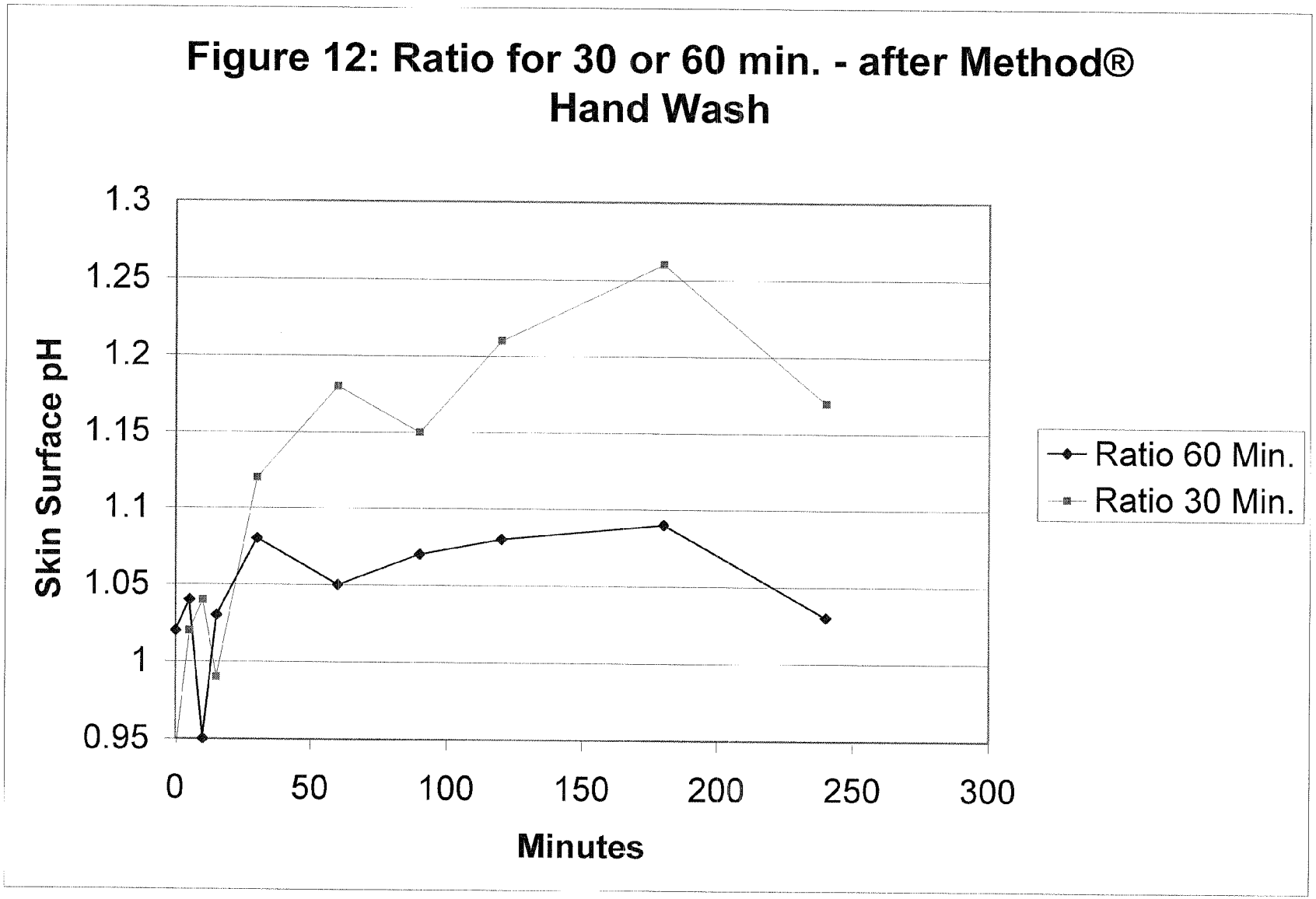
Figure 12: Ratio for 30 or 60 min. - after Method®
Hand Wash
Ratio 60 Min.
Ratio 30 Min.
Skin Surface pH
1.3
1.25
1.2
1.15
1.1
1.05
1
0.95
0
50
100
150
200
250
300
Minutes Figure 13: Table of Two Consecutive Days of 30 Min. Repeat Ivory Hand Washs

| | | 1st Day | | | | | | |
|---|---|---|---|---|---|---|---|---|
| | Min. | SSpH BWJ | SSpH FWJ | SSpH Ratio | SSpH BH | SSpH FH | SSpH BIF | SSpH FIF |
| | 0 | 4.61 | 4.53 | 1.02 | 4.67 | 4.69 | 4.76 | 5.02 |
| Wash | 1 | 8.03 | 7.56 | 1.06 | 7.64 | 7.49 | 7.62 | 7.56 |
| | 30 | 6.99 | 5.76 | 1.21 | 6.21 | 5.63 | 6.08 | 6.12 |
| Wash | 31 | 7.75 | 7.63 | 1.02 | 7.33 | 7.11 | 7.71 | 7.48 |
| | 60 | 7 | 6.13 | 1.14 | 6.33 | 5.92 | 6.74 | 7.86 |
| Wash | 61 | 7.95 | 7.71 | 1.03 | 7.56 | 7.13 | 7.96 | 7.32 |
| | 90 | 7.33 | 5.93 | 1.24 | 7.21 | 5.74 | 6.95 | 6.47 |
| Wash | 91 | 7.8 | 7.59 | 1.03 | 7.79 | 6.99 | 7.64 | 7.06 |
| | 120 | 7.31 | 6.01 | 1.22 | 6.95 | 6.11 | 7.05 | 6.33 |
| Wash | 121 | 7.74 | 7.5 | 1.03 | 7.69 | 7.31 | 7.89 | 7.43 |
| | 150 | 7.62 | 6.28 | 1.21 | 6.76 | 6.28 | 7.05 | 6.28 |
| Wash | 151 | 8.16 | 7.66 | 1.07 | 7.47 | 7.69 | 8.03 | 7.4 |
| | 180 | 6.93 | 6.03 | 1.15 | 6.35 | 6.42 | 6.61 | 6.55 |
| Wash | 181 | 8.11 | 7.47 | 1.09 | 7.36 | 7.24 | 7.61 | 7.26 |
| | 210 | 6.88 | 6.1 | 1.12 | 6.56 | 5.96 | 6.58 | 6.3 |
| Wash | 211 | 8.32 | 7.63 | 1.09 | 7.69 | 7.13 | 7.9 | 7.2 |
| | 240 | 6.95 | 5.82 | 1.19 | 6.66 | 5.91 | 6.73 | 6.62 |
| Wash | 241 | 8.09 | 7.59 | 1.07 | 7.81 | 7.59 | 7.76 | 7.45 |
| | 270 | 7.33 | 6.38 | 1.15 | 7.28 | 6.12 | 6.93 | 6.07 |
| Wash | 271 | 7.72 | 7.84 | 0.98 | 7.83 | 7.14 | 7.92 | 7.35 |
| | 300 | 7.53 | 6.16 | 1.22 | 6.71 | 5.7 | 7.16 | 6.29 |
| Wash | 301 | 8.18 | 7.4 | 1.11 | 7.21 | 7.02 | 7.41 | 7.48 |
| | 330 | 7.59 | 6.51 | 1.17 | 6.94 | 6.06 | 7.31 | 6.35 |
| Wash | 331 | 7.72 | 7.66 | 1.01 | 7.31 | 7.53 | 7.97 | 6.92 |
| | 360 | 7.45 | 6.68 | 1.12 | 6.96 | 6.03 | 7.31 | 6.5 |
| Wash | 361 | 7.57 | 7.4 | 1.02 | 7.97 | 7.34 | 8 | 7.37 |
| | 400 | 7.55 | 6.74 | 1.12 | 7.08 | 6.24 | 7.16 | 6.65 |
| Wash | 401 | 7.8 | 7.61 | 1.03 | 7.94 | 7.46 | 8.01 | 7.47 |
| | 430 | 6.4 | 5.48 | 1.17 | 6.45 | 5.56 | 6.36 | 6.13 |
| | 460 | 5.87 | 5.07 | 1.16 | 5.37 | 5.4 | 5.53 | 5.58 |
| | 640 | 4.62 | 4.36 | 1.06 | 4.57 | 4.87 | 4.43 | 5.14 |

| | | 2nd Day | | | | | | |
|---|---|---|---|---|---|---|---|---|
| | Min. | SSpH BWJ | SSpH FWJ | SSpH Ratio | SSpH BH | SSpH FH | SSpH BIF | SSpH FIF |
| | 1440 | 4.9 | 4.64 | 1.06 | 4.78 | 4.82 | 4.49 | 5.23 |
| Wash | 1441 | 6.53 | 6.6 | 0.99 | 6.66 | 4.61 | 6.83 | 7.09 |
| | 1470 | 6.54 | 5.92 | 1.11 | 6.06 | 6.74 | 6.12 | 6.12 |
| Wash | 1471 | 7.12 | 7.14 | 1 | 6.88 | 7.01 | 7.02 | 7.24 |
| | 1500 | 7.01 | 6.23 | 1.13 | 6.28 | 6.22 | 6.33 | 6.44 |
| Wash | 1501 | 7.27 | 7.15 | 1.02 | 6.77 | 7.18 | 7.3 | 7.13 |
| | 1530 | 6.32 | 5.7 | 1.11 | 6.14 | 5.86 | 6.17 | 6.25 |
| Wash | 1531 | 6.81 | 6.91 | 0.99 | 7.17 | 7.04 | 7.81 | 7.05 |
| | 1560 | 6.6 | 6.21 | 1.05 | 6.45 | 6.09 | 6.24 | 5.98 |
| Wash | 1561 | 7.08 | 7.04 | 1.01 | 6.85 | 6.96 | 7.27 | 7.17 |
| | 1590 | 6.78 | 6.01 | 1.13 | 6.52 | 5.95 | 6.6 | 6.24 |
| Wash | 1591 | 7.16 | 6.99 | 1.02 | 6.91 | 7.13 | 7.1 | 7.03 |
| | 1620 | 6.19 | 5.61 | 1.1 | 6.11 | 5.93 | 6 | 6.13 |
| Wash | 1621 | 7.14 | 7.21 | 0.99 | 6.82 | 7.06 | 7.02 | 6.86 |
| | 1650 | 6.65 | 6.15 | 1.08 | 6.65 | 5.92 | 6.27 | 6.32 |
| Wash | 1651 | 6.98 | 7.43 | 0.94 | 7.13 | 7.21 | 7.49 | 7.28 |
| | 1680 | 6.82 | 5.95 | 1.15 | 6.3 | 5.95 | 6.63 | 6.35 |
| Wash | 1681 | 7 | 7.22 | 0.97 | 6.88 | 7.22 | 7.35 | 7.33 |
| | 1710 | 6.5 | 6.05 | 1.07 | 6.28 | 6.05 | 6.58 | 6.39 |
| Wash | 1711 | 7.53 | 7.42 | 1.02 | 7.18 | 7.33 | 7.27 | 7.07 |
| | 1740 | 6.68 | 6.22 | 1.07 | 6.53 | 6.36 | 6.71 | 6.62 |
| Wash | 1741 | 7.27 | 7.43 | 0.98 | 7.32 | 7.58 | 7.7 | 7.4 |
| | 1770 | 6.86 | 6.58 | 1.02 | 6.6 | 6.37 | 6.62 | 6.45 |
| Wash | 1771 | 7.1 | 7.56 | 1.04 | 7.12 | 7.47 | 7.62 | 7.42 |
| | 1800 | 6.8 | 6.24 | 1.09 | 6.7 | 5.6 | 6.61 | 6.14 |
| Wash | 1801 | 7.32 | 7.54 | 0.97 | 6.72 | 7.56 | 7.09 | 7.41 |
| | 1830 | 6.56 | 6.65 | 0.99 | 6.52 | 6.46 | 6.75 | 6.23 |
| | 1860 | 6.39 | 5.94 | 1.08 | 6.37 | 6.61 | 6.48 | 6.31 |
| | 1890 | 6.54 | 5.55 | 1.18 | 6.49 | 5.4 | 6.08 | 5.76 |
| | 1910 | 6.1 | 5.63 | 1.08 | 6.09 | 5.42 | 6.16 | 5.52 |
| | 1980 | 6.32 | 5.43 | 1.16 | 6.1 | 5.08 | 5.7 | 5.45 |
| | 2300 | 6.15 | 5.6 | 1.09 | 6 | 5.07 | 5.58 | 5.51 |
| | 2790 | 5.21 | 5.37 | 0.97 | 4.94 | 4.9 | 4.85 | 5.09 |

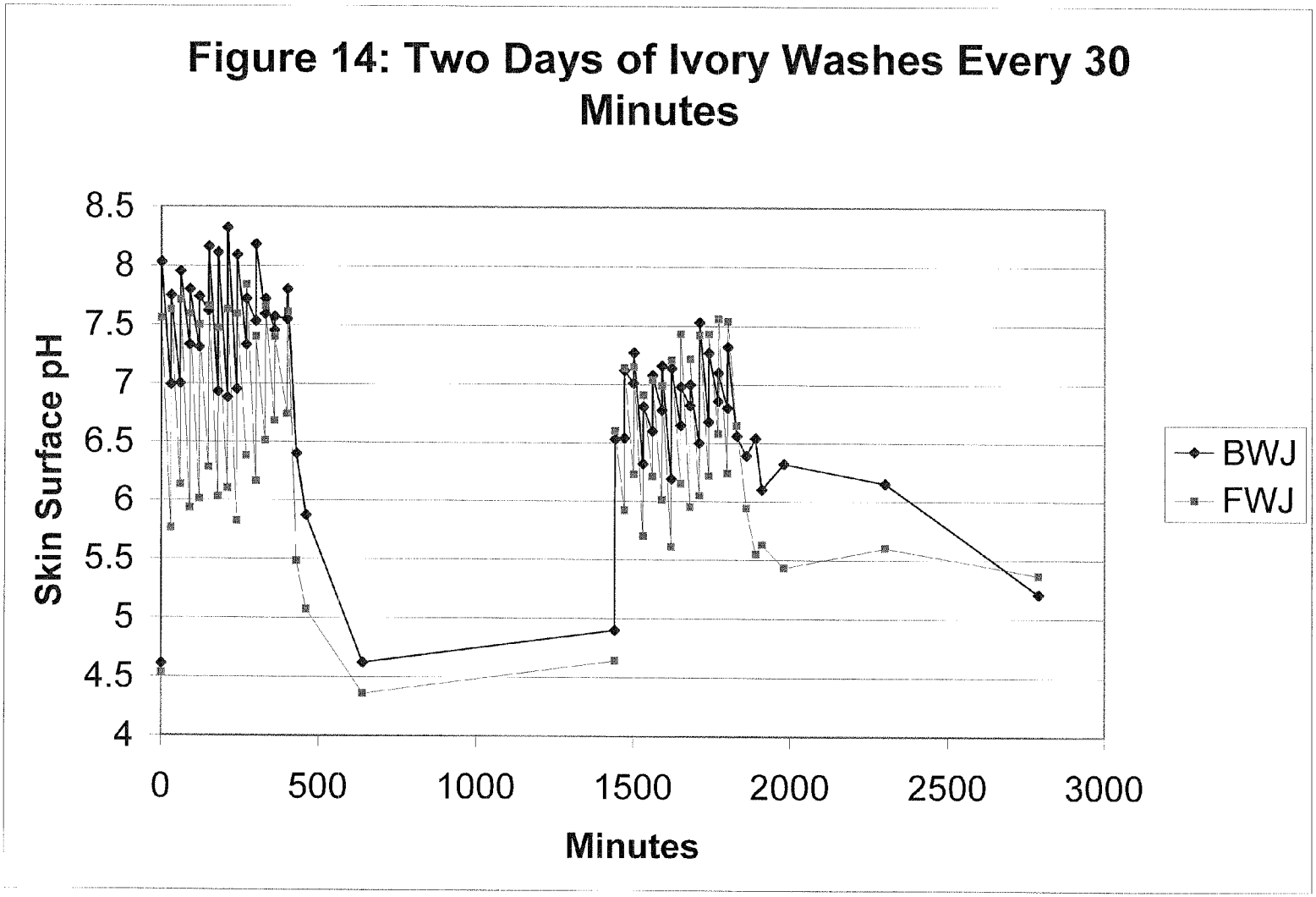
Figure 14: Two Days of Ivory Washes Every 30 Minutes
Skin Surface pH
8.5
8
7.5
7
6.5
6
5.5
5
4.5
4
0
500
1000
1500
2000
2500
3000
Minutes
BWJ
FWJ

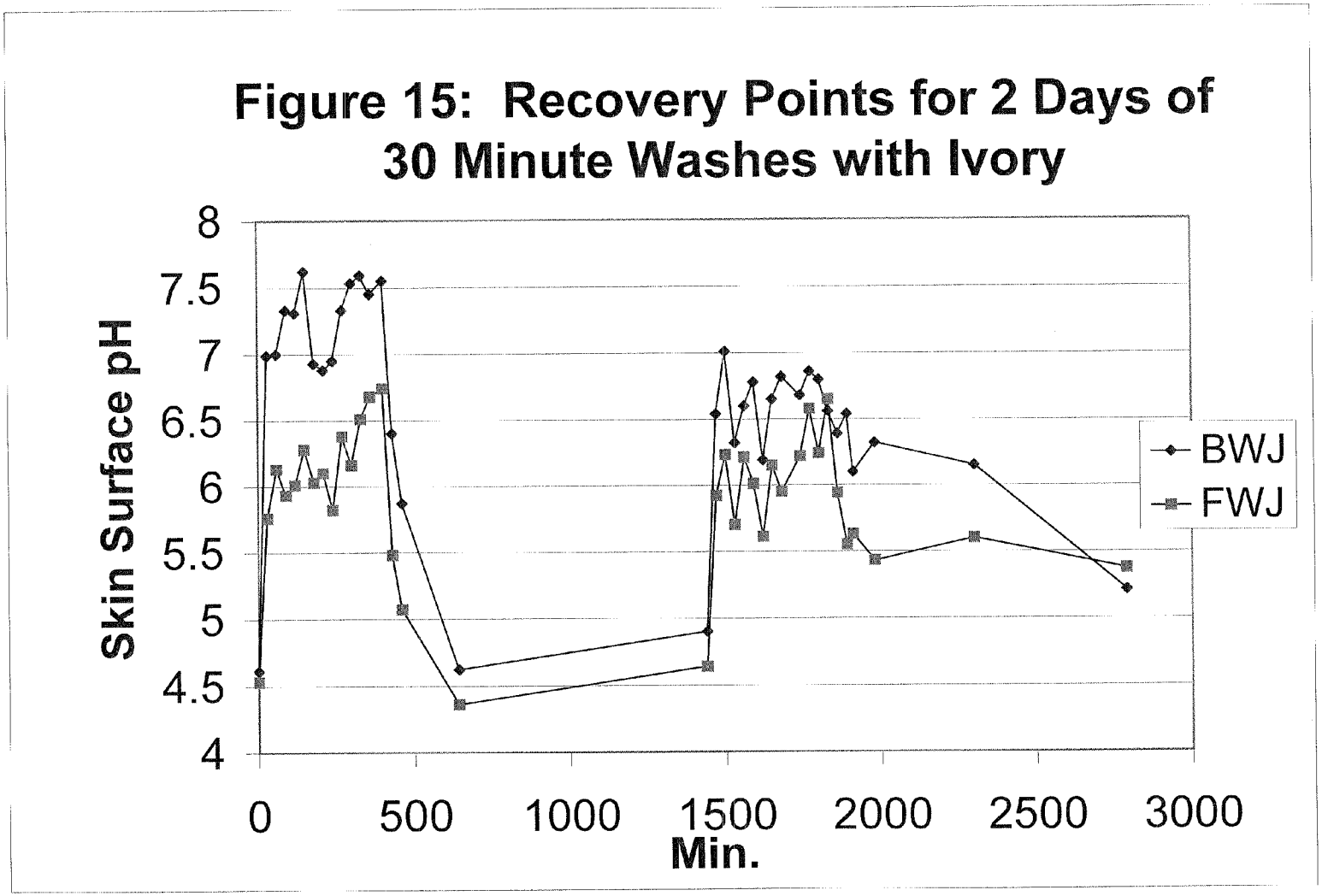
Figure 15: Recovery Points for 2 Days of 30 Minute Washes with Ivory
Skin Surface pH
8
7.5
7
6.5
6
5.5
5
4.5
4
0
500
1000
1500
2000
2500
3000
Min.
BWJ
FWJ Figure 16: Table of Crossover Study for Wetting pH Electrodes

| **Experiment # 1: (n=6)** | **SS pH Tap Water** | **SS pH Dist.Water** |
|---|---|---|
| Electrode/Sites on Left Hand Wetted With Distilled Water | | 4.86 |
| Electrode/Sites on Right Hand Wetted With Tap Water | 4.87 | |
| **Crossover (after I hour)** | | |
| Electrode/Sites on Left Hand Wetted With Tap Water | 5.28 | |
| Electrode/Sites on Right Hand Wetted With Distilled Water | | 4.62 |
| **Experiment # 2: (n=6)** | | |
| Electrode/Sites on Left Hand Wetted With Tap Water | 5.26 | |
| Electrode/Sites on Right Hand Wetted With Distilled Water | | 4.57 |
| **Crossover (after 0.5 hour)** | | |
| Electrode/Sites on Left Hand Wetted With Distilled Water | | 4.86 |
| Electrode/Sites on Right Hand Wetted With Tap Water | 5.25 | |
| **Average** | **5.17** | **4.73** |

NB: Baseline measurements taken on similar sites (N=6), simultaneously on both hands give SS pH values of : Left Hand: 4.69; Right Hand: 4.58 - indicating higher baseline SS PH values on the left compared to the right hand. Therefore, the crossover experiment compensates for such a difference.

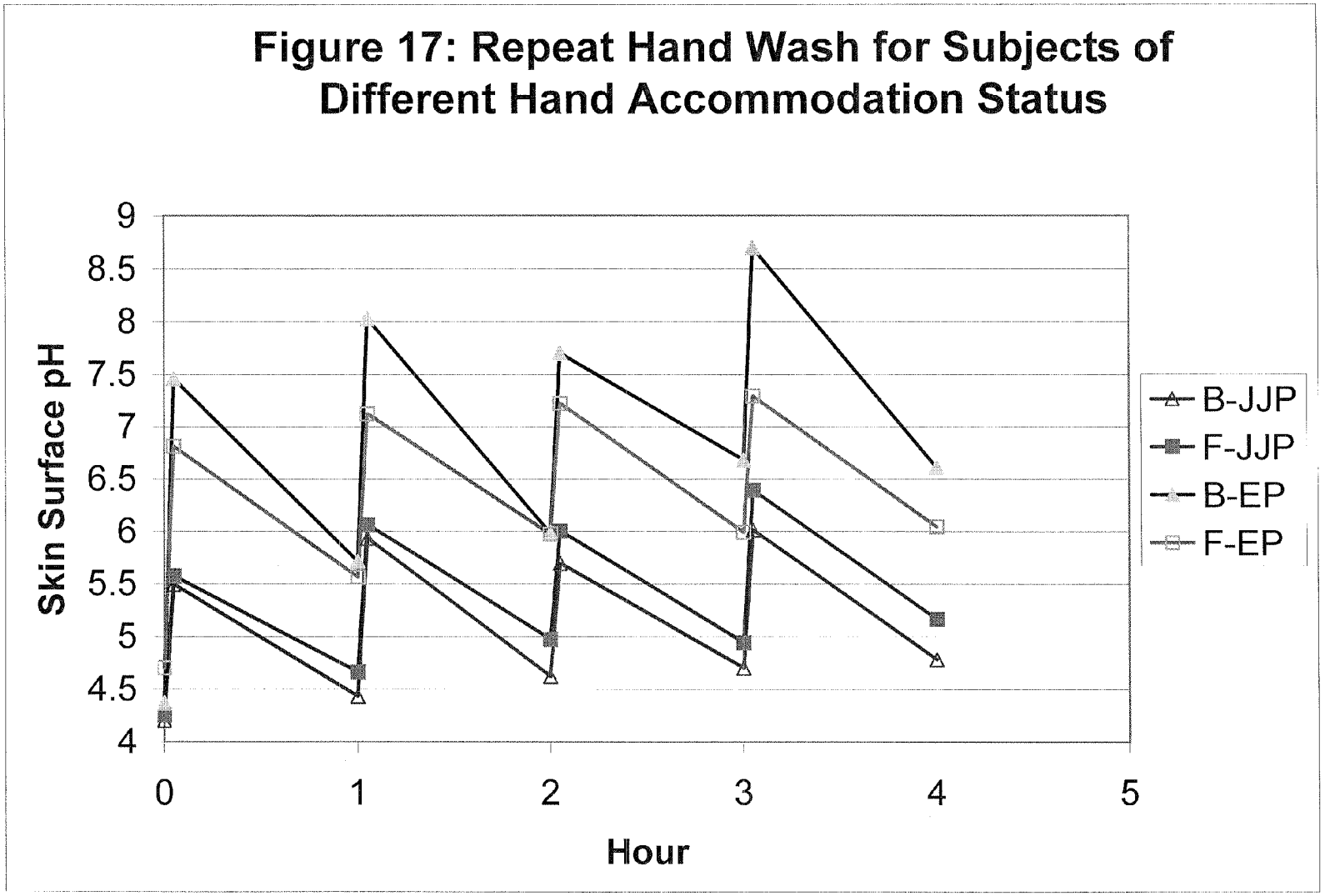
Figure 17: Repeat Hand Wash for Subjects of Different Hand Accommodation Status Figure 18: Effect of Gloves on Detecting Proper Hand Washing

1) Baseline Skin Surface pH measurements were taken on the hands

| Left Site | Hand SSpH | Right Site | Hand SSpH |
|---|---|---|---|
| BH | 4.7 | BH | 4.44 |
| FH | 4.51 | FH | 4.57 |
| BIF | 4.52 | BIF | 4.51 |
| FIF | 5.07 | FIF | 4.82 |
| BWJ | 4.69 | BWJ | 4.58 |
| FWJ | 4.72 | FWJ | 4.51 |

Av. for sites on the back of the hand = 4.57
Av. for sites on the front of the hand = 4.7
Ratio = 0.97

Abbreviations:

| | |
|---|---|
| **Av.** | Average of all six sites |
| **SSpH** | Skin Surface pH |
| **BH** | Back of the hand. |
| **FH** | Front of the hand(Palm) |
| **BIF** | Back of the index finger. |
| **BWJ** | Back of the wrist junction |
| **FWJ** | Front of the wrist junction. |
| **FIF** | Front of the index finger. |

2) Without prior hand washing, gloves were put on and worn for 5 minutes.

3) Skin Surface pH measurements were taken immediately after glove removal:

| Left Site | Hand SSpH | Right Site | Hand SSpH |
|---|---|---|---|
| BH | 4.71 | BH | 4.83 |
| FH | 4.5 | FH | 4.71 |
| BIF | 4.91 | BIF | 5.1 |
| FIF | 5.08 | FIF | 4.98 |
| BWJ | 4.95 | BWJ | 4.76 |
| FWJ | 4.68 | FWJ | 4.43 |

Av. for sites on the back of the hand = 4.88
Av. for sites on the front of the hand = 4.73
Ratio = 1.03

4) Gloves were removed

5) Hands washed with Lever 2000 (R) lather according to ServSafe Guidelines

6) Gloves were put on and worn for 5 minutes.

7) Skin Surface pH measurements were taken immediately after glove removal:

| Left Site | Hand SSpH | Right Site | Hand SSpH |
|---|---|---|---|
| BH | 6.1 | BH | 6.71 |
| FH | 5.6 | FH | 5.35 |
| BIF | 6.69 | BIF | 7.08 |
| FIF | 6.27 | FIF | 6.24 |
| BWJ | 6.86 | BWJ | 6.89 |
| FWJ | 5.92 | FWJ | 6.36 |

Av. for sites on the back of the hand = 6.89
Av. for sites on the front of the hand = 5.84
Ratio = 1.18

Figure 19: Table of Skin Surface pH QA Evaluation During Food Preparation

1) SSpH measurements prior to food preparation (Hands were in tap water during the day)

| | LftHand | Rt.Hand | Av. | Change** | Ratio | | |
|---|---|---|---|---|---|---|---|
| BH | 4.89 | 5.22 | 5.06 | xxxxxxx | | Back Sites Av. = | 5.31 |
| FH | 5.69 | 5.46 | 5.58 | xxxxxxx | 0.91 | | |
| BIF | 5.6 | 5.44 | 5.52 | xxxxxxx | | Front Sites Av. = | 5.41 |
| FIF | 5.89 | 6.02 | 5.96 | xxxxxxx | 0.93 | | |
| BWJ | 5.1 | 4.82 | 4.96 | xxxxxxx | | Overall Av. = | 5.36 |
| FWJ | 4.64 | 4.78 | 4.71 | xxxxxxx | 1.05 | | |

2) SSpH after observing the cutting of limes after handling raw salmon.
(Hand washing in between tasks was not observed)

| | LftHand | RtHand | Av. | Change** | Ratio | | |
|---|---|---|---|---|---|---|---|
| BH | 4.61 | 4.88 | 4.75 | -0.31 | | Back Sites Av. = | 4.85 |
| FH | 4.41 | 5.01 | 4.71 | -0.87 | 1.01 | | |
| BIF | 4.79 | 5.12 | 4.96 | -0.056 | | Front Sites Av. = | 4.87 |
| FIF | 5.35 | 5.5 | 5.43 | -0.53 | 1.01 | | |
| BWJ | 4.85 | 4.86 | 4.85 | -0.11 | | Overall Av. = | 4.86 |
| FWJ | 4.38 | 4.55 | 4.47 | -0.24 | 1.09 | | |

3) SSpH after observing touching garbage, then mixing wet vegetables with both hands.
(Hand washing in between tasks was not observed)

| | LftHand | RtHand | Av. | Change** | Ratio | | |
|---|---|---|---|---|---|---|---|
| BH | 6.23 | 5.68 | 5.96 | 0.9 | | Back Sites Av. = | 5.66 |
| FH | 6.03 | 6.22 | 6.13 | 0.55 | 0.97 | | |
| BIF | 6.03 | 6.45 | 6.24 | 0.72 | | Front Sites Av. = | 5.77 |
| FIF | 6.75 | 6.61 | 6.68 | 0.72 | 0.93 | | |
| BWJ | 5.03 | 4.52 | 4.78 | **-0.18** | | Overall Av. = | 5.72 |
| FWJ | 5.2 | 4.81 | 5.01 | **0.3** | 1.08 | | |

4) SSpH after worker was requested to wash hands by the ServSafe method*

| | LftHand | RtHand | Av. | Change** | Ratio | | |
|---|---|---|---|---|---|---|---|
| BH | 5.91 | 6.5 | 6.21 | 1.15 | | Back Sites Av. = | 6.4 |
| FH | 6.31 | 6.73 | 6.52 | 0.94 | 0.95 | | |
| BIF | 6.56 | 6.63 | 6.6 | 1.08 | | Front Sites Av. = | 6.5 |
| FIF | 6.56 | 6.73 | 6.65 | 0.69 | 0.99 | | |
| BWJ | 6.38 | 6.41 | 6.4 | **1.44** | | Overall Av. = | 6.45 |
| FWJ | 6.52 | 6.15 | 6.34 | **1.63** | 1.01 | | |

* Washed hands with Kirkland dish liquid Antibacterial hand soap.

Change** Change from the SSpH measurement taken at the start of the Study.

pH of the tap water is 7.50

Figure 20: Table of Effect of Norwegian Formula Hand Cream on SSpH After Hand Washing

Step1) Baseline SSpH Measurements are taken:

| | SSpH Left | SSpH Right | %Diff. |
|---|---|---|---|
| BH | 4.7 | 4.37 | xxx |
| FH | 4.59 | 4.61 | xxx |
| BIF | 4.85 | 4.64 | xxx |
| FIF | 5.26 | 5.1 | xxx |
| Av. | **4.85** | **4.68** | 4 |
| BWJ | 4.7 | 4.73 | xxx |
| FWJ | 4.66 | 4.8 | xxx |
| Av. | **4.68** | **4.77** | -2 |

Step 2)Hands washed- Lever2000®,Norwegian HC applied to right hand @BH,FH BIF,FIF

| | Left | Right | %Diff. | Corr* |
|---|---|---|---|---|
| BH | 6.64 | 5.77 | xxx | xxx |
| FH | 6.14 | 5.67 | xxx | xxx |
| BIF | 6.18 | 5.98 | xxx | xxx |
| FIF | 6.05 | 5.98 | xxx | xxx |
| Av. | **6.25** | **5.85** | -6 | 2 |
| BWJ | 6.73 | 6.8 | xxx | xxx |
| FWJ | 6 | 6.29 | xxx | xxx |
| Av. | **6.37** | **6.55** | -3 | -1 |

Step3) Hands immediately washed and are then rested for 2.5 hours.

Step 4)Hands washed - Dove Bar®, Norwegian HC applied to left hand @ BH,FH,BIF,FIF

| | Left | Right | %Diff. | Corr* |
|---|---|---|---|---|
| BH | 4.29 | 6.34 | xxx | xxx |
| FH | 4.59 | 5.36 | xxx | xxx |
| BIF | 4.26 | 6.3 | xxx | xxx |
| FIF | 4.74 | 5.9 | xxx | xxx |
| Av. | **4.47** | **5.98** | -25 | -29 |
| BWJ | 6.07 | 6.47 | xxx | xxx |
| FWJ | 5.63 | 5.87 | xxx | xxx |
| Av. | **5.85** | **6.17** | -5 | -3 |

Step 4)Hands washed - Dove Bar®

| | Left | Right | %Diff. | Corr* |
|---|---|---|---|---|
| BH | 5.81 | 5.93 | xxx | xxx |
| FH | 5.71 | 5.97 | xxx | xxx |
| BIF | 6.15 | 6.69 | xxx | xxx |
| FIF | 5.97 | 6.23 | xxx | xxx |
| Av. | **5.91** | **6.21** | -5 | -9 |
| BWJ | 6.37 | 6.39 | xxx | xxx |
| FWJ | 5.81 | 6.07 | xxx | xxx |
| Av. | **6.09** | **6.23** | -2 | -1 |

Abbreviations:

| | |
|---|---|
| Av. | Average of designated sites |
| SSpH | Skin Surface pH |
| BH | Back of the hand. |
| FH | Front of the hand(Palm) |
| BIF | Back of the index finger. |
| BWJ | Back of the wrist junction |
| FWJ | Front of the wrist junction. |
| FIF | Front of the index finger. |
| Corr* | Correction for baseline SSpH bias. |
| Left | Left Hand |
| Right | Right Hand |
| HC | Hand Cream |

Figure 21: Calibration and Detection of Proper Hand Washing

1) Baseline Skin Surface pH measurements were taken on the Inspectors hands

| Left Hand | | Right Hand | | | | Δ pH | RΔpH |
|---|---|---|---|---|---|---|---|
| **Site** | **SSpH** | **Site** | **SSpH** | **Av.** | **Ratio** | xxx | xxx |
| BH | 4.63 | BH | 4.44 | 4.53 | xxx | xxx | xxx |
| FH | 4.58 | FH | 4.89 | 4.73 | 0.96 | xxx | xxx |
| BIF | 4.84 | BIF | 4.78 | 4.81 | xxx | xxx | xxx |
| FIF | 5.25 | FIF | 5.12 | 5.18 | 0.79 | xxx | xxx |
| BWJ | 4.71 | BWJ | 4.57 | 4.64 | xxx | xxx | xxx |
| FWJ | 4.73 | FWJ | 4.58 | 4.62 | 1 | xxx | xxx |
| **Av.** | **4.79** | | **4.73** | **4.75** | **0.92** | | |

2)Inspector's SS pH's were taken immediately after hand washing with Lever2000®:

| Left Hand | | Right Hand | | | | | |
|---|---|---|---|---|---|---|---|
| **Site** | **SSpH** | **Site** | **SSpH** | **Av.** | **Ratio** | **Δ pH** | **RΔpH** |
| BH | 5.85 | BH | 7.08 | 6.48 | xxx | 1.95 | xxx |
| FH | 6.62 | FH | 6.44 | 6.53 | 0.99 | 1.8 | 1.08 |
| BIF | 6.89 | BIF | 7.2 | 7.05 | xxx | 2.24 | xxx |
| FIF | 6.66 | FIF | 6.49 | 6.57 | 1.07 | 1.35 | 1.66 |
| BWJ | 6.8 | BWJ | 7.15 | 6.97 | xxx | 2.33 | xxx |
| FWJ | 6.48 | FWJ | 5.68 | 6.08 | 1.15 | 1.46 | 1.6 |
| **Av.** | **6.55** | | **6.67** | **6.61** | **1.07** | **1.86** | **1.45** |

3) Baseline Skin Surface pH measurements were taken on the new worker's hands

| Left Hand | | Right Hand | | | | | |
|---|---|---|---|---|---|---|---|
| **Site** | **SSpH** | **Site** | **SSpH** | **Av.** | **Ratio** | **Δ pH** | **RΔpH** |
| BH | 4.72 | BH | 4.52 | 4.62 | xxx | xxx | xxx |
| FH | 4.69 | FH | 4.45 | 4.67 | 0.99 | xxx | xxx |
| BIF | 4.88 | BIF | 4.42 | 4.66 | xxx | xxx | xxx |
| FIF | 4.75 | FIF | 4.61 | 4.67 | 1 | xxx | xxx |
| BWJ | 4.34 | BWJ | 4.51 | 4.42 | xxx | xxx | xxx |
| FWJ | 4.29 | FWJ | 4.3 | 4.3 | 1.03 | xxx | xxx |
| **Av.** | **4.6** | | **4.5** | **4.55** | **1.01** | xxx | xxx |

4) The new worker's SSpH measurements were taken after hand washing with Lever2000®:

| Left Hand | | Right Hand | | | | | |
|---|---|---|---|---|---|---|---|
| **Site** | **SSpH** | **Site** | **SSpH** | **Av.** | **Ratio** | **Δ pH** | **RΔpH** |
| BH | 5.85 | BH | 6.49 | 6.17 | xxx | 1.55 | xxx |
| FH | 6.88 | FH | 7.03 | 6.98 | 0.88 | 2.31 | 0.67 |
| BIF | 6.56 | BIF | 6.52 | 6.54 | xxx | 1.88 | xxx |
| FIF | 6.21 | FIF | 6.2 | 6.21 | 1.05 | 1.55 | 1.21 |
| BWJ | 6.18 | BWJ | 5.87 | 6.03 | xxx | 1.61 | xxx |
| FWJ | 6.48 | FWJ | 6.43 | 6.45 | 0.94 | 2.15 | 0.75 |
| **Av.** | **6.36** | | **6.42** | **6.39** | **0.96** | **1.84** | **0.88** |

Abbreviations:

| | | | |
|---|---|---|---|
| **Av.** | Average of all six sites | **BWJ** | Back of the wrist junction |
| **SSpH** | Skin Surface pH | **FWJ** | Front of the wrist junction. |
| **BH** | Back of the hand. | **FIF** | Front of the index finger. |
| **FH** | Front of the hand(Palm) | **RΔpH** | RatioΔpH |
| **BIF** | Back of the index finger. | | |

Figure 22: Table of Accommodation of Calloused Hands to Soap

Step 1: Baseline SSpH's 3 Week's before hand accommodation protocol bagan:

| (N=2) | SSpH Left | R(B/F) |
|---|---|---|
| **BH** | 4.09 | xxxx |
| **FH** | 4.25 | 0.96 |
| **BIF** | 4.2 | xxxx |
| **FIF** | 4.25 | 0.99 |
| **BWJ** | 4.07 | xxxx |
| **FWJ** | 4.25 | 0.96 |
| **Av.** | **4.19** | **0.97** |

Step 2: Worker washed hands with Ivory according to ServSafe Guidelines:

| (N=2) | SSpH Left | R(B/F) | ΔpH | RΔpH |
|---|---|---|---|---|
| **BH** | 5.03 | xxxx | 0.94 | xxxx |
| **FH** | 5.37 | 0.94 | 1.12 | 0.84 |
| **BIF** | 5.49 | xxxx | 1.28 | xxxx |
| **FIF** | 5.75 | 0.96 | 1.5 | 0.85 |
| **BWJ** | 4.9 | xxxx | 0.83 | xxxx |
| **FWJ** | 5.22 | 0.94 | 0.97 | 0.86 |
| **Av.** | **5.29** | **0.95** | **1.11** | **0.85** |

Step 3: Baseline SSpH after worker washed hands with Ivory 10 times per day for 8 days:

| (N=2) | SSpH Left | SSpH Right | Av. | R(B/F) |
|---|---|---|---|---|
| **BH** | 4.5 | 4.48 | 4.49 | xxxx |
| **FH** | 4.74 | 4.72 | 4.73 | 0.95 |
| **BIF** | 4.74 | 4.59 | 4.65 | xxxx |
| **FIF** | 5.25 | 5.09 | 5.17 | 0.99 |
| **BWJ** | 4.63 | 4.93 | 4.78 | xxxx |
| **FWJ** | 4.51 | 4.6 | 4.56 | 1.05 |
| **Av.** | **4.73** | **4.74** | **4.73** | **1** |

Step 4: Accommodated Worker washed hands with Ivory according to ServSafe Guidelines:

| (N=2) | SSpH Left | SSpH Right | Av. | R(B/F) | ΔpH | RΔpH |
|---|---|---|---|---|---|---|
| **BH** | 5.54 | 6.09 | 5.82 | xxxx | 1.33 | xxxx |
| **FH** | 6.38 | 6.6 | 6.49 | 0.9 | 1.73 | 0.78 |
| **BIF** | 6.08 | 5.75 | 5.92 | xxxx | 1.27 | xxxx |
| **FIF** | 6.9 | 6.5 | 6.7 | 0.88 | 1.53 | 0.83 |
| **BWJ** | 6.19 | 6.24 | 6.37 | xxxx | 1.59 | xxxx |
| **FWJ** | 5.9 | 5.87 | 5.89 | 1.08 | 1.33 | 1.2 |
| **Av.** | **6.17** | **6.18** | **6.19** | **0.95** | **1.46** | **0.94** |

Abbreviations:

| | | | |
|---|---|---|---|
| **Av.** | Average of all six sites | **BWJ** | Back of the wrist junction |
| **SSpH** | Skin Surface pH | **FWJ** | Front of the wrist junction. |
| **BH** | Back of the hand. | **FIF** | Front of the index finger. |
| **FH** | Front of the hand(Palm) | **RΔpH** | RatioΔpH |
| **BIF** | Back of the index finger. | **R(B/F** | Ratio Back to Front |
| **Left** | Left Hand | **Right** | Right Hand |

Figure 23: Table of Dance Instructor's 30 Min. Repeat Ivory(R) Hand Washes

| | Min. | SSpH BWJ | SSpH FWJ | SSpH Ratio | SSpH BH | SSpH FH | SSpH BIF | SSpH FIF |
|---|---|---|---|---|---|---|---|---|
| N=2 | 0 | 4.79 | 4.66 | 1.03 | 4.44 | 4.28 | 4.52 | 4.68 |
| Wash | 1 | 7.14 | 6.55 | 1.09 | 6.98 | 7.07 | 6.77 | 7.23 |
| | 30 | 6.59 | 5.53 | 1.19 | 5.63 | 5.76 | 5.72 | 6.06 |
| Wash | 31 | 7.03 | 6.78 | 1.04 | 6.78 | 7.81 | 7.64 | 6.98 |
| | 60 | 6.44 | 6.15 | 1.05 | 6.15 | 6.09 | 6.23 | 6.44 |
| Wash | 61 | 7.17 | 7.23 | 0.99 | 6.81 | 7.61 | 7.45 | 7.48 |
| | 90 | 7.19 | 6.7 | 1.07 | 6.36 | 6.31 | 6.55 | 6.56 |
| Wash | 91 | 7.56 | 7.58 | 1 | 7 | 6.73 | 7.67 | 7.33 |
| | 120 | 7.16 | 6.78 | 1.06 | 6.19 | 6.3 | 6.95 | 6.6 |
| Wash | 121 | 7.41 | 7.47 | 0.99 | 6.36 | 6.45 | 7.77 | 7.45 |
| | 150 | 7.04 | 6.52 | 1.13 | 6.21 | 6.43 | 6.98 | 6.79 |
| Wash | 151 | 7.37 | 7.43 | 0.99 | 7.31 | 7.76 | 7.73 | 7.56 |
| | 180 | 7.05 | 7.02 | 1 | 6.57 | 6.56 | 6.56 | 6.74 |
| | 210 | 6.49 | 6.39 | 1.02 | 6 | 5.92 | 6.24 | 6.11 |
| | 240 | 6.48 | 6.33 | 1.02 | 5.36 | 5.92 | 6.4 | 6.18 |
| | 300 | 4.96 | 4.77 | 1.04 | 4.46 | 4.78 | 4.51 | 4.96 |

Abbreviations:

| | | | |
|---|---|---|---|
| Av. | Average of all six sites | BWJ | Back of the wrist junction |
| SSpH | Skin Surface pH | FWJ | Front of the wrist junction. |
| BH | Back of the hand. | FIF | Front of the index finger. |
| FH | Front of the hand(Palm) | RΔpH | RatioΔpH |
| BIF | Back of the index finger. | R(B/F | Ratio Back to Front |

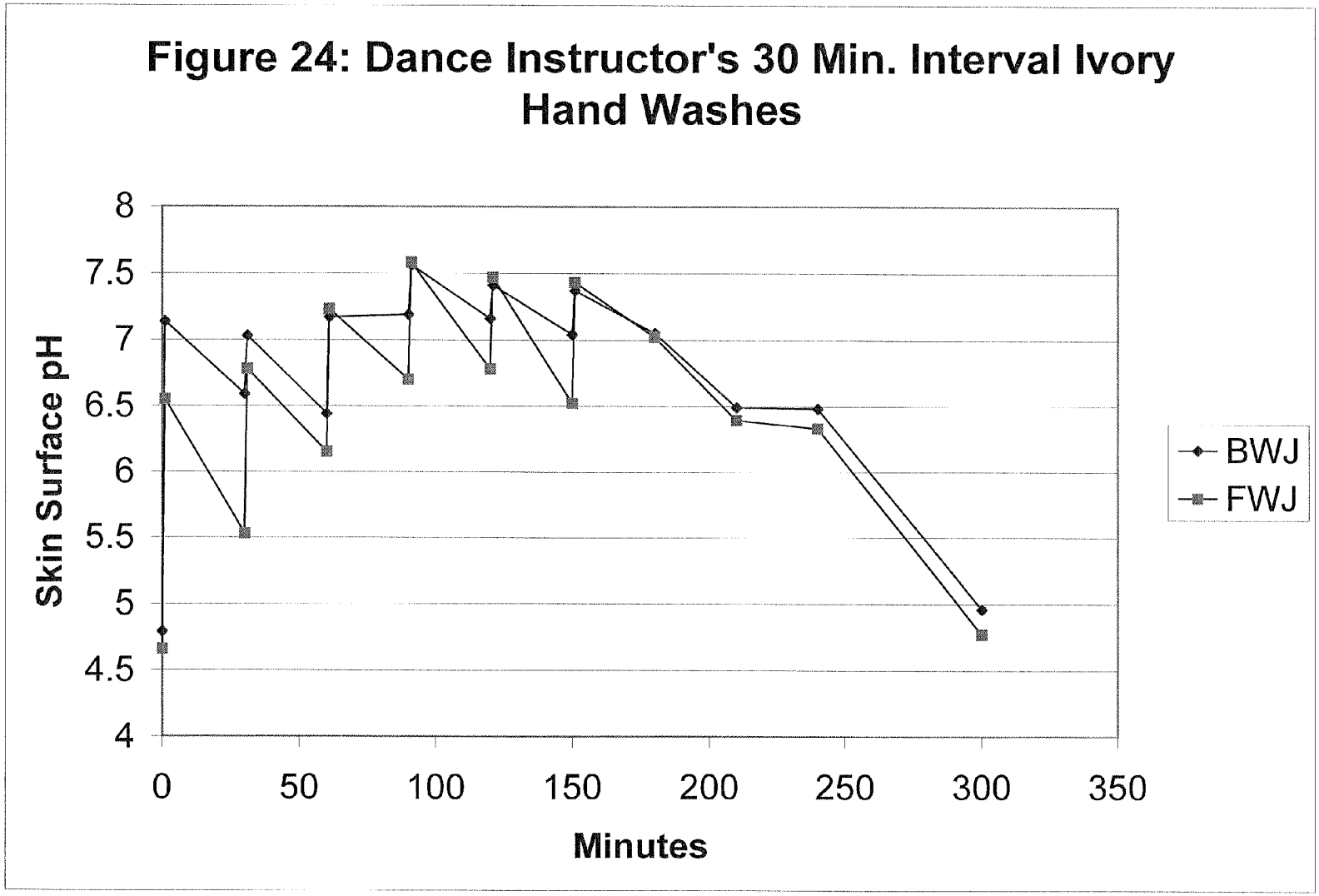
Figure 24: Dance Instructor's 30 Min. Interval Ivory Hand Washes
BWJ
FWJ
Skin Surface pH
8
7.5
7
6.5
6
5.5
5
4.5
4
0
50
100
150
200
250
300
350
Minutes Figure 25: Table of Repeat Ivory Wash By Non-Accommodated Dance Instructor

| | Min. | SSpH BWJ | SSpH FWJ | Ratio | SSpH BH | SSpH FH | SSpH BIF | SSpH FIF |
|---|---|---|---|---|---|---|---|---|
| | 0 | 4.07 | 4.24 | 0.96 | 4.09 | 4.25 | 4.2 | 4.25 |
| Wash | 1 | 4.9 | 5.22 | 0.94 | 5.03 | 5.37 | 5.49 | 5.57 |
| | 60 | 4.27 | 4.44 | 0.95 | 4.19 | 4.52 | 4.43 | 4.66 |
| Wash | 61 | 5.65 | 5.56 | 1.02 | 5.11 | 5.59 | 5.93 | 6.06 |
| | 120 | 4.21 | 4.55 | 0.93 | 4.28 | 4.64 | 4.62 | 4.97 |
| Wash | 121 | 5.33 | 5.6 | 0.95 | 5.23 | 5.89 | 5.69 | 6 |
| | 180 | 4.4 | 4.71 | 0.93 | 4.21 | 4.68 | 4.7 | 4.94 |
| Wash | 181 | 5.61 | 5.84 | 0.96 | 5.4 | 6.05 | 6.01 | 6.39 |
| | 240 | 4.49 | 4.84 | 0.93 | 4.62 | 5.08 | 4.78 | 5.16 |
| | 300 | 4.29 | 4.65 | 0.92 | 4.26 | 4.67 | 4.35 | 4.76 |
| | 360 | 4.14 | 4.53 | 0.91 | 4.25 | 4.6 | 4.31 | 4.64 |

Abbreviations:

| | | | |
|---|---|---|---|
| Av. | Average of all six sites | BWJ | Back of the wrist junction |
| SSpH | Skin Surface pH | FWJ | Front of the wrist junction. |
| BH | Back of the hand. | FIF | Front of the index finger. |
| FH | Front of the hand(Palm) | RΔpH | RatioΔpH |
| BIF | Back of the index finger. | R(B/F) | Ratio Back to Front |

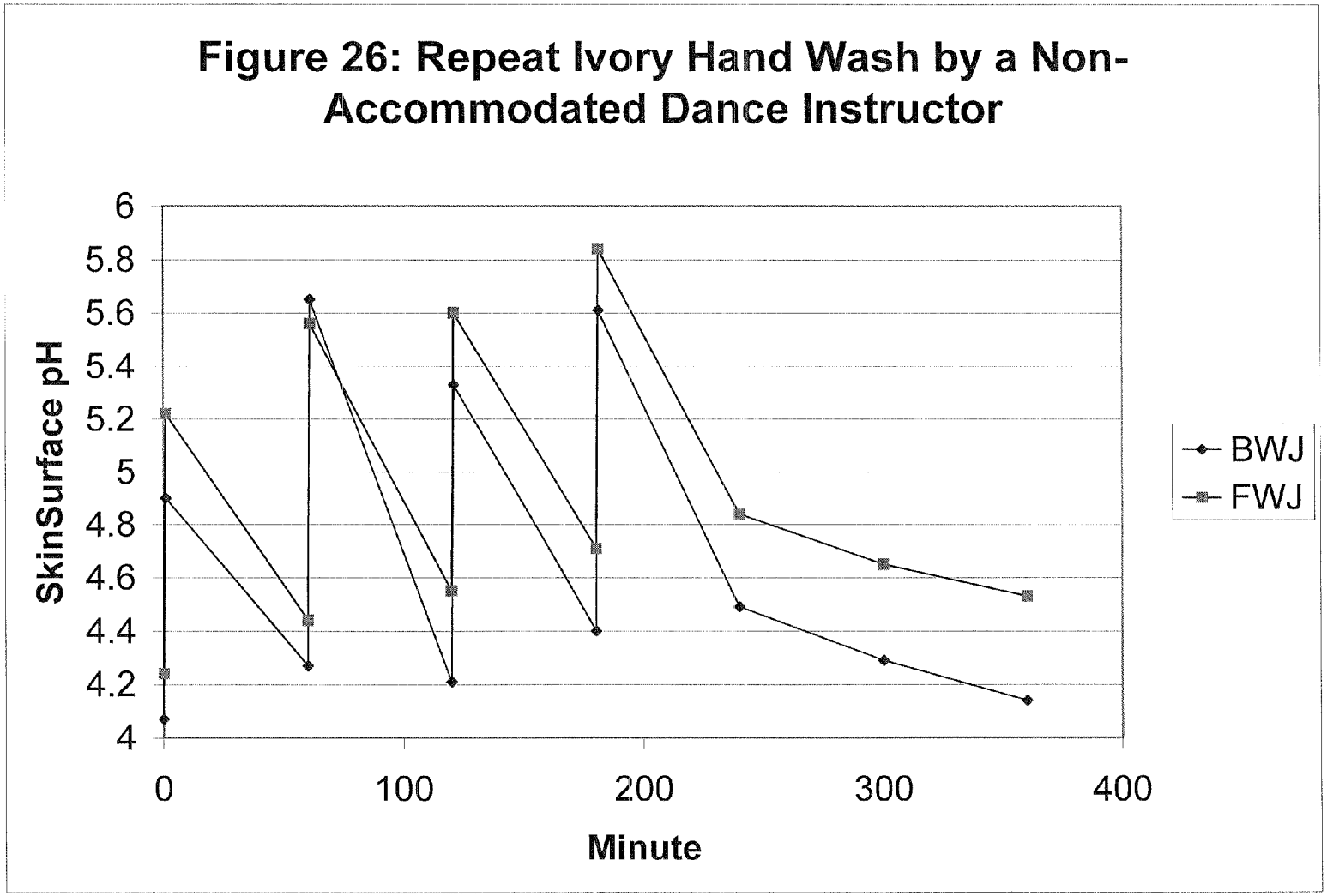
Figure 26: Repeat Ivory Hand Wash by a Non-Accommodated Dance Instructor
SkinSurface pH
6
5.8
5.6
5.4
5.2
5
4.8
4.6
4.4
4.2
4
0
100
200
300
400
Minute
BWJ
FWJ Figure 27: Table 14 of Dance Instructor's 30 Min. Interval Lava (R) Hand Washes

| | Min. | SSpH BWJ | SSpH FWJ | SSpH Ratio | SSpH BH | SSpH FH | SSpH BIF | SSpH FIF |
|---|---|---|---|---|---|---|---|---|
| N=2 | 0 | 4.42 | 4.45 | 0.99 | 4.22 | 4.44 | 4.23 | 4.64 |
| Wash | 1 | 6.69 | 6.42 | 1.04 | 6.61 | 7.15 | 6.45 | 7 |
| | 30 | 6.09 | 5.63 | 1.08 | 5.47 | 5.96 | 5.11 | 5.93 |
| Wash | 31 | 7.19 | 7.02 | 1.02 | 6.87 | 7.21 | 6.99 | 7.3 |
| | 60 | 6.51 | 6.07 | 1.07 | 6.4 | 6.14 | 6.22 | 6.3 |
| Wash | 61 | 7.46 | 7.45 | 1 | 7.19 | 7.6 | 7.54 | 7.58 |
| | 90 | 7 | 6.04 | 1.16 | 6.62 | 6.22 | 6.46 | 6.34 |
| Wash | 91 | 7.2 | 7.11 | 1.01 | 6.76 | 7.27 | 6.77 | 7.37 |
| | 120 | 6.68 | 6.46 | 1.03 | 6 | 6.35 | 6.55 | 6.67 |
| Wash | 121 | 7.38 | 7.33 | 1.01 | 7.18 | 7.51 | 7.62 | 7.45 |
| | 150 | 6.69 | 6.35 | 1.05 | 6.22 | 6.42 | 6.1 | 6.6 |
| Wash | 151 | 7.39 | 7.4 | 1 | 7.25 | 7.81 | 7.32 | 7.45 |
| | 180 | 6.71 | 6.15 | 1.09 | 6.07 | 6.23 | 6.28 | 6.54 |
| | 210 | 6.41 | 5.68 | 1.13 | 5.73 | 5.84 | 5.83 | 6.01 |
| | 420 | 4.57 | 4.55 | 1 | 4.43 | 4.81 | 4.48 | 4.9 |

Abbreviations:

| | | | |
|---|---|---|---|
| Av. | Average of all six sites | BWJ | Back of the wrist junction |
| SSpH | Skin Surface pH | FWJ | Front of the wrist junction. |
| BH | Back of the hand. | FIF | Front of the index finger. |
| FH | Front of the hand(Palm) | RΔpH | RatioΔpH |
| BIF | Back of the index finger. | R(B/F) | Ratio Back to Front |

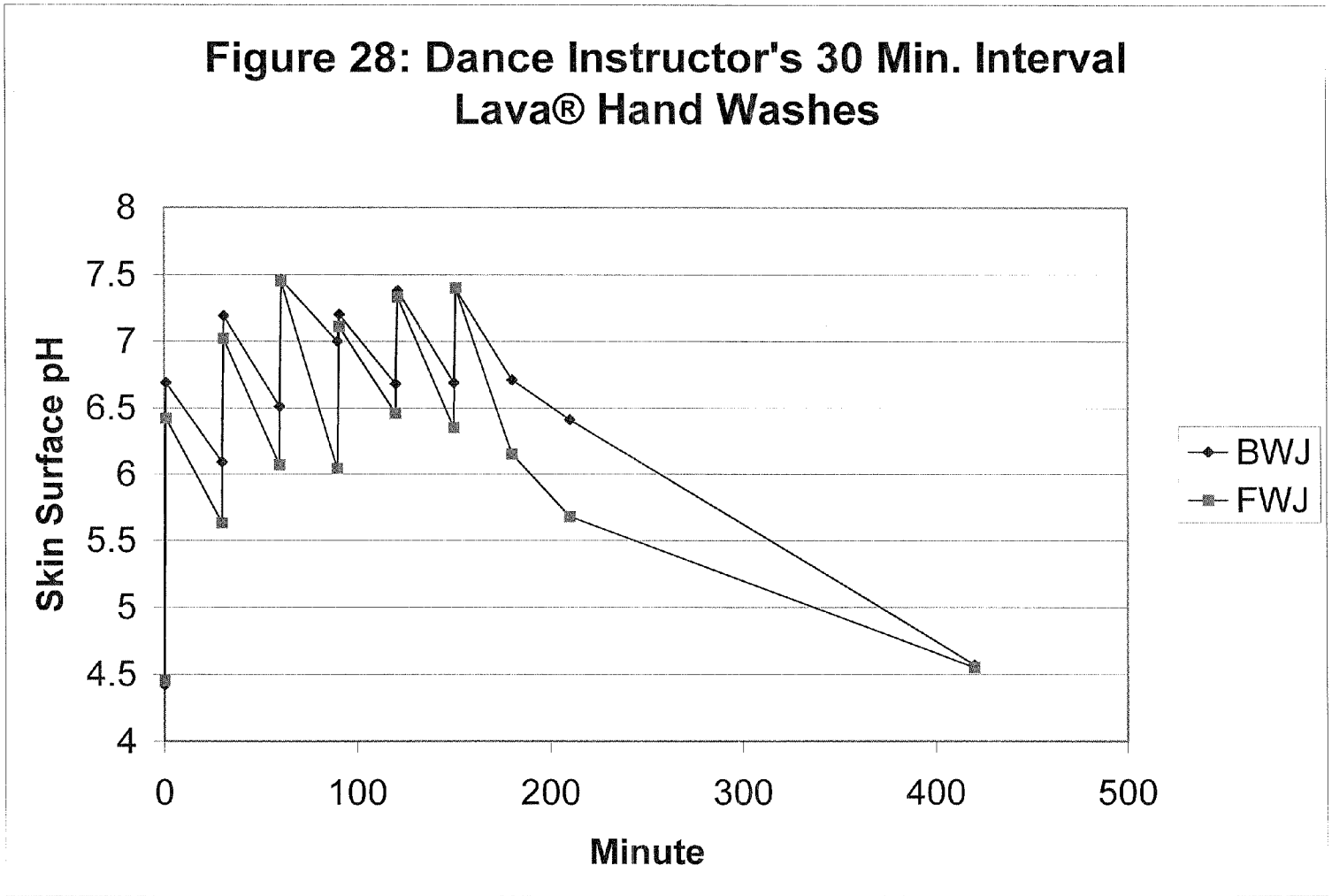
Figure 28: Dance Instructor's 30 Min. Interval
Lava® Hand Washes
Skin Surface pH
8
7.5
7
6.5
6
5.5
5
4.5
4
0
100
200
300
400
500
Minute
BWJ
FWJ Figure 29: Effect of Purell Hand Sanitizer on Skin Surface pH after Lever 2000 Hand Wash

1) Baseline Skin Surface pH measurements were taken before washing hands.

| Left Hand | | Right Hand | | | |
|---|---|---|---|---|---|
| **Site** | **SSpH** | **Site** | **SSpH** | **Av.** | **Ratio** |
| **BH** | 4.9 | **BH** | 4.67 | 4.79 | xxx |
| **FH** | 4.82 | **FH** | 4.58 | 4.7 | 1.02 |
| **BIF** | 4.99 | **BIF** | 4.97 | 4.98 | xxx |
| **FIF** | 5.25 | **FIF** | 5.15 | 5.2 | 0.97 |
| **BWJ** | 4.86 | **BWJ** | 4.89 | 4.87 | xxx |
| **FWJ** | 4.69 | **FWJ** | 4.8 | 4.7 | 1.04 |
| **Av.** | **4.92** | | **4.85** | **4.87** | **1.01** |

2) Both hands were washed with Lever 2000®.

3) After drying, Purell Sanitizer was applied to the right hand covering Sites BH, FH, BIF, FIF but not applying it to Sites BWJ or FWJ.

2) After drying of Purell®, SSpH's were taken on all sites of both hands.

| Left Hand | | | | | | Right Hand | | | | | |
|---|---|---|---|---|---|---|---|---|---|---|---|
| **Site** | **SSpH** | **Ratiol** | **ΔpHL** | **RΔpHL** | | **Site** | **SSpH** | **RatioR** | **ΔpHR** | **RΔpHR** |
| **BH** | 6.36 | xxx | 1.46 | xxx | Purell | **BH** | 6.05 | xxx | 1.38 | xxx |
| **FH** | 6.57 | 0.97 | 1.75 | 0.8 | Purell | **FH** | 5.41 | 1.12 | 0.83 | 1.66 |
| **BIF** | 7 | xxx | 2.01 | xxx | Purell | **BIF** | 5.89 | xxx | 0.92 | xxx |
| **FIF** | 6.55 | 1.07 | 1.3 | 1.55 | Purell | **FIF** | 5.78 | 1.02 | 0.63 | 1.46 |
| **Av.** | **6.62** | **1.02** | **1.63** | **1.18** | | | **5.78** | **1.07** | **0.94** | **1.56** |
| **BWJ** | 6.95 | xxx | 2.09 | xxx | | **BWJ** | 7.31 | xxx | 2.42 | xxx |
| **FWJ** | 6.72 | 1.03 | 1.51 | 1.38 | | **FWJ** | 6.57 | 1.11 | 1.77 | 1.36 |
| **Av.** | **6.69** | **1.02** | **1.68** | **1.24** | | | **6.94** | **1.11** | **2.1** | **1.36** |

Abbreviations:

| | | | |
|---|---|---|---|
| **Av.** | Average of all six sites | **BWJ** | Back of the wrist junction |
| **SSpH** | Skin Surface pH | **FWJ** | Front of the wrist junction. |
| **BH** | Back of the hand. | **FIF** | Front of the index finger. |
| **FH** | Front of the hand(Palm) | **ΔpH** | Change in pH from baseline. |
| **BIF** | Back of the index finger. | **RΔpH** | RatioΔpH |

Figure 30: Table of Time Course of Skin Surface pH on Hands Treated with a Prototype Hand Sanitizer

| | Minute | SSpH BWJ | SSpH FWJ | Ratio | ΔpH BWJ | ΔpH FWJ | RΔpH | SSpH BH | SSpH FH | SSpH BIF | SSpH FIF |
|---|---|---|---|---|---|---|---|---|---|---|---|
| Treat | 0 | 4.64 | 4.48 | 0.94 | | | | 4.52 | 4.81 | 4.95 | 5.34 |
| | 1 | 7.63 | 6.74 | 1.13 | 2.99 | 2.2 | 1.35 | 7.25 | 7.19 | 7.39 | 7.65 |
| | 15 | 6.6 | 5.47 | 1.21 | 1.96 | 1 | 2.04 | 6.2 | 5.68 | 6.23 | 6.66 |
| | 30 | 6.32 | 5.02 | 1.26 | 1.68 | 0.5 | 3.29 | 5.91 | 5.5 | 6.04 | 6.23 |
| | 60 | 6.04 | 4.77 | 1.27 | 1.4 | 0.3 | 5.39 | 5.52 | 5.21 | 5.69 | 5.87 |
| | 120 | 5.93 | 4.62 | 1.28 | 1.29 | 0.1 | 11.7 | 5.43 | 4.84 | 5.48 | 5.65 |
| Wash | 121 | 7.87 | 6.99 | 1.14 | 3.23 | 2.5 | 1.3 | 6.96 | 6.54 | 7.89 | 7.02 |

Abbreviations:

| | |
|---|---|
| Av. | Average of all six sites |
| SSpH | Skin Surface pH |
| BH | Back of the hand. |
| FH | Front of the hand(Palm) |
| BIF | Back of the index finger. |
| BWJ | Back of the wrist junction |
| FWJ | Front of the wrist junction. |
| FIF | Front of the index finger. |
| ΔpH | Change in pH from baseline, '0' time. |
| RΔpH | ratio of ΔpH for SSpH on BWJ/FWJ |

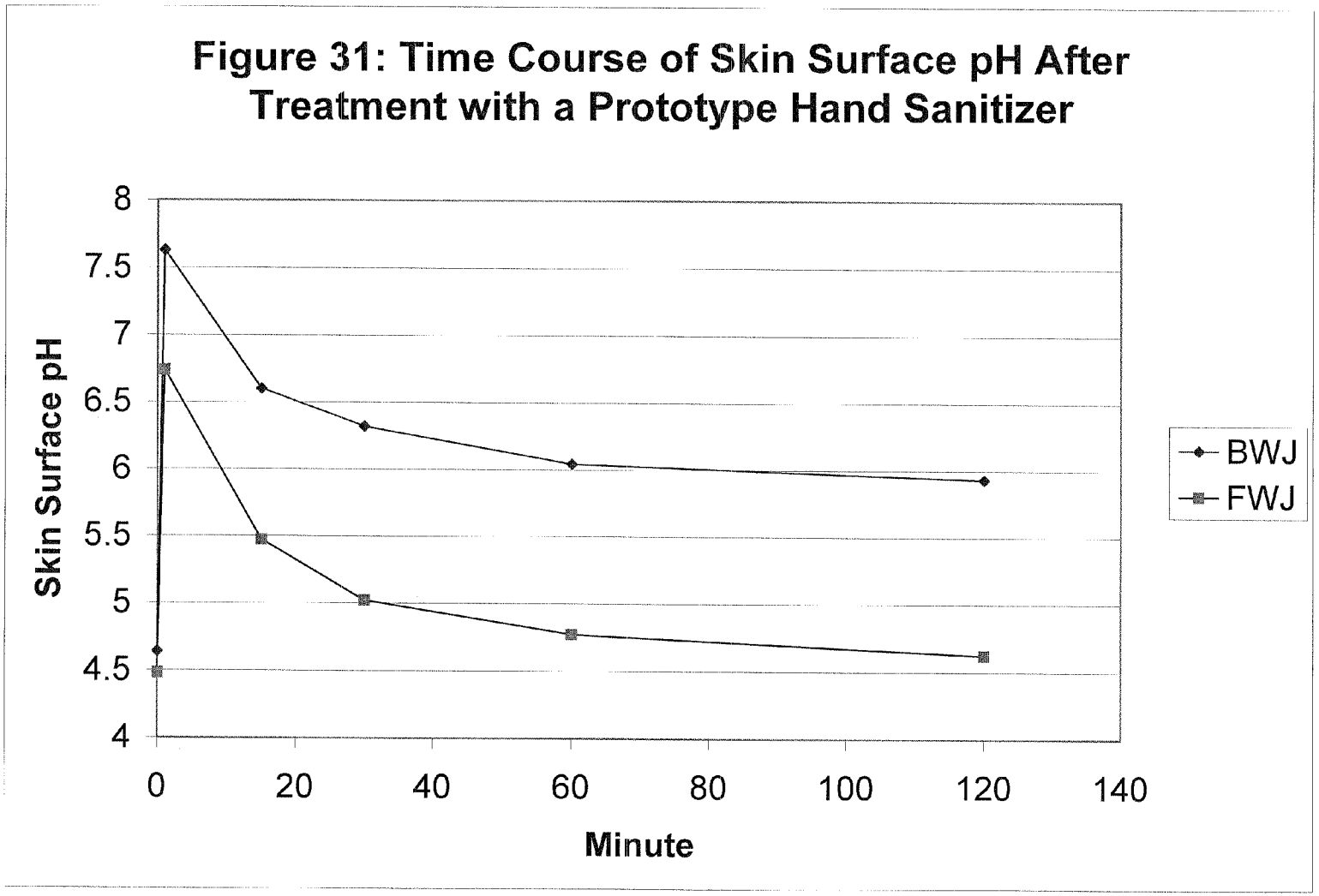
Figure 31: Time Course of Skin Surface pH After Treatment with a Prototype Hand Sanitizer
Skin Surface pH
8
7.5
7
6.5
6
5.5
5
4.5
4
0
20
40
60
80
100
120
140
Minute
BWJ
FWJ

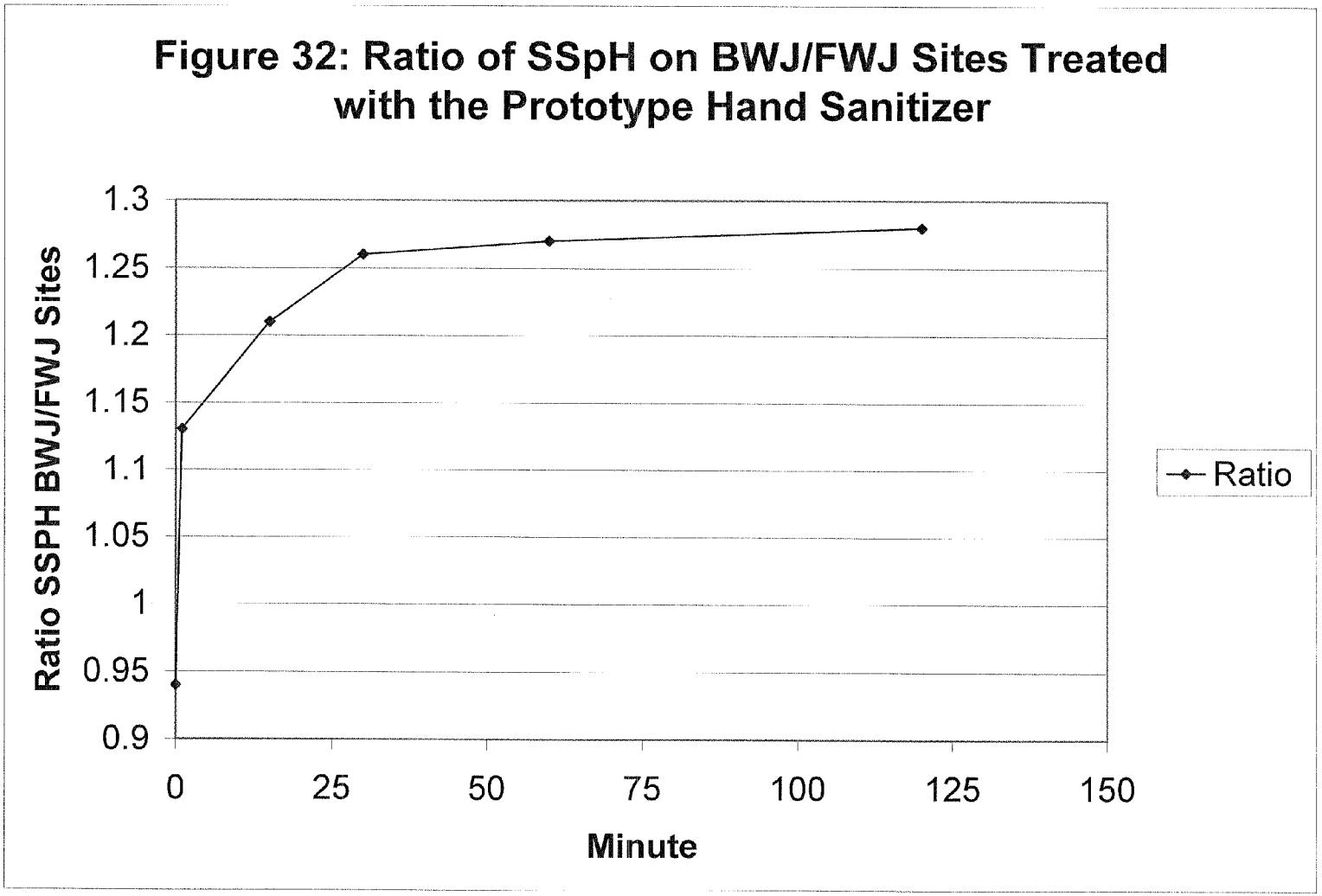
Figure 32: Ratio of SSpH on BWJ/FWJ Sites Treated with the Prototype Hand Sanitizer
Ratio
Ratio SSPH BWJ/FWJ Sites
1.3
1.25
1.2
1.15
1.1
1.05
1
0.95
0.9
0
25
50
75
100
125
150
Minute Figure 33: Table of Skin Surface pH Due to Ivory Hand Washing and Treatment with the Prototype Hand Sanitizer

| | Minute | SSpH BWJ | SSpH FWJ | SSpH BH | SSpH FH | SSpH BIF | SSpH FIF |
|---|---|---|---|---|---|---|---|
| | | | | **1) Baseline Skin Surface pH, before treatment.** | | | |
| | 0 | 4.64 | 4.48 | 4.52 | 4.81 | 4.95 | 5.34 |
| | | | | **2) Recovery after the first application of the sanitizer** | | | |
| | 120 | 5.93 | 4.62 | 5.43 | 4.84 | 5.48 | 5.65 |
| | | | | **3) SS pH immediately after Ivory hand wash.** | | | |
| **Time after** | 121 | 7.87 | 6.99 | 6.96 | 6.54 | 7.89 | 7.02 |
| **2nd Application** | | | | **4) SS pH immediately after 2nd application of hand sanitizer** | | | |
| 0 | 125 | 9.12 | 8.87 | 8.82 | 8.52 | 8.58 | 8.75 |
| 15 | 140 | 8.69 | 8.69 | 8.42 | 8.13 | 8.08 | 8.38 |
| 30 | 170 | 8.23 | 7.87 | 8.08 | 7.53 | 7.76 | 8.53 |
| 60 | 230 | 8.09 | 7.13 | 8.14 | 6.57 | 7.61 | 7.65 |
| 180 | 410 | 7.57 | 5.47 | 6.92 | 5 | 6.86 | 6.34 |
| 390 | 800 | 6.84 | 4.83 | 6.61 | 4.86 | 6.34 | 5.68 |
| | | | | **5) Reversibility after washing the hands with Method®** | | | |
| 690 | 1100 | 4.66 | 4.33 | 4.55 | 4.71 | 4.62 | 5.22 |

Abbreviations:

| | |
|---|---|
| Av. | Average of all six sites |
| SSpH | Skin Surface pH |
| BH | Back of the hand. |
| FH | Front of the hand(Palm) |
| BIF | Back of the index finger. |
| BWJ | Back of the wrist junction |
| FWJ | Front of the wrist junction. |
| FIF | Front of the index finger. |

Figure 34: Table of Comparison of Two Methods of Measuring Skin Surface pH

Baseline Measurements

| | Left Hand | | Right Hand | | Av. | |
|---|---|---|---|---|---|---|
| | SSpH ExTech | SSpH ColorpHast® | SSpH ExTech | SSpH ColorpHast® | SSpH ExTech | SSpH ColorpHast® |
| BWJ | 4.75 | 4.4 | 4.91 | 4.7 | 4.83 | 4.55 |
| FWJ | 4.68 | 4.4 | 4.64 | 4.4 | 4.66 | 4.4 |

Immediately after Ivory Hand Wash

| | Left Hand | | Right Hand | | Av. | |
|---|---|---|---|---|---|---|
| | SSpH ExTech | SSpH ColorpHast® | SSpH ExTech | SSpH ColorpHast® | SSpH ExTech | SSpH ColorpHast® |
| BWJ | 7.44 | 6.5 | 7.02 | 6.1 | 7.23 | 6.3 |
| FWJ | 6.92 | 6.1 | 6.95 | 6.1 | 6.94 | 6.1 |

Abbreviations:

Av. Average of 2 sites
SSpH Skin Surface pH
BWJ Back of the wrist junction
FWJ Front of the wrist junction.

COMPOSITION FOR SANITIZING HANDS AND A METHOD FOR VERIFYING AND MONITORING HAND WASHING AND SANITIZING PRACTICES

FIELD OF THE INVENTION

This invention relates generally to compositions and procedures for prevention of the spread of illness, carried by contaminated hands and pertains in particular to a method of using skin surface pH to verify and monitor hand washing and sanitizing practices by workers in food service and health care. The invention also pertains to the development of sanitizing products that are optimal for the monitoring purpose.

BACKGROUND OF THE INVENTION

A major problem regarding the spread of illness is the contamination of food by food service workers who carry pathogens on their hands and transmit them to food. Lack of proper hand washing in the food processing industry is also of concern where raw meats, fish, and vegetables can be contaminated by handling these items with hands that are contaminated with pathogens. Furthermore, health care workers may contaminate patients with unsanitary hands.

Hands become contaminated by touching body parts or objects contaminated with pathogens. Individuals may carry pathogens in their gastrointestinal tract, skin, nasal passage, etc. Hands may also become contaminated by handling trash, soiled dishes, or other items, such as door knobs that have been touched by a carrier of a pathogen.

Illness caused by hands contaminated with pathogens is well recognized and documented in the food service industry. It is estimated that 30% of all food-borne illness is caused by pathogens being transferred from contaminated hands to food and subsequently being ingested by the host. Contaminated hands are the major source for spreading food-borne illness caused by viral infections (e.g. *Hepatitis* A, Norovirus Gastroenteritis, and Rotavirus Gastroenteritis), some bacterial infections (e.g. Shigellosis, *Staphylococcal* Gastroenteritis, and Hemorrhagic Colitis), as well as some parasitic infections (e.g. *Giardia* Duodenalis, Toxoplasmosis, Intestinal Cryptosporidiosis, and Cyclosporiasis).

Public health officials are acutely aware that contaminated hands are also a major source of infections. Nosocomial infections are a major source of morbidity and mortality. These infections are often carried by health care workers. It has been estimated that a high percentage of hospital workers are *Staphylococcal aureus* carriers. Several strains of *Staphylococcal aureus* have become resistant to most antibiotics resulting in increased hospital mortality rates. Viral disease outbreaks in health care facilities, including hospitals, nursing homes, assisted living facilities, physicians and dentist offices, etc. have been reported. Interestingly, one study found that only a small percentage of health care workers follow proper hand washing or sanitizing practices. Some upper respiratory infections are spread from person to person by hand contact with pathogen-contaminated objects followed by contaminated hand-to-nose, hand-to-eye or hand-to-ear contact. Hand transmission has been shown to be the main route for spreading the common cold and would be a major route for transmission of an avian flu epidemic.

The FDA has written guidelines for hand washing in food service establishments. These guidelines are put into practice by states and local governments overseeing the regulation of food safety. The Educational Foundation of the National Restaurant Association has established within its ServSafe Certification Program an effective hand washing method (referred to hereinafter as the "ServSafe Guidelines"). The ServSafe Guidelines for proper hand washing are as follows: wet both hands with warm water, (near 100 deg. F.), apply soap, vigorously scrub the hands and arms for at least twenty seconds, clean under the fingernails and between the fingers, rinse the hands and arms thoroughly under running water, and then dry the hands and arms with a single-use paper towel or warm air hand dryer.

Several recent studies have indicated the superiority of alcohol-based hand sanitizers over soap products in reducing the microbial count on hands. Reducing the microbial count thereby reduces the potential for transmission of infection. These observations, plus the fact that the alcohol-based sanitizers are considered less irritating to skin, have led some opinion leaders to recommend increased usage of alcohol based sanitizers in the health care setting.

The mere establishment of proper hand washing and sanitizing procedures, however, does not guarantee compliance by food service workers. There are daily newspaper reports of health inspections where critical hand washing violations by food service workers take place on a routine basis. Often, when a food service or health care worker is suspected to be in violation of proper hand washing, the worker may just simply claim that they did wash their hands.

In an effort to monitor proper hand washing, devices that count hand washings have been patented and marketed to food service establishments. The device essentially requires the identification of the food service worker who is washing their hands. That is, the food service worker enters their personal Pin # into a computer device when they wash their hands. Such devices have not been widely accepted by the Industry. The major problems with these devices are: a) the inability to verify that proper hand washing has taken place; b) the lack of compliance with entering the Pin #; c) the lack of room for the device in the usually cramped quarters next to the hand washing sink; d) the relatively high cost purchasing and maintaining the device; and e) the inability to verify or monitor the use of alcohol-based sanitizers. Given the absence of a widely accepted method, it is difficult for food sanitation inspectors to monitor and verify proper hand washing and sanitizing practices.

A food sanitation inspector is in a food service establishment for a short time (usually 0.5-2 hours). Because the inspector is busy with other aspects of the inspection, the inspector is likely to miss improper hand washing by some, if not most, of the workers. Managers and inspectors of health care workers are in the same position as those in the food service industry. Food service managers are burdened with other responsibilities including supervising food logistics, food delivery, food storage, food preparation, food cooking, food holding, customer service, food establishment maintenance and record keeping, which leave little time for monitoring proper hand washing practices.

Furthermore, the skin on the hands of workers who routinely carry out proper hand washing practices will eventually become accommodated to hand washing. The workers with accommodated hands will respond differently to proper hand washing as compared to those subjects who do not practice proper hand washing or seldom wash their hands.

Therefore, a need exists for a composition and method for verifying and monitoring hand washing and sanitizing practices in the food and health care industries. The composition will preferably be a hand sanitizer that raises and maintains elevated skin surface pH for at least thirty minutes. The method comprises the use of skin surface pH on designated sites of the hands to verify whether the individual's hands have been properly washed and sanitized.

SUMMARY OF THE INVENTION

It is an object of the present invention to provide a composition and method for verifying and monitoring hand washing and sanitizing practices in the food and health care industries.

It is another object of the present invention to develop hand sanitizers that function optimally with the method for verifying and monitoring proper hand washing and sanitizing practices.

It is another object of the present invention to provide a method for using the skin surface pH on designated sites of the hand and/or lower arm to verify whether the individual's hands have become accommodated to proper hand washing and/or sanitizing.

BRIEF DESCRIPTION OF THE PREFERRED EMBODIMENTS

In accordance with one embodiment of the present invention, a method for verifying and monitoring hand washing and sanitizing practices is disclosed. The method comprises the steps of measuring skin surface pH of hand and/or a lower arm of a user and comparing the skin surface pH with a predetermined skin surface pH range. A measured skin surface pH below a predetermined pH number on the skin surface pH range indicates that the hand and/or lower arm of the user is improperly washed and a measured skin surface pH above a predetermined pH number on the skin surface pH range indicates that the hand and/or lower arm of the user is properly washed.

In accordance with another embodiment of the present invention, a method for verifying and monitoring hand washing and sanitizing practices is disclosed. The method comprises the steps of placing a pH measuring device on at least one skin surface of a hand and/or a lower arm of a user, holding the pH measuring device in contact with the skin surface for between approximately ten and approximately thirty seconds, reading at least one measurement of skin surface pH from the pH measuring device, and comparing the skin surface pH of the hand and/or lower arm with a predetermined skin surface pH range. A measured skin surface pH below a predetermined pH number on the skin surface pH range indicates that the hand and/or lower arm of the user is improperly washed and a measured skin surface pH above a predetermined pH number on the skin surface pH range indicates that the hand and/or lower arm of the user is properly washed.

In accordance with another embodiment of the present invention, a system for verifying and monitoring hand washing and sanitizing practices is disclosed. The system comprises a pH measuring device for measuring skin surface pH of a hand and/or a lower arm of a user and a predetermined skin surface pH range to which the skin surface pH is compared. A measured skin surface pH below a predetermined pH number on the skin surface pH range indicates that the hand and/or lower arm of the user is improperly washed and a measured skin surface pH above a predetermined pH number on the skin surface pH range indicates that the hand and/or lower arm of the user is properly washed.

BRIEF DESCRIPTION OF THE DRAWINGS

FIG. 3 is a table showing the baseline skin surface pH measurements of several subjects.

FIG. 4 is a table showing a comparison of skin surface pH of two subjects after a single Ivory® hand wash.

FIG. 5 is a line graph showing a time course of skin surface pH for the back wrist junction and the front wrist junction of the two subjects of FIG. 4.

FIG. 6 is a line graph showing a time course of the ratio of the skin surface pH of the sites on back wrist junction/front wrist junction for the two subjects of FIG. 4.

FIG. 7 is a table showing a comparison of skin surface pH on designated sites of the hand after a first hand wash with various regimens.

FIG. 8 is a line graph showing a time course of skin surface pH on the back wrist junction of the hand after a first hand wash with various regimens.

FIG. 9 is a table showing a comparison of skin surface pH of designated sites of the hand after repeat hand washes with Method®.

FIG. 10 is a line graph showing a time course of skin surface pH on the back wrist junction of the hand and the front wrist junction of the hand during repeated hand washing with Method® at sixty-minute intervals.

FIG. 11 is a line graph showing a time course of skin surface pH on the back wrist junction of the hand and the front wrist junction of the hand during repeated hand washing with Method® at thirty-minute intervals.

FIG. 12 is a time line graph showing a time course of the ratio of the skin surface pH during repeated hand washing with Method® at thirty-minute and sixty-minute intervals.

FIG. 13 is a table showing a comparison of skin surface pH of designated sites of the hand after repeat hand washes with Ivory® over two days where hand washes were carried out at thirty-minute intervals over a seven-hour period.

FIG. 14 is a line graph showing a time course of the skin surface pH on the back wrist junction of the hand and the front wrist junction of the hand during repeated hand washing with Ivory® over two days where hand washes were carried out at thirty-minute intervals over a seven-hour period.

FIG. 15 is a line graph showing a time course of skin surface pH recovery at thirty-minute periods during repeated hand washing with Ivory® over two days where hand washes were carried out at thirty-minute intervals over a seven-hour period.

FIG. 16 is a table showing a crossover study for wetting pH electrodes with distilled water and tap water.

FIG. 17 is a line graph showing a time course of skin surface pH on the back index finger and the front index finger of two subjects.

FIG. 18 is a table showing the effect of wearing gloves on skin surface pH on designated sites of the hand and the effect it has on detecting proper hand washing.

FIG. 19 is a table showing skin surface pH taken at specific times during the food preparation process when hand washing violations were observed.

FIG. 20 is a table showing the effect of Norwegian Formula® Hand Cream on skin surface pH after hand washing.

FIG. 21 is a table showing calibration and detection of proper hand washing.

FIG. 22 is a table showing the accommodation of calloused hands to soap.

FIG. 23 is a table showing the skin surface pH of a subject on designated sites of the hand during repeated washings with Ivory® at thirty-minute intervals.

FIG. 24 is a line graph showing a time course of the skin surface pH on the back wrist junction of the hand and the front wrist junction of the hand of the non-accommodated subject of FIG. 23 during repeated washings with Ivory® at thirty-minute intervals.

FIG. 25 is a table showing the skin surface pH on designated sites of the hand of the non-accommodated subject of FIG. 23 during repeated washings with Ivory® at sixty-minute intervals.

FIG. 26 is a line graph showing a time course of skin surface pH on the back wrist junction of the hand and the front wrist junction of the hand of the accommodated subject of FIG. 23 at sixty-minute intervals.

FIG. 27 is a table showing the skin surface pH on designated sites of the hand of the accommodated subject of FIG. 23 during repeated washings with Lava® at thirty-minute intervals.

FIG. 28 is a line graph showing a time course of skin surface pH on the back wrist junction of the hand and the front wrist junction of the hand of the accommodated subject of FIG. 23 during repeated washings with Lava® at thirty-minute intervals.

FIG. 29 is a table showing the effect of the use of Purell® Instant Hand Sanitizer on skin surface pH after washing the hands with Lever 2000®.

FIG. 30 is a table showing the time course of skin surface pH on the designated sites of hands that have been treated with a prototype hand sanitizer.

FIG. 31 is a line graph showing the time course of skin surface pH on the back wrist junction of the hands and the front wrist junction of the hands after treatment with the prototype hand sanitizer of FIG. 30.

FIG. 32 is a line graph showing a time course of the skin surface pH ratio on the back of the wrist junction to that of the front of the wrist junction sites after treatment with the prototype hand sanitizer of FIG. 30.

FIG. 33 is a table showing the skin surface pH on designated sites of the hand after washing with Ivory® and treatment with the prototype hand sanitizer of FIG. 30.

FIG. 34 is a table showing a comparison of two methods of measuring skin surface pH.

DETAILED DESCRIPTION OF THE PREFERRED EMBODIMENTS

Figure 2:
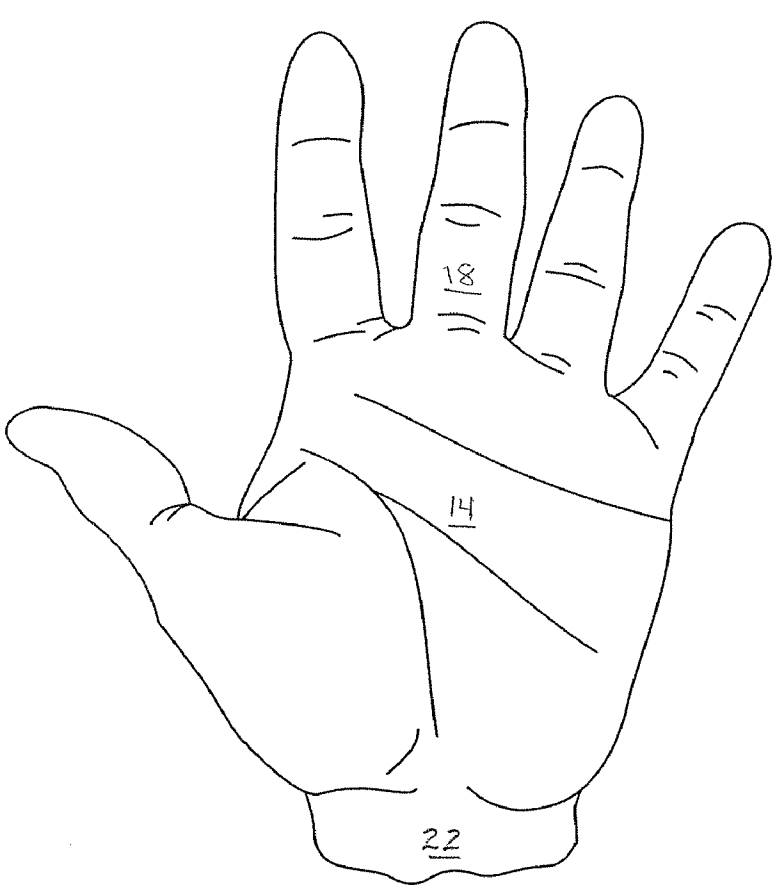
FIG. 2 is a perspective view of the front of the left hand of FIG. 1.

The invention relates to the ability of various hand washing procedures to alter the natural skin surface pH in various ways and for the buffering capacity of the skin to restore itself to its natural state over time, depending on the status of the hands and the manner in which they were washed. That is, proper hand washing will increase the skin surface pH in a manner detectable by skin surface pH measurements. On the other hand, a lack of hand washing or improper hand washing will result in little or no change in skin surface pH.

It has been found that the measurement of skin surface pH on designated sites on the hands may be used to verify and monitor proper hand washing and sanitizing practices carried out by food service workers, health care workers, and other individuals who may spread disease by improper washing of the hands. These sites may include: a center back portion 12 (shown in FIG. 1) of the hand, a center front portion 14 (shown in FIG. 2) of the hand, a front upper section of an index finger 18 (shown in FIG. 2) of the hand, a back upper section of the index finger 16 (shown in FIG. 1) of the hand, a center front wrist junction 22 (shown in FIG. 2) of the hand, and a center back wrist junction 20 (shown in FIG. 1) of the hand.

If left undisturbed, skin surface pH on the hands at various sites, has a range of 4.0-5.5. Washing the hands with cleansing products and their subsequent rinsing with tap water raises the skin surface pH by one unit or more (pH 5.5-9) immediately thereafter. After completion of the hand washing process, the skin surface pH immediately starts to return to its lower baseline status.

The extent of the change in skin surface pH depends upon several factors: a) the composition of the hand washing product, b) the pH of the tap water used, c) the extent of accommodation of the skin, d) the quality of the hand washing practice, e) the location of the site being tested, and f) contamination from exogenous factors.

The time course of the return of the skin surface pH to a baseline, on defined sites on the skin, after hand washing or sanitizing is the basis of this invention for: a) verifying that hand washing or hand sanitizing was done, b) monitoring that proper hand washing and/or sanitizing practices are being carried out, c) developing acceptable hand sanitizing products that are optimal for monitoring proper hand washing and/or sanitizing practices, and d) determining when a worker has incurred a safety hazard by chronically over-washing and/or sanitizing their hands.

An experienced food service or health care worker who has a habit of properly washing their hands according to ServSafe Guidelines will develop accommodated hand skin and will have a baseline skin surface pH, on specified sites on their hands, in the range of 4.0 to 5.5. When properly washing their hands during the course of the working day, the pH will rise 0.5 to 3 pH units depending on: a) the site on the skin tested, b) the hand washing product used, c) the pH of the water used, d) the frequency of previous hand washes, and e) the physiological status of the skin. Within a few seconds of hand washing, the skin surface pH rises to a maximum value and immediately starts to fall towards to a baseline value.

For some sites on the hands, the skin surface pH will fall to its baseline value within twenty minutes. By measuring skin surface pH on those sites, it is possible to verify that an individual has washed his/her hands properly. For example, the skin surface pH Method can be used to distinguish between hand washing with tap water only (improper) and washing with soap (proper). If proper hand washing had taken place, the skin surface pH of a particular site should be above a specific predetermined pH number (e.g. above 5.5) within a designated period of time (e.g. 20 minutes) after hand washing.

A worker who has not washed his/her hands recently (e.g. within the last hour or longer) will have a lower skin surface pH, on specific sites, compared to the skin surface pH he/she would have if he/she had recently washed his/her hands. By taking skin surface pH measurements on specific sites on the hands, it is possible to monitor hand washing practices over the course of the working day. That is, at any time during the working day, a worker's accommodated skin surface pH should be above his/her baseline skin surface pH range (e.g. pH 4.0-5.5) if he/she is washing his/her hands on a routine basis.

Hand washing formulations that have an alkaline pH are preferred, but are not necessary for monitoring proper hand washing. It should be clearly understood that hand cleansers of any pH are acceptable. A further refinement in monitoring proper hand washing consists of a skin surface pH Ratio Method. For workers with accommodated skin on their hands, after hand washing, the skin surface pHs on sites on the back wrist junction 20 of the hand regress to baseline skin surface pH at a slower rate than sites on the front wrist junction 22 of the hand. By taking measurements on specific sites on the back wrist junction (BWJ) site 20 and the front wrist junction (FWJ) site 22 of the hand, and calculating the ratio of the skin surface pH values (i.e., BWJ/FWJ), the following can be inferred: a) a skin surface pH above a predetermined pH number (e.g. 5.5) indicates that recent hand washing has taken place, b) if the ratio of back/front skin surface pH is greater than predetermined skin surface pH ratio (e.g., 0.99), frequent hand washing is taking place, and c) if the worker arrives at work with a high skin surface pH (e.g., 6.0 or higher), this subject should be screened for skin irritation and bacterial overgrowth on their hands.

Use of the Skin Surface pH Method for Diagnosing Proper Hand Washing and Sanitizing disclosed herein is essential for development of optimized sanitizing products for monitoring proper sanitizing. The time course of skin surface pH, in response to hand washing and/or sanitizing with an optimized formulation, will affect specific skin surface pH responses. Such responses include: a) a raising of the skin surface by at least two pH units immediately after washing and/or sanitizing the hands, b) a regression to baseline skin surface pH of at least thirty minutes for sites on the back of the hands, and c) a regression to baseline skin surface pH of fifteen minutes, or less, for sites on the front of the hands.

Subjects with accommodated skin on their hands will have variable skin surface pH responses, to proper hand washing, on different sites on their hands. For example, the sites on the back wrist junction 20 of the hands will regress to baseline skin surface pH slower than sites on the front wrist junction 22 of the hands.

A hand sanitizer, when used in combination with an alkaline soap, can be developed that will allow the validation and monitoring of proper hand sanitizing procedures and that will help maintain a skin surface pH above 7.5 for attenuating bacterial growth. Hand washing formulations that are non-irritating may also be used chronically without raising the baseline skin surface pH above 5.5.

The present invention may be further described with reference to the following examples. The examples below illustrate:

1. A method, involving the measurement of skin surface pH, for validating and monitoring proper hand washing by which a combination of a hand washing product and a hand sanitizer and/or hand lotion;

2. A method, using skin surface pH, for determining if a worker washed their hands before putting on gloves or between glove changes;

3. A method, using skin surface pH, for determining if worker's hands have become accommodated to hand washing products;

4. A method, using skin surface pH, to determine if health care and food service workers have a skin surface pH on their hands on the range of 4.6 to 7.5 which can support bacterial overgrowth;

5. A method, involving the use of skin surface pH, by which an inspector, manager or other authority can use skin surface measurement results to coach a worker as to proper hand washing and/or sanitizing procedures;

6. A method, involving the use of skin surface pH, by which an instructor or other authority can certify an individual for properly carrying out skin surface pH measurements;

7. The use of distilled water or un-buffered or non-alkaline water to wet skin before skin surface pH measurements are taken, for the purpose of monitoring proper hand washing;

8. A process, involving the measurement of skin surface pH, by which a hand sanitizer is developed, which when used in combination with an alkaline soap, will maintain the skin surface pH on the hands at a pH of 7.5 or higher, for a period of 30 minutes or longer; and 9. The use of an alkaline soap for hand washing followed by hand treatment with an alkaline hand sanitizer in order to maintain skin surface pH at 7.5 or higher, for 30 minutes or longer for the purposes of attenuating bacterial growth if hands are still contaminated or become contaminated after sanitization takes place.

EXAMPLE 1

Skin Surface pH measurements were taken on specified sites on the hands of volunteers, having various occupations. They did not wash or sanitize their hands overnight. The skin surface pH measurements were taken the following morning.

Figure 1:
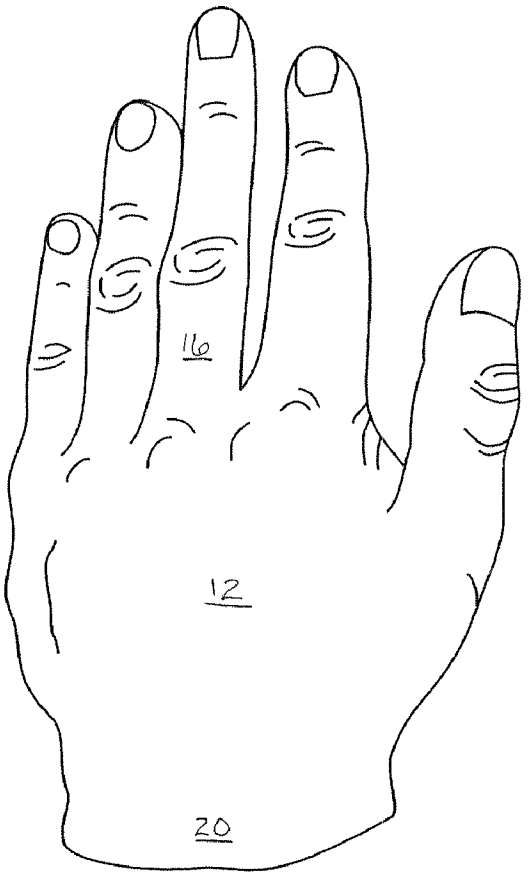
FIG. 1 is a perspective view of the back of a left hand.

The pH meter used for all studies was the ExStik II (pH100) Meter. Calibrations were taken at pH 4.0 and 7.0, according to the manufacturer's specifications. FIGS. 1 and 2 show six specific areas on the hand that served as sites for measurements of skin surface pH. The sites included the center of the back of the hand (BH) 12, the center of the front of the hand i.e., center of the palm (FH) 14, the front of the upper section of the index finger (FIF) 18, the back, upper section of the index finger (BIF) 16, the center of the front wrist junction (FWJ) 22, and the center of the back wrist junction (BWJ) 20.

Baseline skin surface pH measurements were taken on the morning before the subjects washed their hands. For skin surface pH measurements, the electrode was wetted with distilled water before the electrode was placed vertically in contact with the site on each subject's hand. The electrode remained in contact with the site until a steady state pH reading was observed. Contact time varied from 10-30 seconds. These same procedures were followed in all of the following EXAMPLES.

The subjects were instructed not to wash their hands overnight. The skin surface pH measurements on these sites were taken on several occasions from individuals of various sex, race, age, and occupation, as shown in FIG. 3. The skin surface pH results for each site are listed as well as the average skin surface pH for all of the sites on each subject's hand.

For all subjects, on all sites, the skin surface pH ranges from a low of 4.07 to a high of 5.7. The average skin surface pH for all sites was found to be 4.67 with a standard deviation of 0.24 pH units or 5.1%. The subject with the lowest skin surface pH values (JJP) is a dance instructor who seldom washes his hands. The subject with the highest skin surface pH values uses a hand moisturizer daily. The omission that she applied the moisturizer the night before may have conditioned her skin to higher skin surface pH values.

There are differences in the ratios of skin surface pHs on the back and front of the hands. The overall ratio of skin surface pH is 0.98 which represents a 2% variation. The ratio of the BH site 12 to the FH site 14 is 0.97 or a 3% variation while the ratio of the BIF site 16 to the FIF site 18 is 0.96 or a 4% variation. These ratios contrast with that of the ratio of the BWJ site 20 to the FWJ 22 site is 1.00. The BH 12, FH 14, BIF 16, and FIF 18 sites are on the lower part of the hand while the BWJ 20 and FWJ 22 sites are on the upper part of the hand. During the course of the day, the FH 14 and FIF 18 sites come into contact with both materials and objects to a much greater extent than do the BH 12, BIF 16, BWJ 20, and FWJ 22 sites. Higher use levels of the front, lower part of the hands, relative to the back, lower part of the hands could possibly account for the observed bias.

EXAMPLE 2

A comparison study was carried out on the time course of skin surface pH on sites on the hands after a single washing of the hands with Ivory® soap. Two subjects were studied. One subject (JAP) is a manager with non-accommodated hand skin. She does not usually wash her hands according to the ServSafe Guidelines. She also avoids washing the back of her hands. She is referred to here as the non-accommodated hand washer. The second subject (EP) is a food safety inspector who washes his hands 10-15 times per day and 5-6 days per week by following the ServSafe Guidelines. He is referred to as the accommodated hand washer.

The sites described in EXAMPLE 1 were studied using the right (EP) hand and the left hand (JAP) for testing. The results are presented in FIG. 4 and illustrated in FIGS. 5 and 6.

The results are an average of two skin surface pH readings on each site. Also shown is the ratio of the skin surface pH on the back wrist junction (BWJ) site 20 to that on the front wrist junction (FWJ) site 22. The BWJ 20 and FWJ 22 are the preferred sites for testing. The other sites are less suitable for testing for the following reasons: a) the BWJ 20 and FWJ 22 sites are likely to be indicative of improper hand washing since they are located farthest away from the palms which are usually the focus of hand washing; b) these sites are less subject to contamination by food or other objects that routinely contaminate the palms and front of the fingers; c) as will be shown below, skin surface pH on sites on the BWJ 20 and FWJ 22 are diagnostic for testing individuals for having accommodated hand skin. While the BH 12, FH 14, BIF 16, and FIF 18 sites are less preferable, it should be clearly understood that substantial benefit may nevertheless be derived from testing them for skin surface pH. In fact, testing any site on the hand or lower forearm will provide useful information.

The results in FIG. 5 show the time course of skin surface pH for the back wrist junction (BWJ) 20 and the front wrist junction (FWJ) 22 of both subjects. It is observed that the baseline skin surface pH values are below 5.0. The skin surface pH rises to a range of 6-7.4 for all sites after hand washing takes place. Thus, proper hand washing can be validated by observing that the skin surface pH rises well above the normal baseline range of 4.0-5.5 as discussed in EXAMPLE 1 above.

The skin surface pH reaches maximum value after hand washing and regresses toward the baseline level. Within 60 minutes, the skin surface pH on the BWJ 20 and FWJ 22 sites of the non-accommodated hand washer has fallen to 5.5 or below. The skin surface pH on the FWJ site 22 of the hand of the accommodated hand washer has fallen to 5.5. In contrast, the skin surface pH on the site on the BWJ 20 of the accommodated hand washer persists at a level of close to pH 6 for two hours or longer. Thus, it is possible to distinguish an accommodated hand washer from a non-accommodated hand washer by the persistence in skin surface pH on the site on the BWJ 20.

A plot of the time course of the ratio of the skin surface pH of the sites on BWJ 20/FWJ 22 for the two subjects is illustrated in FIG. 6. It is observed that for the non-accommodated hand washer, the ratio of the skin surface pH remains below 1.0 for the course of the study. The ratio of the skin surface pH on BWJ 20/FWJ 22 sites for the accommodated hand washer remains above 1.0 through the course of the study. These results show that use of the Skin Surface pH Method for Diagnosing Proper Hand Washing and Sanitizing makes it possible to differentiate an accommodated hand washer from non-accommodated hand washer.

EXAMPLE 3

Experiments were carried to determine the time course of skin surface pH on designated sites of the hand due to: a) lack of washing of the hands during the day (unwashed hands), b) washing the hands with distilled water (pH 5.3), c) washing the hands with tap water (pH 7.5), d) washing the hands with Soft Soap® hand cleanser, e) washing the hands with Dove® bar and f) washing the hands with Lever® 2000 bar. The hands were washed according to ServSafe Guidelines, with the exception that soap was not used for a-c above. The results are presented in FIG. 7 and illustrated in FIG. 8 for sites on the BWJ 20.

a) Skin surface pH measurements were taken on unwashed sites over the course of the day. The results indicate that the skin surface pH does not change over the course of the eleven hour period. The % deviation is 0.45%. Thus, over the course of the day the skin surface pH on the hands is not subject to diurnal variations.

b) Skin surface pH measurements were taken on sites on the hands that were washed for 20 seconds with distilled water at room temperature. Distilled water was found to have a pH of 5.3. Over the course of the 20 the minute study, washing the hands with distilled water did not appreciably change the skin surface pH on the sites tested.

c) Skin surface pH measurements were taken on sites on the hands that were washed for 20 seconds with warm tap water having a pH of 7.5. The skin surface pH on all sites increased modestly from an average skin surface pH of 4.45 to 4.76, representing a 0.31 pH unit increase. A threshold of skin surface pH of 5.5 is set so that a value below 5.5 indicates improper hand washing and a value above that indicates proper hand washing. Since washing the hands with tap water does not raise the pH to a level of 5.5 or above, the Skin Surface pH Method for Diagnosing Proper Hand Washing and Sanitizing can detect hands that are improperly washed with only tap water.

d) For the hands washed with SoftSoap®, the average skin surface pH for all the sites tested increases from 4.52 to 5.34, an increase of 0.82 pH units. Thus, the average increase of all the sites falls below a threshold of pH 5.5. However, the skin surface pH on the BWJ site 20 increased to 5.53, which is above the threshold of pH 5.5.

The skin surface pH on the BWJ 20 does not return to baseline until 60 minutes after hand washing, while the skin surface pH on the FWJ 22 returns to baseline values between 30 and 60 minutes. Thus, use of the BWJ 20 and FWJ 22 sites would be best suited for testing for proper hand washing when SoftSoap® is employed by an establishment.

e) The skin surface pH on sites on hands washed with Dove® rises from average baseline levels of 4.30 to average levels of 5.52, an increase in 1.22 pH units. The skin surface pH on the BWJ site 20 rises to 5.75, which is well above the pH 5.5 threshold.

The skin surface pH on the BWJ site 20 does not return to baseline levels until 45 minutes or later. The skin surface pH on the FWJ site 22 returns to baseline values between 15 and 45 minutes after hand washing. Thus, when using Dove®, a pH value above 5.5 on the BWJ site 20 and a ratio of skin surface pH for the BWJ 20/FWJ 22 sites that is greater than 1.0 would be indicative of proper hand washing.

f) The average skin surface pH on sites on hands washed with Lever® 2000 rises from a baseline value of 4.43 to a level of 6.48, an increase of 2.05 pH units. The skin surface pH on all sites increased to values that exceeded a pH 5.5 threshold. Thus, any of the sites tested could be used to validate proper hand washing when Lever 2000® is employed in an establishment.

Of importance, is the observation that the skin surface pH on the FWJ site 22 drops below 5.5 by 30 minutes after hand washing, while the pH on the BWJ site 20 remains above 6.0. Thus, the ratio is positive, but the fact that the skin surface pH on the FWJ site 22 is below 5.5 indicates the hands have not been washed for 30 minutes or longer. Thus, by taking skin surface pH measurements on the BWJ 20 and FWJ 22 sites immediately and 30 minutes after washing the hands with Lever 2000®, the following information can be obtained: 1) the worker washed their hands properly (i.e., pHs greater than 5.5), 2) the worker has not washed their hands within the last 30 minutes (i.e., pH on the FWJ site 22 less than 5.5 at the 30 minute reading), 3) the skin on the hands of the worker is accommodated on all sites meaning that he/she is a frequent and proper hand washer (i.e., skin surface pH ratio of BWJ 20/FWJ 22 sites is greater than 1 at the 30 minute reading).

EXAMPLE 4

Two studies were carried out to determine the time course of skin surface pH on sites of hands that were repeatedly washed with Method® Foaming Hand Wash.

For both studies, baseline skin surface pH measurements were taken followed by hand washing done according to ServSafe Guidelines. Skin surface pH measurements were also taken after either a 30 or a 60 minute interval after each hand washing. The results are shown in FIGS. 9-12. Focus is placed on the skin surface pH on the BWJ 20 and FWJ 22 sites.

Washing the hands every 30 minutes revealed similarities and differences with washing hands every 60 minutes. After the seven 30 minute interval hand washings, the skin surface pH falls at a much faster rate on the FWJ site 22 than on the BWJ site 20 as compared to that for the five 60 minute interval hand washings. For 30 minute interval hand washings, the skin surface pH on the BWJ site 20 progressively increases, with the number of hand washings, to a greater extent on the BWJ site 20 as compared to the FWJ site 22. After the last 30 minute interval hand wash (at 210 minutes), the skin surface pH falls below pH 5.5 within 10 minutes on the FWJ site 22, while it remains at pH 5.5, or above, for at least 570 minutes on the BWJ site 20.

In FIG. 9, the Ratio of skin surface pHs on the BWJ site 20 to FWJ site 22 are listed in Column 3 for both the 30 and 60 minute interval hand washings. The time course of the Ratios is shown in FIG. 12. For the 60 minute interval hand washings, the Ratio is bound between 1 and 1.1. For the 30 minute interval hand washings, the Ratio extends to a higher range of close to 1.1 to 1.25. Thirty minutes after the last 30 minute interval hand washing takes place (at 210 minutes), the Ratio increases. The Ratio remains below 1.1 after the last 60 minute interval hand washing takes place (at 240 minutes).

The Ratio of the BWJ sites 20 to the FWJ sites 22 increases for more frequent, 30 minute interval hand washing. Thus, the Ratio Method can distinguish between a frequent and a less frequent hand washer as well the monitoring of proper hand washing practices.

EXAMPLE 5

A hand washing study, using Ivory® soap, was performed over a two day period. The subject had accommodated hand skin from previously washing his hands 10-15 times per day, using the ServSafe Guidelines. On the first day, the study took place in Las Vegas, Nev. On the second day, the study was carried out in Corona, Calif. On each day, 14 hand washes were carried out, at 30 minute intervals, over a 7 hour period. The 30 minute cycle involved taking baseline skin surface pH measurements, followed by proper hand washing.

The results are shown in FIGS. 13-15. The one minute evaluation after each 30 minute interval indicates when hand washing took place. Although skin surface pH measurements were performed on all six sites (FIG. 13), focus is on the two preferred sites for testing. The following observations are discussed:

The results indicate that proper hand washing would be easily detected. That is, the range of skin surface pH values immediately after the hands are washed is 6.5 to 8.3. This range is well above the threshold skin surface pH of 5.5.

After the first hand washing, the pH rises above 7.5, on both sites. Thereafter, the skin surface pH falls at a faster rate on the FWJ site 22 than on the BWJ site 20. This time course parallels that for washing sites on the hands with Method® as described in EXAMPLE 4 above. Similar skin surface pH responses are observed after all of the hand washings have taken place. After the last hand washing of the first day (at 360 minutes), the skin surface pH, declines on both sites returning to baseline values by 3 hours later. The skin surface pH on the BWJ site 20 persists at a higher skin surface pH than seen on the FWJ site 22 (between the 360 and 640 minute evaluations).

The range of skin surface pH values for the BWJ sites 20, over the course of the 14 hand washings, is markedly higher than that found for skin surface pH on the FWJ sites 22. That is, the range of skin surface pH values on the BWJ sites 20 are from 6.9 to 8.4 while that on the FWJ sites 22 are from 5.7 to 7.7. Thus, the ratio of the skin surface pH on the BWJ site 20 to that on the FWJ 22 site remains high during the day if proper hand washing is taking place.

After resting the hands, from washing overnight, the same experimental protocol was carried out in Corona, Calif. A plot of skin surface pH after the 30 minute recovery periods is illustrated in FIG. 15. It can be seen that over each recovery period, the BWJ sites 20 have higher skin surface pHs compared to that on the FWJ sites 22. Thus, the Ratio of BWJ 20 to FWJ 22 skin surface pH values ranges well above 1.05. Comparing the recovery times at the end of the first day (400-1440 minutes) and at the end of the second day (1801-2790 minutes) it can be seen that the baseline pH rises from 4.5-4.9 to 5.2-6.4.

There is persistent higher skin surface pHs (pH 6.15-7.32) found on the BWJ sites 20, as well as some other sites, after the last hand washing up to 7.8 hours later. During this time there were signs of skin irritation (i.e., tightness, dryness burning, stinging, and itching) on the back of the hand and particularly on the sites on the BWJ 20. At pH values over 4.6 to 7.5, rapid bacterial growth is significant and bacterial overgrowth on the hands could occur. It is concluded that the Skin Surface pH Method for Diagnosing Proper Hand Washing and Sanitizing can be used to identify subjects with persistent high skin surface pHs who may harbor high titers of bacterial pathogens on their hands.

EXAMPLE 6

A crossover study was carried out to determine if the type of water used for wetting the skin prior to skin surface pH testing is of significance. All six sites on both hands were used for the study (N=6). For skin surface pH measurements, the sites on one hand were wetted with tap water (pH 7.5) and the sites on the opposite hand were wetted with distilled water (pH 5.2). Skin surface pH measurements were taken after the wetting of each site. One hour or one half hour was allowed to pass before the wetting of the sites, on the hands with distilled water or tap water, was crossed over. The experiments were carried out on two consecutive days.

The results are shown in FIG. 16. The results indicate that wetting sites with tap water, relative to wetting the skin with distilled water increases the skin surface pH by 0.44. Thus, the use of tap water for wetting skin before skin surface pH measurements are taken will result in a higher pH than the use of distilled water having a lower pH. These results indicate that use of distilled water or un-buffered water at a pH below alkalinity is preferred.

EXAMPLE 7

Hand washing studies was carried out on two subjects. The first subject was a dance instructor with non-accommodated hands, who infrequently washes his hands and hardly ever washed the back of his hands.

The second subject was a food sanitation inspector who washed his hands 10-15 times per day using the ServSafe Guidelines and therefore had accommodated hands. For the experiment described here, both subjects carried out a repeated hand washing regimen using the ServSafe Guidelines.

The skin surface pH results for sites on the back index finger (BIF) 16 and the front index finger (FIF) 18 of the two subjects are illustrated in FIG. 17. It is noted that for both subjects, baseline skin surface pHs are below 5. Immediately after washing the hands, the skin surface pH on both sites on the hands of both subjects increases, with the skin surface pH on both sites on the hand of the subject with non-accommodated skin rising to close to 5.5. The skin surface pH rises to 6.7 to 7.5 on both sites on the hand of the accommodated subject.

Repeating this proper hand washing regimen results in marked differences between the skin surface pH responses on sites of the non-accommodated hand washer as compared to that of the accommodated hand washer: a) Skin surface pH on both sites on the hand of the accommodated hand washer rises to higher values after each hand washing relative to responses to hand washing on sites on the hand of the non-accommodated hand washer; b) Skin surface pH values on both sites of the hand of the accommodated hand washer remain at higher pH values 60 minutes after each hand washing, as compared to that of the non-accommodated hand washer; c) During the four hand washing cycles, the skin surface pH on the BIF site 16 is higher than the skin surface pH on the FIF site 18 for the hands of the accommodated hand washer; d) During the four hand washing periods the skin surface pH on the FIF site 18 is higher than the skin surface pH on the BIF site 16 for the hands of the non-accommodated hand washer.

The results indicate that the Skin Surface pH Method for Diagnosing Proper Hand Washing and Sanitizing can be used to determine if a subject has accommodated skin. A food handler or health care worker who is employed in an establishment for more than a week should have accommodated skin on their hands. The method can detect workers who are neglecting hand washing.

EXAMPLE 8

An experiment was carried out to determine the effect of using distilled water (pH 5.24) with Lever 2000® on the skin surface pH on all six sites on both hands. A subject with accommodated hands participated in the study. Distilled water was used for lathering with Lever 2000®, washing and rinsing the hands according to the ServSafe Guidelines.

Baseline skin surface pH measurements were taken prior to hand washing. The average skin surface pH for all six sites on each hand was found to be 4.81. The Ratio of skin surface pH on sites on the back of the hand to that on the front of the hand was found to be 1.02.

Skin surface pH measurements were taken immediately after hand washing was completed. The average skin surface pH for all 6 sites on each hand was found to be 6.68. The Ratio of skin surface pH on sites on the back of the hand to that on the front of the hand was found to be 1.11.

The results demonstrate that marked increases in the skin surface pH and the skin surface pH ratio of BWJ 20/FWJ 22 sites occur when hand washing takes place with low pH water and a high pH soap product. Thus, it is possible to develop a hand washing product that will be predictive of proper hand washing regardless of the pH of the tap water.

EXAMPLE 9

An experiment was carried out to determine the effect using distilled water (pH 5.10) with Method® foaming hand cleanser on the skin surface pH on all six sites on both hands. A subject with accommodated hands participated in the study. Distilled water was used for wetting the skin before applying five squirts of Method® (pH=5.27) to the hands. Distilled water was used for washing and rinsing the hands according to the ServSafe Guidelines.

Baseline skin surface pH measurements were taken prior to hand washing. The average skin surface pH for all six sites on each hand was found to be 4.78. The Ratio of skin surface pH on sites on the back of the hand to that on the front of the hand was found to be 0.95.

Skin surface pH measurements were taken immediately after hand washing was completed. The average skin surface pH for all six sites on each hand was found to be 5.04. The Ratio of skin surface pH on sites on the back of the hand to that on the front of the hand was found to be 1.01.

The results show a lack of change in the skin surface pH and the Ratio when hand washing takes place with water and a hand washing product both having a low pH. Use of a low pH hand washing product, in combination with low pH water, would not be predictive of proper hand washing since the skin surface pH does not rise to 5.5 or above on proper hand washing by an accommodated subject.

The results presented here, in combination with the results presented in EXAMPLE 7 above indicate the versatility of use of a soap-based hand washing product for use of the Skin Surface pH Method for Diagnosing Proper Hand Washing and Sanitizing for validating and monitoring proper hand washing procedures.

EXAMPLE 10

An experiment was carried out to determine the effect of putting on gloves, after proper hand washing, on skin surface pH of sites on the hands. It is required that both food service and health care workers wash their hands prior to putting on gloves.

Small size Advantage® Powder Free Stretch Synthetic Exam Gloves were from Medline, Inc., Mundeline, Ill. 60060. Baseline skin surface pH measurements, on all six sites on both hands were taken prior to putting on gloves. For the first part of the experiment, the hands were not washed prior to putting on the gloves. The hands were allowed to remain in the gloves for five minutes. Immediately after removing the gloves, skin surface pH measurements took place on all sites on both hands. Next, the hands were washed with a lather of Lever 2000® according to ServSafe Guidelines. Thereafter, a new pair of gloves was placed on the hands for five minutes. Next, skin surface pH measurements took place on all sites on both hands. The results are shown in FIG. 18.

The results indicate that a) putting on gloves for a short period of time does not appreciably change skin surface pH values, and b) that proper hand washing, prior to putting on gloves, can be validated with the Skin Surface pH Method for Diagnosing Proper Hand Washing and Sanitizing.

EXAMPLE 11

Food preparation by a subject was observed. The subject had non-accommodated hands. Skin surface pH measurements were taken at specific times during the food preparation process, when hand washing violations were observed. The results are displayed in FIG. 19.

This subject indicated that her hands were in contact with tap water earlier in the day due to performing routine household chores—which may account for the relatively high average skin surface pH value of 5.36 found at the start of the study (N=12 sites). At the start of the study, the skin surface pH baseline values on the BWJ site 20 and on the FWJ 22 site are lower than that found on the sites on the lower hand by about 0.79 pH unit. The BWJ 20 and the FWJ 22 sites are on the upper part of the hand where less contact with tap water (pH=7.5) takes place.

During food preparation, raw salmon was handled. Without washing her hands, she proceeded to cut limes. Skin surface pH measurements on sites on her hands were immediately taken. The results are displayed in Step 2 of FIG. 19. The skin surface pHs were found to be lower than those found for the skin surface pHs at baseline as listed in Step 1. This surprising result is attributed to her handling of the acidic limes (pH 2-3). The skin surface pHs on the BWJ 20 and the FWJ 22 sites are much less affected by the limes than the sites on the palm (FH 14) and front of the index finger (FIF 18). The lack of significant change in skin surface pH on the BWJ 20 and the FWJ 22 sites supports the observation that this subject did not wash her hands before changing tasks.

Next, she was observed to touch garbage and then mix wet vegetables with both hands. Skin surface pH measurements were taken. The results are listed in Step 3 of FIG. 19. Skin surface pHs on sites on the bottom of the hand (i.e. BH 12, FH 14, BIF 16, and FIF 18) increased markedly, while the skin surface pHs on the top of the hand sites (i.e. BWJ 20 and FWJ 22) were unaffected due to the observation that there was no contact of these sites with water while she mixed the vegetables. The lack of significant change in skin surface pH on the BWJ 20 and the FWJ 22 sites supports the observation that this subject did not wash her hands after touching garbage.

The subject was instructed to wash her hands according to the ServSafe Guidelines to insure that all of the sites are washed equally. KIRKLAND dish liquid antibacterial hand washing soap (pH=8.62) was used. The results are shown in Step 4 of FIG. 23. The skin surface pH on all sites is above 6.2, including the BWJ 20 and FWJ 22 sites.

The results of this study:

a) Confirm that the Skin Surface pH Method for Diagnosing Proper Hand Washing and Sanitizing can be used to validate proper hand washing or to show that hands have not been properly washed; and b) Show that skin surface pH measurements on the BWJ 20 and FWJ 22 are the preferred site for testing for proper hand washing practices.

EXAMPLE 12

A subject was observed to commit a hand washing violation by washing only the front of his hands with tap water for five seconds. Skin surface pH measurements, taken immediately after hand washing, revealed an average skin surface pH of 5.18 on the BWJ site 20 and an average skin surface pH of 4.74 on the FWJ site 22. These skin surface pH values are below a threshold value of 5.5 for proper hand washing. If the subject had washed his hands properly with the available hand washing product (Lever 2000®), the skin surface pH on both the BWJ 20 and FWJ 22 would have rose to values greater than pH 6.0.

Thus, a subject committing a common hand washing infraction can be easily identified by use of the Skin Surface pH Method for Diagnosing Proper Hand Washing and Sanitizing.

EXAMPLE 13

A study was carried out to determine the effect of use of a popular marketed hand cream, i.e., Norwegian Formula® hand cream, on skin surface pH's after hand washing has taken place. The study was done on a subject with accommodated hands. The results are presented in FIG. 20.

At the start of the study, baseline measurements were taken on all sites, on both hands, as shown in Step 1 of FIG. 20. For the purpose of this Study, the sites are grouped as: a) bottom of the hands (BH 12, FH 14, BIF 16, FIF 18); and b) top of the hands (BWJ 20, FWJ 22) since these groups were treated differently in the following protocol.

The results listed Column 4 of FIG. 20 indicate that there is a plus 4% left-right hand bias for the sites on the bottom of the hand and a minus 2% left-right hand bias for the sites at the top of the hand.

Both hands were washed with Lever 2000® according to ServSafe Guidelines. Thereafter, Norwegian Hand Cream was uniformly applied to sites on the bottom of the right hand. The hand was allowed to dry for ten minutes. Care was taken not to put the product on the sites on top of the hand. The results shown under Step 2 of FIG. 20 indicate that Norwegian Hand Cream has little to no effect on the skin surface pHs on the bottom of the hands.

After resting the hands for 2.5 hours, both hands were washed with Dove Bar® according to ServSafe Guidelines. Thereafter, Norwegian Hand Cream was uniformly applied to sites on the bottom of the left hand. The hand was allowed to dry for ten minutes. Care was taken not to put the product on the sites on top of the hand. The results are displayed under Step 3 of FIG. 20. Here it is observed that use of the Norwegian Hand Cream had a marked effect of reducing the skin surface pHs by an average of 29% to slightly below the skin surface pH values found at baseline (See Step 1 of FIG. 20).

The hands were then washed with Dove Bar®, according to ServSafe Guidelines, in order to determine if this procedure would reverse the skin surface pH suppressing effect of the previous treatment with Norwegian Hand Cream. The results are presented under Step 4 of FIG. 20. Here it is observed that Norwegian Hand Cream had a lingering effect of reducing the skin surface pHs by an average of 9% even after washing the hands with Dove® Bar. Results, not shown here, demonstrate that the lingering effect of use of Norwegian Hand Cream took two more hand washings, one with Dove Bar® and the other with Lever2000® to dissipate this lingering effect.

The results of this experiment indicate that there is potential for hand creams to interfere with the use of the Skin Surface pH Method for Diagnosing Proper Hand Washing and Sanitizing to validate and monitor hand washing practices. The hand cream hand no effect on skin surface pH when an alkaline hand washing product was used, but had a large effect when a neutral pH bar was used.

Most food service and health care establishments do not allow the use of therapeutic hand products during working hours. For those that do, care must be taken in the choice of hand cream that can be used without interference with use of the Skin Surface pH Method for Diagnosing Proper Hand Washing and Sanitizing. Use of the Skin Surface pH Method for Diagnosing Proper Hand Washing and Sanitizing would be necessary to develop a therapeutic or barrier product that would be compatible with the use of the Skin Surface pH Method for Diagnosing Proper Hand Washing and Sanitizing for validating and monitoring proper hand washing practices.

EXAMPLE 14

An experiment was carried out to simulate a scenario by which an inspector can determine the expected rise in skin surface pH upon washing of hands under the conditions present in a specific food service or health care establishment.

Upon entering the "establishment," the "Inspector" washed his hands according to ServSafe Guidelines. Since being left handed, he took measurements on his right hand. Skin surface pHs on the BWJ 20 and FWJ 22 sites were found to be 7.15 and 5.68, respectively. The skin surface pH ratio of the BWJ 20/FWJ 22 sites was 1.26.

Thereafter, the "Inspector" observed a "new employee," who had recently entered the kitchen, leaving the area of the hand sink. He wanted to determine if this worker had properly washed her hands. He took measurements on her left hand (she was right handed). The skin surface pH on the BWJ 20 and FWJ 22 sites were found to be 6.18 and 6.48, respectively. The ratio was found to be 0.94.

The results indicate that this "new worker" washed her hands properly since her skin surface pH values on both sites were above a defined threshold of pH 5.5. Her low Ratio of 0.94 as compared to the high Ratio of 1.26 found for the site on the inspector's accommodated right hand verifies that she was a new employee and still had non-accommodated skin.

The above scenario depicts the measurements that could be taken in a food service establishment or a health care setting. The complete results of this Study, where hands were washed with Lever 2000®, are shown in FIG. 21. The results reveal some findings of interest:

a) The increase in average pH (Δ pH) on all sites, due to proper hand washing, on "the inspector's" hands (1.86) and the new worker's hands (1.84) are almost identical, thereby validating the Skin Surface pH calibration Method.

b) The ratio (RΔpH) in change in pH, from baseline, for sites of the back of the hands to the sites on the front of the hands after proper hand washing on the Inspector's hands is 1.45 and that on the new worker's hands is 0.88. Thus, RΔpH is an additional indicator that can distinguish between accommodated and non-accommodated hands.

EXAMPLE 15

This study was carried out in order to determine the effect on skin surface pH of accommodating the hands of a dance instructor to proper hand washing. He washed his hands ten times per day with Ivory® soap for eight consecutive days. Before entering the Study, he was an infrequent hand washer who did not use the ServSafe Guidance procedures for hand washing and seldom washed the back of his hands. It was observed that his hands were calloused due to 6-8 hours per day of contact of his hands with the hands of clients. The outline and results of the study are displayed in FIG. 22.

Three weeks prior to the Accommodation Phase, baseline skin surface pH measurements were taken on the left hand followed by hand washing with Ivory® according to ServSafe Guidelines (Step 1 of FIG. 22). At baseline, the average skin surface pH of all sites was 4.19 and the average Ratio of skin surface pH of back of the hand sites (B) to front of the hand sites (F) of 0.97.

After completion of the baseline measurements, a hand washing challenge was carried out. After hand washing with Ivory®, the average pH of all sites is 5.29 with an average Ratio of skin surface pH of back of the hand sites (B) to the front of the hand sites (F) of 0.95 (Step 2 of FIG. 22). Thus, on the non-accommodated skin of this subject, the pH increased (ΔpH) by 1.11 unit. The average skin surface pH ratio of the back of the hands to the front of the hands was 0.95. The ratio for the skin surface pH of the BWJ sites 20 to the FWJ sites 22 was 0.94.

After eight days of washing the hands ten times per day with Ivory®, the baseline skin surface pH measurements were taken on all sites on both hands (Step 3 of FIG. 22). At baseline, the average skin surface pH of all sites was 4.73 and the average ratio of skin surface pH of back of the hand sites (B) to front of the hand sites (F) of 1.0. Thus, the accommodation process raised the average baseline skin surface pH from 4.19 to 4.73 and the skin surface pH ratio (B/F sites) rose from 0.97 to 1.0. More impressive was the rise in the skin surface pH on the BWJ site 20 from 4.07 to 4.63 and the R(BWJ 20/FWJ 22) from 0.96 to 1.05. Thus, the accommodation process has a greater effect on the skin surface pH of the sites on the top of the hands (BWJ 20 and the FWJ 22 sites) compared to the sites on the bottom of the hands.

Skin surface pH measurements were next taken after the hands were washed with Ivory® (Step 4 of FIG. 22). After hand washing, the average pH of all sites is 6.16 with an average Ratio of skin surface pH of back of the hand sites (B) to the front of the hand sites (F) of 0.95. Thus, on the accommodated skin of this subject, the pH increased (ΔpH) by 1.46 pH unit and the average R(B/F) was 0.95, which is identical with that at baseline. The ratio for the skin surface pH of the R(BWJ/FWJ) sites was higher, at 1.2.

Some interesting conclusions are drawn from this Study:

a) By accommodating the skin on the hands of this subject, skin surface pHs after hand washing rise to levels that would reliably validate that he has washed his hands.

That is, the range of values of 5.54 to 6.9 are above the 5.5 threshold, while before his skin was accommodated to Ivory®, his non-accommodated skin surface pHs rose to pHs between 4.90 and 5.75.

b) The skin surface pH ratio of the (BWJ 20/FWJ 22) sites converts from less than one to greater than one due to the accommodation process. This observation supports the use of the BWJ 20 and FWJ 22 sites for monitoring workers to determine if their hands are being washed frequently enough (i.e. that they acquire accommodated skin).

EXAMPLE 16

A repeat hand washing study, using Ivory® soap was carried out. Hand washing was done according to ServSafe Guidelines. Hand washing was done at sixty minute intervals on the non-accommodated hands of a dance instructor. Previous to this study, the dance instructor was an infrequent hand washer but had calloused hands due to contact with clients.

The results are presented in FIG. 23 and the results for the BWJ 20 and FWJ 22 sites, on the top of the hands, are illustrated in FIG. 24. After the first hand washing, the skin surface pHs were found to rise from 4.0-4.3 to 4.7-5.2. These values are below the pH 5.5 threshold, above which indicates that hand washing has been done. During the subsequent three hand washings, at sixty-minute intervals, the skin surface pHs on the BWJ 20 and FWJ 22 sites range from 4.4 to 5.8. As observed in FIG. 25, the Ratio of the skin surface pH on the BWJ site 20 to that on the FWJ site 22 is less than 0.96 at all but one measurement point. Thus, for the sites of interest on hands that are non-accommodated, the skin surface pHs do not reliably rise above a threshold of pH 5.5 and the Ratio of the skin surface pHs on the BWJ site 20 to the FWJ site 22 is less than 0.97.

The dance instructor underwent the accommodation of his hand skin by washing his hands, according to ServSafe Guidelines, with Ivory® soap. He washed an average of nine times per day for ten days (extension of EXAMPLE 15 above). This subject did not perceive any signs or symptoms of skin irritation during the accommodation phase.

Thereafter, on the following morning, he repeatedly washed his hands with Ivory® soap every thirty minutes for a total of six hand washings. Skin surface pH measurements were taken on six sites on both hands before and immediately after each hand washing.

The results are presented in FIG. 23. A plot of the time course of skin surface pH on the BWF and FWJ sites is shown in FIG. 24. After the first hand washing, the skin surface pHs on both sites increased from a range 4.6-4.8 to a range of 6.5-7.3. After the first hand washing on the first day, the skin surface pHs remained in a range of 5.5 to 7.7 over the course of the six hand washings and through a period of 1.5 hours or more after the last hand washing. The ratio of skin surface pH on the BWJ site 20 to the FWJ site 22 was in a range of 0.99-1.13 at points of measurement through out the Study indicating that the skin of this subject was accommodated.

It is of interest that the skin surface pH's drop below 5.5 within four hours after ceasing hand washing. This result indicates that healthy accommodated hands will recede to a skin surface pH that is not optimal for supporting bacterial growth within a four hour time frame after hand washing.

Comparing the first study on non-accommodated hands to the second study on accommodated hands of the same individual, some findings of significance are noted:

a) The Skin Surface pH Method for Diagnosing Proper Hand Washing and Sanitizing can be used to define an infrequent or improper hand washer when a skin surface pH response to hand washing that is below pH 5.5 and/or a ratio of skin surface pHs on the BWJ site 20 to the FWJ site 22 that is below 0.97.

b) The Skin Surface pH Method for Diagnosing Proper Hand Washing and Sanitizing can be used to define a frequent or proper hand washer when a skin surface pH rise above pH 5.5 in response to hand washing and/or a ratio of skin surface pHs on the BWJ site 20 to the FWJ site 22 that is above 0.99.

c) The Skin Surface pH Method for Diagnosing Proper Hand Washing and Sanitizing can be used to distinguish between a compliant and a non-compliant hand washer.

d) The Skin Surface pH Method for Diagnosing Proper Hand Washing and Sanitizing can be used to screen frequent, accommodated hand washers to assure that, after hand washing, their skin surface pH returns to a level below 6.0, which will not be optimal for supporting bacterial overgrowth within a specific time frame.

EXAMPLE 17

A follow-up study to the study described in EXAMPLE 16 involves a different soap hand washing challenge to the hands of the dance instructor whose hands have become accommodated to Ivory®.

Previous to this Study, he had washed his hands an average of nine times per day for ten days (extension of EXAMPLE 16 above). This subject did not perceive any signs or symptoms of skin irritation during the Accommodation Phase or when challenged with six hand washings with Ivory® soap at thirty-minute intervals.

The day after hand washing took place with the Ivory® soap challenge, the procedure was repeated, except that he washed his hands with Lava® soap. It is claimed by the manufacturer to be a heavy-duty hand cleaner. It contains pumice in addition to being an alkaline soap product. Skin surface pH measurements were taken on six sites on both hands before and immediately after each hand washing. The results are presented in FIG. 27. A plot of the time course of skin surface pH on the BWJ 20 and FWJ 22 sites is shown in FIG. 28.

Immediately after the first hand washing, the skin surface pHs on both sites increased from a range 4.42-4.45 to a range of 6.42 to 6.69. The skin surface pHs remained in a range of 5.63 to 7.45 over the course of the six hand washings. At one hour after the last hand washing, skin surface pH remained near 6.5 on the BWJ site 20 while it fell to near 5.5 on the FWJ site 22. Thus, as found previously, and discussed in the above EXAMPLES, a positive ratio of the skin surface pH on the BWJ site 20 to the FWJ site 22 is diagnostic of accommodated skin.

By 4.5 hours after the last hand washing, the skin surface pHs on both sites returned to baseline levels near 4.6. Thus, the skin on the hands, of this subject, would not support bacterial overgrowth.

EXAMPLE 18

An experiment was carried out to determine the effect of use of Purell® Instant Hand Sanitizer on skin surface pH after washing the hands with Lever 2000®. The results are shown in FIG. 29.

After baseline skin surface pHs were taken on all sites, on both hands, the hands were washed according to ServSafe Guidelines. After drying, Purell® Instant Hand Sanitizer was spread over the bottom of the right hand thereby coating the bottom of the hand sites (BH 12, FH 14, BIF 16, and FIF 18) with sanitizer. Care was taken to avoid placing the sanitizer on the top of the hand (BWJ 20 and FWJ 22 sites). After drying, skin surface pHs were taken on all sites.

The results show average skin surface pH increases of 6.69-6.94 for sites washed with Lever 2000® and not treated with Purell®, while the sites treated with Purell® had average skin surface pH increases of 5.78. Thus, the sanitizer, which contains 62% ethyl alcohol, suppressed the pH after washing the hands with Lever 2000® by 15.1%. It suppressed the increase on skin surface pH from baseline values by 55%. Thus, the use of a sanitizer, after washing the hands, can have a suppressing effect on the rise in skin surface pH. Given that the threshold for detection of proper hand washing is set at a skin surface pH of 5.5, proper hand washing would be detected even with the use of a hand sanitizer.

This example shows the need to develop a hand sanitizer that will not markedly affect the rise in skin surface pH due to proper hand washing.

EXAMPLE 19

From EXAMPLE 18 above, it was discovered that "state of the art" sanitizers are not acceptable, under all circumstances, for use when attempting to verify or monitor proper hand washing practices using the Skin Surface pH Method. This discovery has led to the devising of the following hand sanitizer compositions that will make feasible the use of the Skin Surface pH Method for Verifying and Monitoring Proper Hand Sanitizing practices: The essential ingredients of the composition are:

1) An alkalizing agent, or combination of such, at a total concentration 0.05 to 2% w/w that raises and maintains the pH of the formulation at a pH of 10 or higher;

2) An alcohol, or combination of alcohols, at a total concentration of 40-80% w/w; and 3) Water at 8-60% w/w.

It should be understood that % w/w represents the weight of the ingredient/total weight of the formulation×100.

Examples of alkalizing agents of "1" include sodium carbonate, boric acid, ethanolamine, triethanolamine, ammonia or any Generally Recognized as Safe (GRAS) alkalyzing agent that can raise the composition to a pH of 10 or higher.

Examples of alcohols in "2" include ethanol, isopropanol, n-propanol, isobutanol and n-butanol.

Examples of water in "3" include filtered water, distilled water and isotonic saline.

Thickeners (e.g., carboxypropyl cellulose, carboxymethyl cellulose), emollients (e.g., glycerin, hexylene glycol, propylene glycol, mineral oil), chelating agents (trisodium EDTA, sodium citrate), antioxidants (e.g., tocopheryl acetate, retinyl palmitate, benzophenone-4) and preservatives (e.g., parabens, sodium bisulfite) or cosmetic ingredients (e.g., FD&C Dyes, fragrance), familiar to those knowledgeable in the art, may also be present in the composition.

An experiment was carried out to demonstrate that a prototype hand sanitizer devised from the above compositions will facilitate the verifying and monitoring of compliance with proper hand sanitization by food service and health care workers.

A prototype product was created by adding seventeen parts of a 3% solution of aqueous soda ash (sodium carbonate) solution to on hundred parts of 70% isopropanol to yield a 60% isopropanol hand sanitizer with 0.43% sodium carbonate having a pH 11.67.

After baseline skin surface pHs were taken, both hands were treated with the Prototype. Care was taken to treat all areas of the hands and lower arms equally thereby insuring the sites to be tested were treated equally. The hands were allowed to dry. Skin surface pH measurements were taken at the intervals shown in FIG. 30. FIG. 31 is an illustration for the time course of skin surface pH measurements on the back wrist junction (BWJ) 20 and front wrist junction (FWJ) 22 sites.

The results indicate that immediately after treatment with the prototype hand sanitizer, skin surface pH on all sites tested, rises from baseline levels ranging from 4.48-5.34 to levels ranging from 6.74 to 7.65. Thus, any of the sites tested would be suitable for validating that the sanitizer was used by a worker.

FIG. 31 illustrates the time course of skin surface pH on the BWF 20 and FWJ 22 sites. The skin surface pH on both sites rises above 6.5 after treatment, with the skin surface pH on the BWJ site 20 rising above 7.5. Within fifteen minutes, the skin surface pH on the FWJ site 22 has fallen to below 5.5, while the skin surface pH on the BWJ site 20 persists near a pH of six or higher for two hours or longer.

As noted from FIG. 30 and plotted in FIG. 32, the ratio of skin surface pH for the back of the wrist junction (BWJ) 20 to that of the front of the wrist junction (FWJ) 22 sites increases rapidly for the first thirty minutes after hand treatment and then slowly thereafter until at least two hours after treatment. Thus, by measuring the skin surface pH on the BWJ 20 and FWJ 22 sites and taking the ratio of these numbers, it is possible to determine if use of the hand sanitizer prototype had taken place within thirty minutes of the skin surface pH measurements.

For example, to validate recent and proper use of the prototype hand sanitizer, within the last thirty minutes, the skin surface pH on the BWJ site 20 and the FWJ site 22 would be above pH 5.5 or the pH on the BWJ site 20 would be above pH 5.5 and the ratio of the pH on the BWJ site 20 to that on the FWJ site 22 would be below 1.25.

The results also infer that improper hand sanitizing or no hand sanitizing took place if the skin surface pHs on both sites are below pH 5.5 and the ratio of skin surface pH for the back of the wrist junction (BWJ) 20 to that of the front of the wrist junction (FWJ) 22 sites is below 1.1.

By using skin surface pH for optimization, it is possible to develop a hand sanitizing product that will meet several criteria, preferably including:

1. It would be non-irritating to the skin when multiple treatments of the hands takes place;
2. It will allow for skin surface pH measurements to diagnose improper hand sanitizing by both accommodated and non-accommodated hand washers;
3. Upon proper hand sanitizing, the skin surface pH will rise from baseline at least 2 pH units on the back wrist junction (BWJ) 20 (or other sites on the back of the hand) and will rise at least 1.5 pH unit from baseline on the front wrist junction (FWJ) 22 (or other sites on the front of the hand);
4. After proper hand sanitizing by an accommodated hand washer, the skin surface pH on the back wrist junction (BWJ) 20 will recover to levels higher than the skin surface pH on the front wrist junction (FWJ) 22;
5. Proper hand sanitizing with the optimized prototype, by an accommodated hand washer, will maintain the ratio of skin surface pH on the back wrist junction (BWJ) 20 to that on the front wrist junction (FWJ) at 1.0 or higher;
6. The product will be stable over the shelf life of the Product; and 7. The optimized hand sanitizing product will be compatible with use of other hand related products including hand washing products, hand creams and moisturizers.

EXAMPLE 20

An experiment was carried out to determine the effect on skin surface pH of washing the hands with Ivory® soap followed by treatment of the hands with the Prototype hand sanitizer described in EXAMPLE 19, above. The results are displayed in FIG. 33.

Two hours after both hands were treated with the Prototype hand sanitizer (see EXAMPLE 19), the hands were washed with Ivory® soap according to ServSafe Guidelines. Immediately thereafter, skin surface pH measurements were taken. The skin surface pH on all sites ranged from 6.54 to 7.89.

Next, the hands were treated for a second time with the Prototype hand sanitizer. Skin surface pH measurements were then taken on the sites. Immediately after treatment, the skin surface pH on all sites ranged from 8.52 to 9.12. The skin surface pH on all sites persisted above pH 7.5 for at least thirty minutes. By sixty minutes, the skin surface pH on some of the sites fell below 7.5. Thus, the use of an alkaline soap followed by the use of the alkaline Prototype hand sanitizer affected a skin surface pH greater than 7.5 on all sites on the hands that lasted for at least thirty minutes.

The use of an alkaline soap product plus the use of an alkaline hand sanitizer create a skin surface pH condition that is adverse for bacterial growth on the hands for at least thirty minutes after hand washing and sanitizing with both products.

The results presented in FIG. 29 indicate that by 6.5 hours after washing with Ivory® soap and sanitizing with the Prototype, the skin surface pH on all sites have returned to baseline values.

EXAMPLE 21

An experiment was simulated to demonstrate that skin surface pH could be used to educate a worker to correct an improper hand washing practice. A worker was observed to wash the bottom of his hands (BH 12, FH 14, BIF 16, and FIF 18 sites) for twenty seconds, with soap, while neglecting to wash the top part of the hands (BWJ 20 and FWJ 22 sites).

The "manager" observed this improper hand washing procedure. The "manager" proceeded to take skin surface pH measurements on the "worker's" sites. The average skin surface pH on the sites on the bottom of the hands was 7.02, while that on the top of the hands was 5.41. The worker was shown the results so that he could observe that the values on the top of the hands were much lower. It was pointed out that the skin surface pH, on the sites on the top of the hands, was lower than pH 5.5, the threshold skin surface pH for indicating proper hand washing. Thus, the "worker" was given a demonstrative lesson in proper hand washing.

EXAMPLE 22

A situation was simulated by which an "Inspector" observes a "nurse" entering a "patient's" room from the direction of the rest room. The "Inspector" needs to know if the "nurse" washed her hands properly before interacting with the "patient."

The "Inspector" takes a skin surface pH measurement on a site of the front wrist junction (FWJ) 22 of her left hand (she is right handed). The skin surface pH is found to be 5.3.

The "Inspector" then requests that the "nurse" wash her hands according to ServSafe Guidelines. Immediately thereafter, the "Inspector" measures skin surface pH on the BWJ 20 and FWJ 22 sites. The skin surface pH on the FWJ 22 is 7.2 and that on the BWJ 20 site is 7.6.

The results indicate that a) before entering the "patient's" room, the "nurse" did not wash her hands; and b) the "nurse" is not a frequent hand washer since the a skin surface pH ratio of the BWJ 20/FWJ 22 site was found to be 0.95, which is indicative of non-accommodated skin. She is then given a lesson in proper hand washing.

EXAMPLE 23

In practice, any method that provides reliable information, related to pH of skin is acceptable. Skin surface pH can be measured by any pH meter that can accommodate an electrode that contacts the skin. pH indicator dyes can also used. These dyes are available commercially and are often embedded in pH indicator paper strips. pH indicator dyes have also been incorporated into fiber optic sensors and associated instrumentation for measuring pH has been recently developed. Such instrumentation is commercially available from World Precision Instruments and Ocean Optics.

An example of a portable skin surface pH meter is the ExStik pH Meter Model pH 100 (ExTech Instruments Corp., Waltham, Mass. 02451, USA). This instrument has been used to perform most of the pH measurements included in this patent. And commercially available pH paper strips are manufactured by several companies including 1) colorpHast® from Sanitation tool.com and 2) Aquachek® from Hach Company (Loveland, Colo. 80539, USA).

1) ColorpHast® strips have a pH range of 4.0 to 7.0. A range of graduated pH units of 0.2 to 0.4 is available on the package containing the strips. It should be clearly understood, however, that substantial benefit may be derived from any reliable pH measuring device.

A hand washing experiment, using Ivory® soap, was carried out to compare skin surface pHs on the back wrist junction (BWJ) sites 20 and the front wrist junction (FWJ) 22 sites on both hands (N=2/site). Simultaneous skin surface pH measurements were taken with the ExTech pH meter and the colorpHast® strips. The ExTech pH meter was calibrated at pH 4.0 and 7.0 immediately before use. Baseline skin surface pH measurements on the BWJ 20 were taken first, followed by skin surface pH measurements on the FWJ site 22. The ExTech electrode was wetted by dipping it in distilled water and applying it to the designated site. The pH reading was allowed to come to a steady state (10-30 seconds) and the pH recorded. Next, a colorpHast® strip was placed in the drop of water remaining on the site on the skin. The strip was allowed to remain there for sixty seconds before it was removed. Ten minutes was allowed for the color to fully develop. The color of the strip was then matched to the color on the range on the package provided by the manufacturer. The procedures described above were repeated for the BWJ 20 and FWJ 22 sites on each hand. The same procedure took place immediately after the hands were washed according to ServSafe Guidelines.

The results are presented in FIG. 34. There is a reasonably good comparison between the two methods of measuring skin surface pH for the baseline skin surface pH measurements. The measurements performed with the colorpHast® strips yield pH values about 0.2 to 0.3 pH units lower than that found with measurements made with the ExTech pH meter. Comparison of the two methods after hand washing shows a wider difference in skin surface pHs. That is, skin surface pHs found on the sites using the colorpHast® strips are 0.8 to 0.9 pH units lower than that found for measurements made with the ExTech pH meter. Regardless of this disparity, the colorpHast® strips could be utilized to validate hand washing with Ivory® soap since the pH is found to rise above the critical level of pH 5.5.

2) Aquachek®'s pH range is from pH 6.2 to 8.4. An experiment was carried out involving washing the hands for 20 seconds with Lever 2000®, rinsing for 10 seconds with a paper towel according to ServSafe Guidelines. A strip of Aquachek® pH paper was placed for 2 seconds on right palm that was previously dampened with distilled water. Thirty seconds was allowed for color to develop. Matching colors with the pH range on the label indicated that the pH reached 7.8. Ten minutes was allowed to pass and a strip of Aquachek® pH paper was again placed on the dampened palm for two seconds. Matching colors with the pH range on the label indicated that the pH had fallen to below pH 6.2. This result indicates that that Aquachek® pH paper could possibly be used to validate hand washing when used with hand washing formulations that raise the pH of the skin to levels higher than 6.2.

EXAMPLE 24

An experiment was simulated to demonstrate how a qualified instructor in the Skin Surface pH Method for Diagnosing Proper Hand Washing and Sanitizing, can test a "student" for qualification as a Certified Skin Surface Method Specialist—for monitoring proper hand washing.

The "instructor" does not wash his hands or touch objects that alter skin surface pH for four hours prior to the test. The "instructor" performs skin surface pH measurements on the sites on both of his hands for a total of twelve measurements. Next, he requests that the "student" immediately carry out skin surface pH on the same sites on the "instructor's" hands. If the average of the skin surface pH values (N=12) found by the "student" and that found by the "instructor" do not vary by more than 2%, and the comparative skin surface pH values on each site do not vary, between "student" and "instructor's" measurements, by more than 4%, then the "student" is certified to carry out skin surface pH measurements for validating and monitoring proper hand washing procedures.

EXAMPLE 25

Dove® Bar was purchased from a local market (Lot # 7418226800) and found, by label, to contain the following ingredients in decreasing order: sodium cocyl isethionate, stearic acid, coconut acid, sodium tallowate, sodium isethionate, water, sodium stearate, cocoamidopropyl betaine, sodium cocoate or sodium palm kernelate, fragrance, sodium chloride, tetrasodium EDTA, tetrasodium etidronate, BHT, titanium dioxide (cl 77891). The pH of a slurry of Dove® Bar was found to be 7.06.

Soft Soap® was purchased from a local market (Lot # 7418226800) and found, by label, to contain the following ingredients in decreasing order: water, sodium laureth sulfate, cocoamidopropyl betaine, decyl glucoside, fragrance, DMDM hydantoin, sodium chloride, PEG-120 methyl glucose dioleate, tetrasodium EDTA, sodium sulfate, polyquaterium-7, citric acid, poloxamer 124, PEG-7 glyceryl cocoate, D&C Red # 33, FD&C blue No. 1. The pH of the product was found to be 7.69.

Ivory® soap was purchased from a local market (Lot # 3700032136). It is labeled 99 44/100% pure (sodium tallowate). The pH of a slurry of Ivory® soap was found to be 9.56.

Lever 2000® Bar was purchased from a local market (Lot # 1111132924 1) and found, by label, to contain the following ingredients in decreasing order: sodium tallowate, sodium cocoate, water, stearic acid, cocoamidopropyl betaine, sodium chloride, fragrance, sodium methyl 2-sulfolaurate, petrolatum, tocopheryl acetate (vitamin E acetate), mineral oil, *helianthus annuus* (sunflower) seed oil, glycerine, coconut acid, sodium stearate, sodum sulfate, disodium 2-sulfolaurate, tetrasodium EDTA, tetrasodium etidronate, BHT, titanium dioxide (cl 77891). The pH was found to be 9.19.

Method® was purchased from a local market. The ingredients are listed in decreasing order as: water, sodium methyl 2-laurylsulfolaurate, disodium 2-laurylsulfolaurate, sodium lauryl sulfoacetate, cocoamidopropyl betaine, glycerin, aloe barbadenis gel, jojoba leaf extract, retinyl palmitate (Vitamin A), tocopheryl acetate (Vitamin E), grape seed oil, citric acid, sodium hydroxide, benzophenone 4, DMDM hydantoin, Fragrance, Violet 2. The pH was found to be 5.16.

KIRKLAND Dish liquid antibacterial hand soap contains the following ingredients in decreasing order: sodium laureth sulfate, urea, sodium methyl 2-sulfopalmatate, sodium dodecylbenzene sulfonate, denatured alcohol, lauramine oxide, magnesium chloride, disodium 2-sulfopalmitate, methyl palmitate, sodium citrate, trisodium EDTA, sodium bisulfite, fragrance, benzophenone-4, methylchloroisothiazoline, and D&C Orange #4. The pH was found to be 8.62.

Norwegian® Hand Cream (Neutrogena, Los Angeles, Calif.) was purchased from a local market. Its ingredients, in decreasing order are listed as: water, glycerin, cetearyl alcohol, stearic acid, sodium cetearyl sulfate, methyl paraben, propyl paraben, dilauryl thio dipropionate, sodium sulfite.

Lava (Wd-40 Company, San Diego, Calif. # 7956710086) was purchased from a local market. The ingredients are listed as sodium tallowate, sodium cocoate, pumice, water, glycerin, coconut acid, sodium carbonate, fragrance, sodium chloride, tetrasodium etidronate, pentasodium pentetate, titanium dioxide, chromium hydroxide green, D&C Yellow No. 10. The pH was found to be 9.70.

Purell® Instant Hand Sanitizer was obtained from a local market and is labeled to have 62% ethyl alcohol as the active ingredient. The pH was found to be 7.24.

While the invention has been particularly shown and described with reference to preferred embodiments thereof, it will be understood by those skilled in the art that the foregoing and other changes in form and details may be made therein without departing from the spirit and scope of the invention. For example skin surface pH measurements could be taken from other areas of the hands. Furthermore, the method and compositions may be used in places other than in the food service, food production, and health care industries. Still further, while it is preferred that hands be scrubbed for at least twenty seconds, according to current ServSafe Guidelines, it should be clearly understood that the hands may be scrubbed for any predetermined amount of time that is sufficient for proper hand washing.

I claim:

1. A method for verifying and monitoring hand washing and sanitizing practices comprising the steps of:

measuring skin surface pH of at least one of a hand and a lower arm of a user, wherein measuring skin surface pH of said at least one of a hand and a lower arm of said user comprising the steps of:

placing a pH measuring device on at least one skin surface of said at least one of a hand and a lower arm of said user;

holding said pH measuring device in contact with said at least one skin surface until said pH measuring device reaches a steady state; and reading at least one measurement of at least one skin surface pH from said pH measuring device; and comparing said skin surface pH of said at least one of a hand and a lower arm of said user with a predetermined skin surface pH range, wherein a measured skin surface pH below the predetermined pH number on said skin surface pH range indicates that said at least one of a hand and a lower arm of said user being improperly washed and wherein a measured skin surface pH above the predetermined pH number on said skin surface pH range indicates that said at least one of a hand and a lower arm of said user being properly washed;

reading a first measurement of a first skin surface pH from said pH measuring device;

reading a second measurement of a second skin surface pH from said pH measuring device;

calculating a skin surface pH ratio of said first measurement of said first skin surface pH to said second measurement of said second skin surface pH; and comparing said skin surface pH ratio of said first measurement of said first skin surface pH to said second measurement of said second skin surface pH with a predetermined skin surface pH ratio range, wherein a measured skin surface pH ratio below the predetermined skin surface pH ratio on said skin surface pH ratio range indicates that said at least one of a hand and a lower arm of said user being improperly washed, and wherein measured skin surface pH ratio above the predetermined skin surface pH ratio on said skin surface pH ratio range indicates that said at least one of a hand and a lower arm of said user being properly washed.

2. The method of claim 1 further comprising the steps of:

providing a hand cleanser;

wetting said at least one of a hand and a lower arm of said user with water;

applying said hand cleanser to said at least one of a hand and a lower arm of said user;

scrubbing said at least one of a hand and a lower arm of said user with said hand cleanser for the predetermined period of time; and rinsing off said hand cleanser from said at least one of a hand and a lower arm of said user with water.

3. The method of claim 2 wherein said predetermined period of time being at least twenty seconds.

4. The method of claim 2 wherein said hand cleanser being one of a soap, a surfactant, and a hand washing foam.

5. The method of claim 2 wherein said hand cleanser being alkaline.

6. The method of claim 2 wherein said hand cleanser having a pH between 2 and 12.

7. The method of claim 1 further comprising the steps of:

providing a hand sanitizer;

applying said hand sanitizer to said at least one of a hand and a lower arm of said user; and rubbing said at least one of a hand and a lower arm of said user with said hand sanitizer.

8. The method of claim 7 wherein said hand sanitizer comprising a ratio of:

at least one alkalizing agent having a total concentration of between approximately 0.05% and approximately 2% w/w;

at least one alcohol having a total concentration of between approximately 40% and approximately 80% w/w; and water between approximately 8% and approximately 60% w/w.

9. The method of claim 7 wherein said hand sanitizer being alkaline and raising a pH of said hand sanitizer to at least 10.

10. The method of claim 1 wherein said pH measuring device being a pH meter.

11. The method of claim 10 further comprising the step of wetting said at least one skin surface of said at least one of a hand and a lower arm of said user with distilled water before placing electrodes of said pH meter on said at least one skin surface of said at least one of a hand and a lower arm of said user.

12. The method of claim 1 wherein said pH measuring device being pH paper.

13. The method of claim 1 wherein said at least one skin surface of said at least one of a hand and a lower arm of said user being on one of a center back portion of said hand, a center front portion of said hand, a front upper section of an index finger of said hand, a back upper section of said index finger of said hand, a center front wrist junction of said hand, and a center back wrist junction of said hand.

14. The method of claim 1 wherein said first skin surface pH being measured from a center back wrist junction of said hand and wherein said second skin surface pH being measured from a center front wrist junction of said hand.

15. The method of claim 1 wherein measuring skin surface pH of said at least one of a hand and a lower arm of said user occurs immediately after cleaning said at least one of a hand and a lower arm of a user with said hand cleanser.

16. The method of claim 1 wherein measuring skin surface pH of said at least one of a hand and a lower arm of said user occurs after at least one set time interval after cleaning said at least one of a hand and a lower arm of said user with said hand cleanser.

17. A method for verifying and monitoring hand washing and sanitizing practices comprising the steps of:

placing a pH measuring device on at least one skin surface of at least one of a hand and a lower arm of a user;

holding said pH measuring device in contact with said at least one skin surface for between approximately ten and approximately thirty seconds until said pH measuring device reaches a steady state;

reading at least one measurement of at least one skin surface pH from said pH measuring device;

comparing said skin surface pH of said at least one of a hand and a lower arm with the predetermined skin surface pH range, wherein a measured skin surface pH below the predetermined pH number on said skin surface pH range indicates that said at least one of a hand and a lower arm of said user being improperly washed and wherein a measured skin surface pH below the predetermined pH number on said skin surface pH range indicates that said at least one of a hand and a lower arm of said user being properly washed;

reading a first measurement of a first skin surface pH from said pH measuring device;

reading a second measurement of a second skin surface pH from said pH measuring device;

calculating a skin surface pH ratio of said first measurement of said first skin surface pH to said second measurement of said second skin surface pH; and comparing said skin surface pH ratio of said first measurement of said first skin surface pH to said second measurement of said second skin surface pH with a predetermined skin surface pH ratio range, wherein a measured skin surface pH ratio below the predetermined skin surface pH ratio on said skin surface pH ratio range indicates that said at least one of a hand and a lower arm of said user being improperly washed, and wherein a measured skin surface pH ratio above the predetermined skin surface pH ratio on said skin surface pH ratio range indicates that said at least one of a hand and a lower arm of said user being properly washed.

18. The method of claim 17 further comprising the steps of:

providing an alkaline hand cleanser;

wetting said at least one of a hand and a lower arm of said user with water;

applying said alkaline hand cleanser to said at least one of a hand and a lower arm of said;

scrubbing said at least one of a hand and a lower arm of said user with said alkaline hand cleanser for at least twenty seconds;

rinsing off said alkaline hand cleanser from said at least one of a hand and a lower arm of said user with water; and drying said at least one of a hand and a lower arm of said user.

19. The method of claim 18 further comprising the steps of:

providing an alkaline hand sanitizer;

applying said hand sanitizer to said at least one of a hand and a lower arm of said user; and rubbing said at least one of a hand and a lower arm of said user with said hand sanitizer in order to maintain said skin surface pH of at least 7.5 for at least thirty minutes.

20. The method of claim 18 wherein said alkaline hand cleanser being one of a soap, a surfactant, and a hand washing foam.

21. The method of claim 17 wherein said pH measuring device being a pH meter and wherein said method further comprising the step of wetting said at least one skin surface of said at least one of a hand and a lower arm of said user with distilled water before placing electrodes of said pH meter on said at least one skin surface of said at least one of a hand and a lower arm of said user.

22. A system for verifying and monitoring hand washing and sanitizing practices comprising:

a pH measuring device for measuring skin surface pH of at least one of a hand and a lower arm of a user;

the predetermined skin surface pH range to which said skin surface pH of said at least one of a hand and a lower arm is compared, wherein a measured skin surface pH below the predetermined pH number on said skin surface pH range indicates that said at least one of a hand and a lower arm of said user being improperly washed and wherein a measured skin surface pH above the predetermined pH number on said skin surface pH range indicates that said at least one of a hand and a lower arm of said user being properly washed; and the predetermined skin surface pH ratio range, wherein a measured skin surface pH ratio below the predetermined skin surface pH ratio on said skin surface pH ratio range indicates that said at least one of a hand and a lower arm of said user being improperly washed, and wherein a measured skin surface pH ratio above the predetermined skin surface pH ratio on said skin surface pH ratio range indicates that said at least one of a hand and a lower arm of said user being properly washed.

23. The system of claim 22 wherein a skin surface pH ratio of said at least one of a hand and a lower arm of said user being calculated with a first skin surface pH measured from a center back wrist junction of said hand of said user and with a second skin surface pH measured from a center front wrist junction of said hand of said user.

24. The system of claim 22 further comprising a hand cleanser.

25. The system of claim 24 wherein said at least one hand cleanser being one of a soap, a surfactant, and a hand washing foam.

26. The system of claim 22 further comprising a hand sanitizer.

27. The system of claim 26 wherein said hand sanitizer having a pH of at least 10 and wherein said hand sanitizer comprising a ratio of:

at least one alkalizing agent having a total concentration of between approximately 0.05% and approximately 2% w/w;

at least one alcohol having a total concentration of between approximately 40% and approximately 80% w/w; and water between approximately 8% and approximately 60% w/w.

28. The system of claim 22 wherein said pH measuring device being one of pH paper and a pH meter.

29. A method for verifying and monitoring hand washing and sanitizing practices comprising the steps of:

providing a hand sanitizer;

applying said hand sanitizer to at least one of a hand and a lower arm of a user;

rubbing said at least one of a hand and a lower arm of said user with said hand sanitizer;

measuring skin surface pH of said at least one of a hand and a lower arm of a user;

comparing said skin surface pH of said at least one of a hand and a lower arm of said user with the predetermined skin surface pH range, wherein a measured skin surface pH below the predetermined pH number on said skin surface pH range indicates that said at least one of a hand and a lower arm of said user being improperly washed and wherein a measured skin surface pH above the predetermined pH number on said skin surface pH range indicates that said at least one of a hand and a lower arm of said user being properly washed; and wherein said hand sanitizer comprising a ratio of:

at least one alkalizing agent having a total concentration of between approximately 0.05% and approximately 2% w/w;

at least one alcohol having a total concentration of between approximately 40% and approximately 80% w/w; and water between approximately 8% and approximately 60% w/w.

30. A system for verifying and monitoring hand washing and sanitizing practices comprising:

a pH measuring device for measuring skin surface pH of at least one of a hand and a lower arm of a user;

the predetermined skin surface pH range to which said skin surface pH of said at least one of a hand and a lower arm is compared, wherein a measured skin surface pH below the predetermined pH number on said skin surface pH range indicates that said at least one of a hand and a lower arm of said user being improperly washed and wherein a measured skin surface pH above the predetermined pH number on said skin surface pH range indicates that said at least one of a hand and a lower arm of said user being properly washed; and a hand sanitizer;

wherein said hand sanitizer having a pH of at least 10 and wherein said hand sanitizer comprising a ratio of:

at least one alkalizing agent having a total concentration of between approximately 0.05% and approximately 2% w/w;

at least one alcohol having a total concentration of between approximately 40% and approximately 80% w/w; and water between approximately 8% and approximately 60% w/w.

* * * * *